United States Patent [19]

Shoji et al.

[11] Patent Number: 4,696,880

[45] Date of Patent: Sep. 29, 1987

[54] METHOD AND APPARATUS FOR REPRODUCING MULTI-COLOR IMAGE AND PHOTORECEPTOR THEREOF

[75] Inventors: Hisashi Shoji; Satoshi Haneda; Seiichiro Hiratsuka, all of Hachioji, Japan

[73] Assignee: Konishiroku Photo Industry Co., Ltd., Tokyo, Japan

[21] Appl. No.: 772,651

[22] Filed: Sep. 4, 1985

[30] Foreign Application Priority Data

| | | | |
|---|---|---|---|
| Sep. 6, 1984 | [JP] | Japan | 59-185439 |
| Sep. 6, 1984 | [JP] | Japan | 59-185440 |
| Sep. 6, 1984 | [JP] | Japan | 59-187044 |
| Sep. 6, 1984 | [JP] | Japan | 59-198127 |

[51] Int. Cl.[4] ..... G03G 13/01; G03G 13/22

[52] U.S. Cl. ..... 430/42; 430/46; 430/55

[58] Field of Search ..... 430/42, 46, 55

[56] References Cited

U.S. PATENT DOCUMENTS

| | | | |
|---|---|---|---|
| 3,413,117 | 11/1968 | Gaynor | 430/42 X |
| 3,836,363 | 9/1974 | Plutchak | 430/46 |
| 3,898,082 | 8/1975 | Giaimo | 430/42 |
| 4,291,109 | 9/1981 | Whitmore | 430/42 |
| 4,604,337 | 8/1986 | Mimura et al. | 430/46 |

FOREIGN PATENT DOCUMENTS

| | | | |
|---|---|---|---|
| 2524164 | 9/1982 | France | 430/42 |
| 52-74341 | 6/1977 | Japan | 430/42 |

*Primary Examiner*—Roland E. Martin

*Attorney, Agent, or Firm*—Jordan B. Bierman

[57] ABSTRACT

A multi-color imaging method wherein a photo-receptor having a photoconductive layer on a conductive member and having on the photoconductive layer an insulating layer comprising a different-color fine-filter distributed layer. The surface of the photo-receptor is image exposed while being changed, then given a flood exposure of specific light to the surface to form a potential pattern on the portion of specific filters and a step to develop the potential pattern is repeated at least twice depending on the type of filter, and a changing process that uniformalizes the potential on the surface is given before the second flood exposure and therewith every time.

12 Claims, 28 Drawing Figures

E (V)
1000
500
0
B R G B R
1
2
3
41
4
5
LR
LB
FB
6B

FIG.8[4]
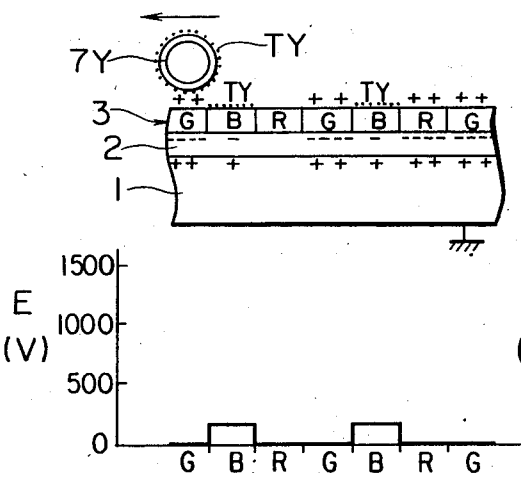
FIG.8[5]
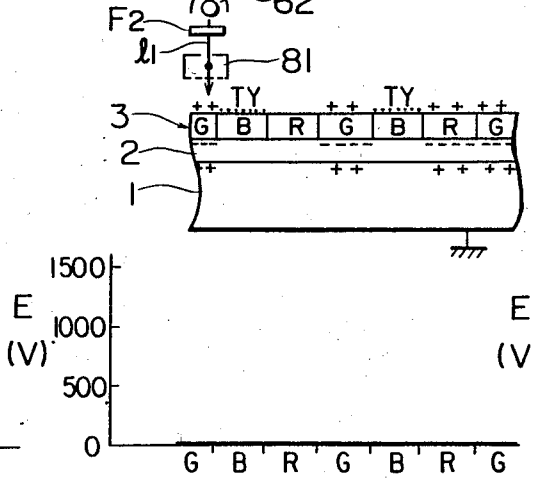
FIG.8[6]
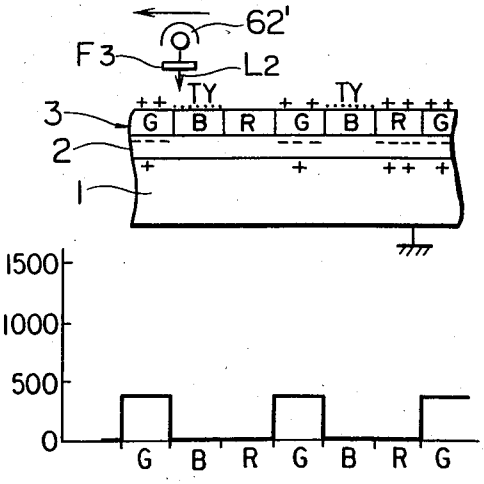

FIG.8[10]
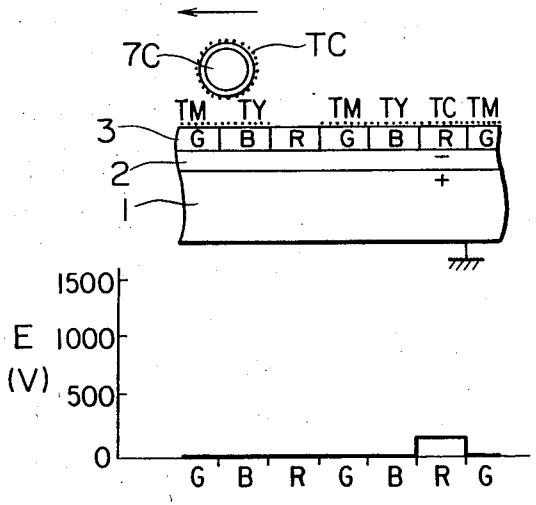
FIG.8[9]
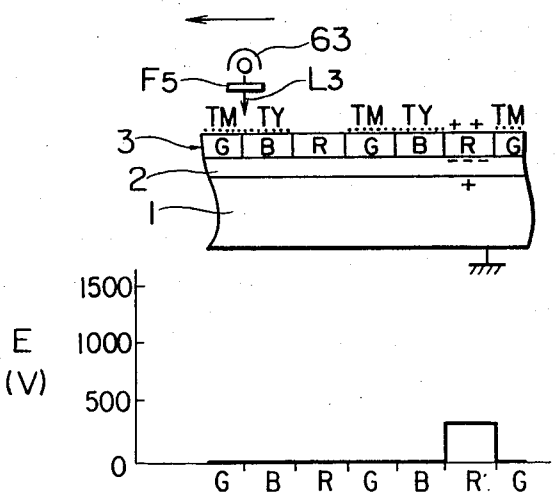

B R G B R G B R
1
2
3
4
5
6
LI
W
BK
F
E (V)
2000
1000
0

FIG.28[1]
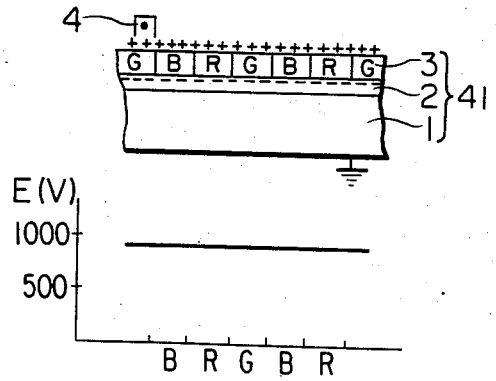
FIG.28[2]
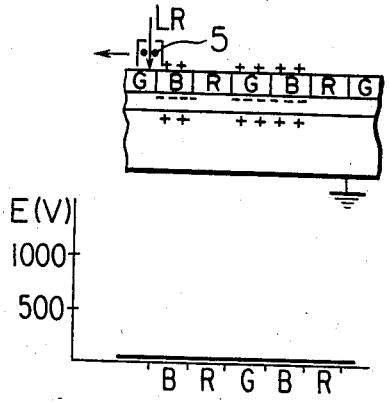
FIG.28[4]
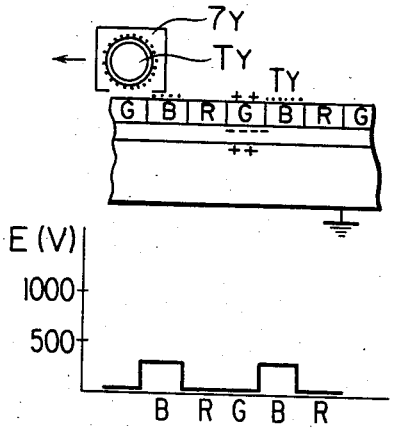
FIG.28[3]
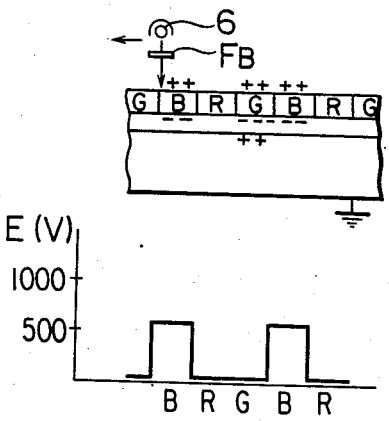
FIG.28[5]
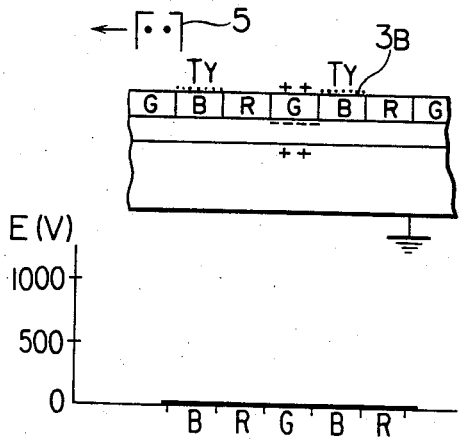

METHOD AND APPARATUS FOR REPRODUCING MULTI-COLOR IMAGE AND PHOTORECEPTOR THEREOF

BACKGROUND OF THE INVENTION

The present invention relates to an image-reproducing method, an apparatus and a photoreceptor thereof and more particularly to a multi-color-image-reproducing method that reproduces multi-color images by the use of an electrophotographic method, a photoreceptor thereof and a multi-color-image-reproducing apparatus therefor.

Many methods for obtaining multi-color images by the use of an electrophotographic method and apparatus to be used for the methods have hitherto been proposed and they are generally classified roughly as follows. In one method thereof, latent-image-formings and developings with color toners are repeated in accordance with the number of color separation wherein a photoreceptor is used and colors are superposed on a photoreceptor or colors are superposed on a transferring member through the transfer onto the transferring member, each time of developing. In the other method, an apparatus having a plurality of photoreceptors according to the number of color separation is used and a light-image of each color is projected on each photoreceptor concurrently with other light-images of other colors and a latent image thus formed on each photoreceptor is developed with color toner and then transferred successively on transferring members, thus multi-color images are obtained after superposing of colors.

In the first method mentioned above, however, a plurality of latent-image-formings and developing processes should be repeated, therefore the image-recording is time-consuming and speedup thereof is very difficult, which is a disadvantage. In the second method mentioned above, on the other hand, a plurality of photoreceptors are used in parallel which is advantageous on the point of speedup but an apparatus tends to be complicated, bulky and expensive because of a plurality of photoreceptors, optical systems and developing units required and thus it is not practical. Further, aforesaid two methods have a serious disadvantage that positioning of images for repetion of image-forming and of transferring in plural times is difficult, thus it is impossible to prevent completely the color-slip on the image.

In Japanese Patent Publication Open to Public Inspection No. 74341/1977 (hereinafter referred to as Japanese Patent O.P.I. Publication), on the other hand, there is disclosed a method wherein a photoreceptor having a filter for colors in mosaic pattern formed on photoconductive layer thereof as an insulating layer is used for reproducing multi-color images but it offers no satisfactory image quality and thereby it has not been put on practical use.

SUMMARY OF THE INVENTION

An object of the present invention devised in view of the foregoing is to provide a multi-color-image-reproducing method wherein electrostatic latent images for plural color separation number can be formed through a single exposure of a document image and thereby no color-slip takes place and a portion which has been developed first and is to accept toners does not accept toners being developed later, thus multi-color images in high quality can be reproduced through a fast and simple process.

Aforesaid object may be achieved by the following multi-color-image-reproducing method. Namely, it is a multi-color-image-reproducing method wherein a photoreceptor having a photoconductive layer arranged on the conductive member thereof and having, on the photoconductive layer, an insulating layer comprising a different-color-fine-filter-distributed layer is used and after the surface of the photoreceptor has been subjected to an image-exposure while being electrically charged, a step to give a flood exposure of specific light to the surface of the photoreceptor and to form a potential pattern on the portion corresponding to the specific filters in the aforesaid filters and a step to develop the electrostatic latent image formed according to the potential pattern are repeated at least twice or more depending on the type of aforesaid filter, and a charging process that uniformalizes the potential on the photoreceptor surface is given before the second flood exposure and thereafter every time. Namely, a photoreceptor having a insulating layer in which plural color-separation filters (for the transmission of specific wavelength light) are arranged in the form of fine line type or of mosaic type provided on the photosensitive layer having the photosensitivity for the entire range of visible ray, is used and an image-exposure is first given to the entire surface of the photoreceptor, thus electric charges are distributed on the lower photosensitive layer of each filter (hereinafter referred to as a primary latent image) depending on the separated image density. Then a flood exposure by the light identical to the one transmitting the color of the first color separation filter is given to the surface of the photoreceptor and thereby electrostatic images (hereinafter referred to as a secondary latent image) corresponding to the primary latent image are formed only on the photoconductive layer at the lower part of the filter and then they are developed with color toners whose color corresponds to the type of the filter, for example, a complementary color for the color transmitting the filter, then the charging is given for uniformalizing the potential on the photoreceptor surface and the operations including flood exposure, developing and re-charging identical to the foregoing are repeated for color separation images in succession, thus multi-color images are formed on the photoreceptor and then the multi-color images are recorded on the transferring member through only one transferring.

Another object of the invention is to provide, for the better effect, a solution for the problems which may be encountered in working of aforesaid method of reproducing multi-color images. Even in the case that the voltage-flattening is made by aforesaid re-charging, charges (e.g. negative charge) remain on the photoconductive layer at toner-adhering portion, which creates a concern that these charges are eliminated by the flood exposure in the following step for toner-image-forming and thereby the surface potential of the photoreceptor is enhanced. Under such condition, there is a possibility that the next toner of another color is superposed on the preceding toner and thereby the turbidity of colors takes place. Therefore, the object of the invention is to provide a method wherein multi-color images which are excellent in color reproduction quality and have no color turbidity are obtained at low cost.

Aforesaid object may be achieved by the following image-forming method. Namely, the method for reproducing multi-color images comprises a step for giving an image-exposure to the photoreceptor through the filter layer consisting of plural filter portions and a step for the repetition of operations wherein the development is made after a flood exposure by the light transmitting at least one kind of aforesaid filter portions and then at least a part of charges remaining on the photoconductive layer in the area where toner is adhered through the aforesaid development are eliminated and thereby the surface potential of the photoreceptor is uniformalized.

Further object of the present invention is as follows. Namely, when it is planned to use the filter that transmits the light only in the prescribed wavelength band such as a B-filter, G-filter and R-filter which are normal filters as a mosaic filter, various restrictions can not be avoided on the selection of the material of the filter practically for obtaining the light in the ample amount because the width of wavelength band is narrow, which is not desirable. Therefore, aforesaid method for reproducing multi-color images is for obtaining the same purpose in easier way and is based on that the portion where image-forming has been finished in aforesaid process does not cause any problem even if it is exposed to the light of flood exposure given thereafter. Aforesaid object may be achieved by the following constituent.

The photoreceptor comprising the insulating layer containing the filter that transmits the short wavelength band of visible rays, the filter transmitting the medium wavelength band of visible rays and the filter transmitting the long wavelength band of visible rays. the photoconductive layer having the spectral sensitivity covering at least total wavelength band of visible rays and the conductive substrate, is given an image-exposure while it is being given electric charges. After that, the entire surface of the photoreceptor is exposed evenly to the primary light (L1) that contains the light component transmitting any one kind (F1) of aforesaid 3 kinds of filters and does not substantially contain the light components transmitting other 2 kinds of filters and thereby the primary electrostatic images are formed and they are developed with the primary color toner.

After that, the potential on the photoreceptor surface is uniformalized and then the entire surface of the photoreceptor is exposed evenly to the secondary light (L2) that contains the light component transmitting other filter (F2) that is different from at least aforesaid filter F1 and does not substantially contain the light component transmitting the remaining one filter (F3) and thereby the secondary electrostatic images are formed and they are developed with the secondary color toner.

After that, the potential on the photoreceptor surface is again uniformalized and the entire surface of the photoreceptor is exposed to the tertiary light (L3) containing the light component transmitting at least one kind of remaining filter F3, thus the tertiary electrostatic images are formed and they are developed with the tertiary color toner.

The foregoing is a method for reproducing multicolor images and it is preferable that aforesaid tertiary light L3 is white light and aforesaid filters F1, F2, and F3 are the filters transmitting the upper range, the medium range and the lower range of wavelength of visible rays respectively and the light L1 and L2 are red light transmitting the filter F1 and yellow light that does not transmit the filter F3 respectively, the constitution of which provides more effects. Following is a background of the further object of the present invention. In the method of reproducing multi-color images mentioned above, the size, shape and layout of finely-divided color separation filter have been same for every color from the viewpoint of design and manufacturing. Especially, the filter portions having the same maximum light-transmissivity for the same color have been used for the structure and following problems have been found.

(1) Since the color filter is finely-divided, the latent image is also finely-divided. After the development thereof, therefore, the edge effect is very notable and the gradation reproducibility and color reproducibility tend to be unnatural.

(2) A spatial frequency of the document and a spatial frequency of a color-separation filter cause an interference and a moire effect tends to occur.

Therefore, aforesaid further object is to provide the photoreceptor that solves aforesaid problems and gives conditions that the color reproducibility is excellent and moire effects hardly occur and to provide a method of reproducing images that employs a photoreceptor capable of recording simply and at high speed the multicolor images having no color-slip from a single image-exposure and forms multi-color images successfully through the simple and high-speed process.

Aforesaid object may be attained through the following constitution. Namely, the photoreceptor comprises a filter layer consisting of plural filter portions whose spectral transmissivity characteristics differ each other and is characterized in that the light of any color can transmit at least 2 kinds of filters among aforesaid filter portions.

The method of reproducing images comprises a step for giving an image-exposure to the photoreceptor having a filter layer consisting of plural filter portions whose spectral transmissivity characteristics differ each other and wherein the light of any color transmits at least 2 kinds of filters among aforesaid filter portions and a step for repeating, after the foregoing, the operation to give the flood exposure with the light transmitting at least a part of aforesaid filter portions and then to perform the development.

Since developing conditions for the development by means of various colors have not been studied and thereby the turbulence of toner images and the drop of image density have not been avoided, further object of the invention is to provide a method of reproducing images which solves aforesaid problems and employs a photoreceptor capable of recording simply and at high speed the multi-color images without a color-slip through a single image-exposure and thereby reproduces successfully the multi-color images through a simple and high-speed process.

The construction for accomplishing aforesaid object represents a method of reproducing images comprising a step for forming electrostatic latent images on an image-carrier having a photoconductive layer and a filter layer consisting of filters of plural kinds and a step for repeating the operation to give a flood-exposure with the specific light of one kind of aforesaid filter to aforesaid image-carrier and thereby form a potential pattern and then to perform the development, wherein the development at least second step or thereafter in aforesaid repeating step is performed under the condition that the developer layer on the side of the developing unit does not substantially contact aforesaid image-carrier. More particularly, the preferable photoreceptor to be used in the present invention is a photoreceptor wherein a photoconductive layer is arranged on a conductive member, for example, and an insulating layer containing a large nember of filters in plural kinds of different colors is superposed on the surface of aforesaid photoconductive layer. Preferable embodiments are to satisfy the following conditions (1), (2) or (3) which are necessary for obtaining multi-color images with a high image quality.

(1) The clearance between aforesaid multi-color and a developer-transport member is to be greater than the thickness of the developer layer formed on aforesaid developer-transport member.

(2) When employing the developing system for developing aforesaid latent image by the use of mono-component developer wherein Vac(v) is an amplitude of AC component of developing bias, f(Hz) is a frequency and d(mm) is a clearance between aforesaid image-carrier and a developer-transport member that transports developer, the following condition is to be satisfied.

$$0.2 \leqq Vac/(d.f) \leqq 1.6$$

(3) When employing the developing system for developing aforesaid latent image by the use of plural-component developer, the following condition is to be satisfied.

$$0.2 \leqq Vac/(d.f)$$

$$\{(Vac/d)-1500\}f \leqq 1.0$$

Still further object of the invention is to provide an apparatus for reproducing multi-color images which apparatus is of a compact and simple constituent and is highly reliable for obtaining multi-color images.

Aforesaid object is accomplished by the apparatus for reproducing multi-color images comprising;

(a) a rotatable photoreceptor consisting of a conductive member, a photoconductive layer and an insulating layer containing a filter layer that consists of filters of plural kinds which are different each other
(b) a means for giving an image-exposure to aforesaid photoreceptor
(c) a means for uniformalizing for surface potential of aforesaid photoreceptor
(d) a means of even exposure for selecting the light of specific relative spectral distribution and for irradiating aforesaid photoreceptor
(e) a plurality of developing means to accept different kinds of toners
(f) a means for transferring toner images on aforesaid photoreceptor, and
(g) a cleaning means capable of having the mode to clean the surface of aforesaid photoreceptor and a mode for releasing the cleaning mode, wherein the exposure by means of an even exposure means of above item (d) and the development by means of a developing means of (e) are repeated for every rotation.

BRIEF DESCRIPTION OF THE DRAWINGS

FIGS. I(*a*), 1(*b*), 1(*c*) and 1(*d*) are the schematic diagram each illustrating the layer arrangement of the photoreceptors capable of being used in the invention;

FIGS. 28[1] through 28[5] illustrate the processes of the still further example of the invention.

DESCRIPTION OF THE PREFERRED EMBODIMENTS

Examples

The invention will now be described below, with reference to the drawings attached hereto.

Every one of the drawings illustrates the embodiment using three kinds of filters for serving as color-separation filters which transmit only the rays of light having a specific wavelength region, i.e., a red-light transmitting filter, a green-light transmitting filter and a blue-light transmitting filter, and three kinds of colored toners corresponding to the filters, respectively.

It is, however, to be understood that the invention shall not be limited to a variety of such a color-combination as described above.

Figure 1A:
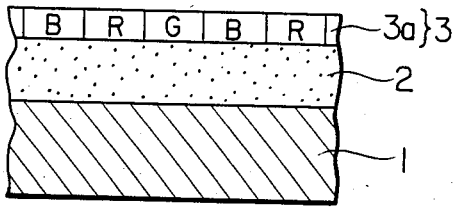
Figure 1B:
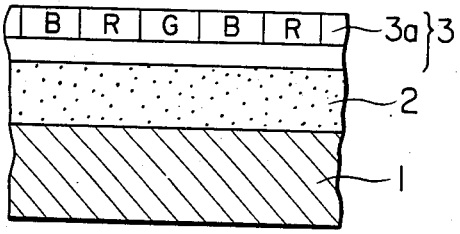
Figure 1C:
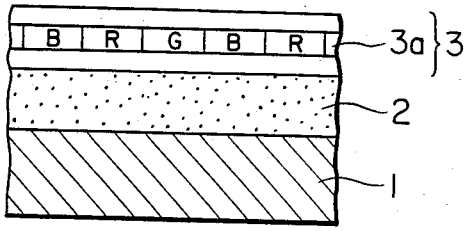
Figure 1D:
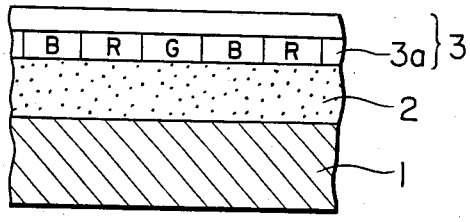
Figure 2A:
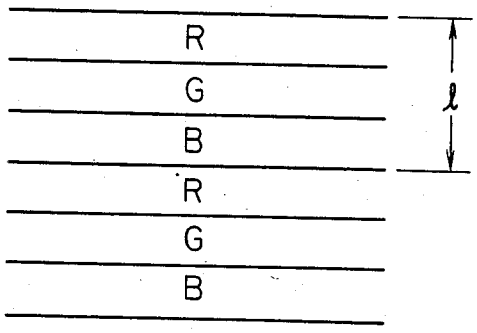
FIGS. 2(*a*), 2(*b*) and 2(*c*) illustrate the respective examples of the horizontal arrangements of the filter-distributed layers which are the insulating layers of the photoreceptors capable of being used in the invention.
Figure 2B:
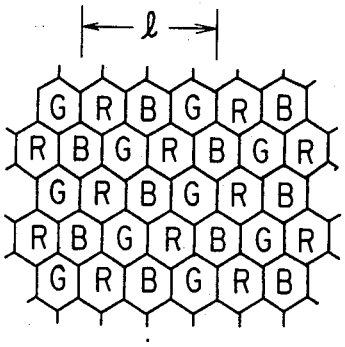
Figure 2C:
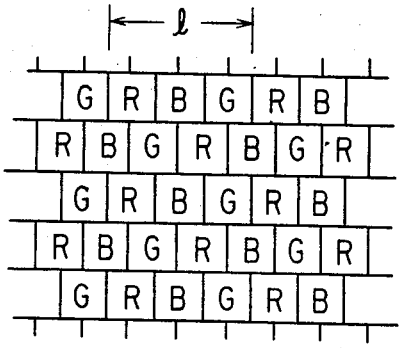
Figure 3:
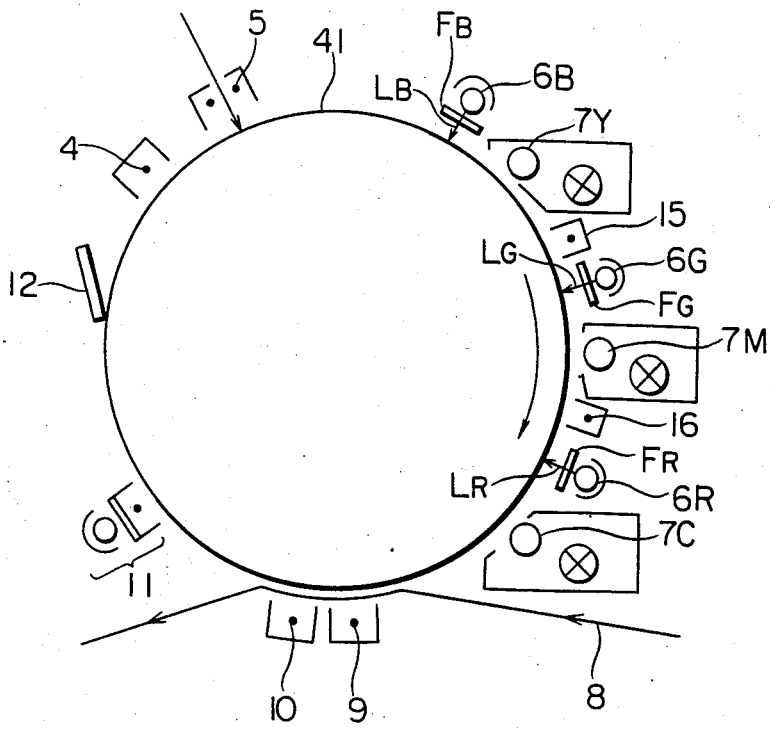
FIG. 3 is the schematic structure of an example of a multi-color image reproducing apparatus whereby the methods of the invention can be embodied.
Figure 4:
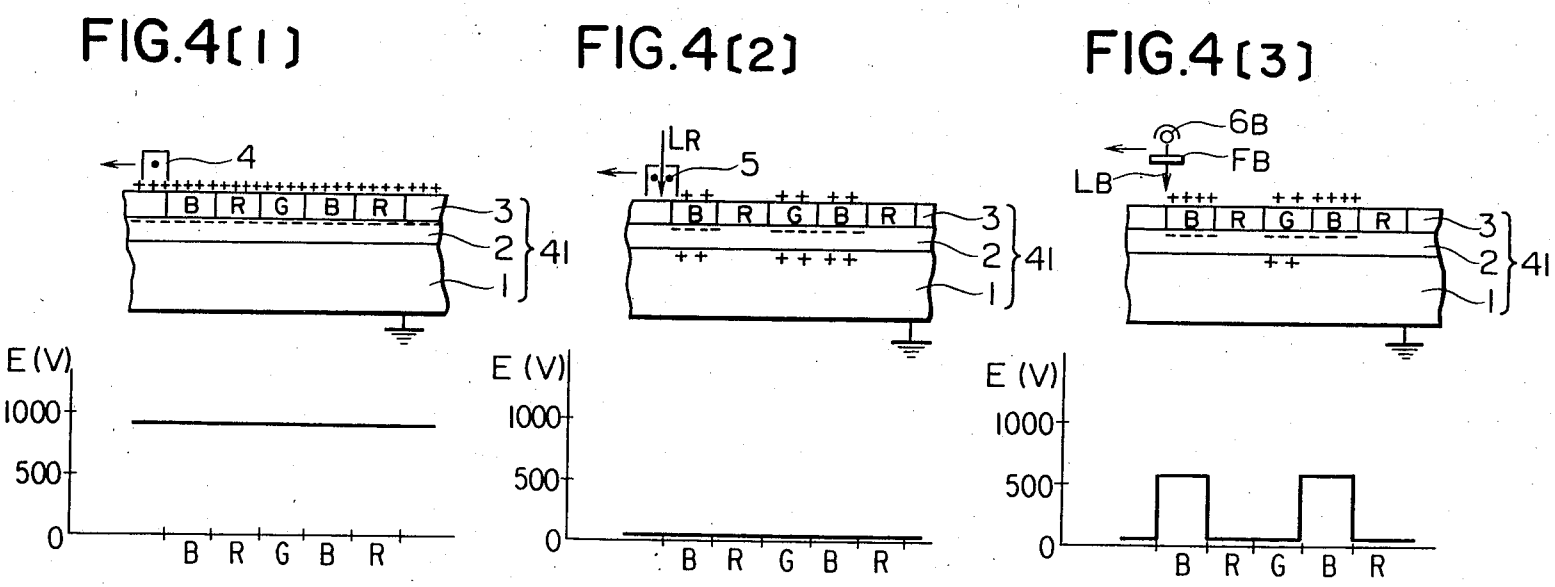
FIG. 4 typically illustrates a process wherein the method used in an embodiment of the invention may be described.
Figure 4:
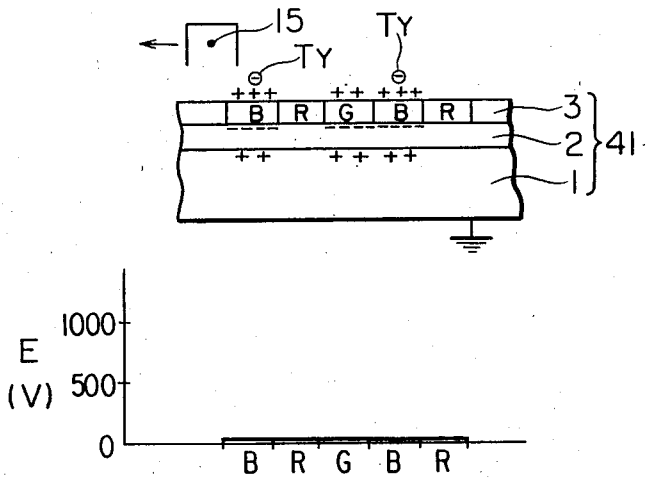
Figure 4:
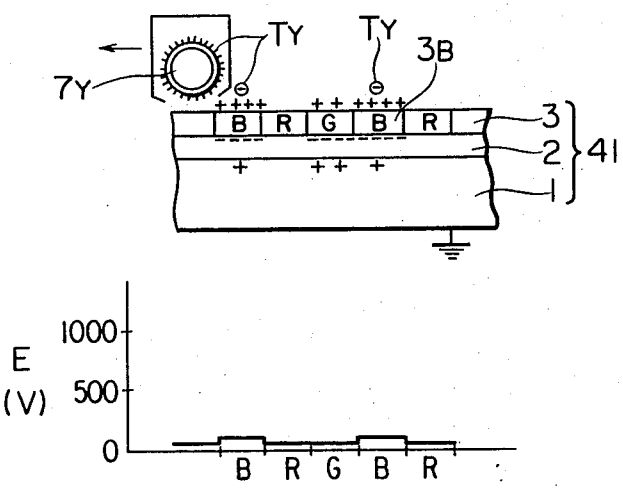
Figure 5:
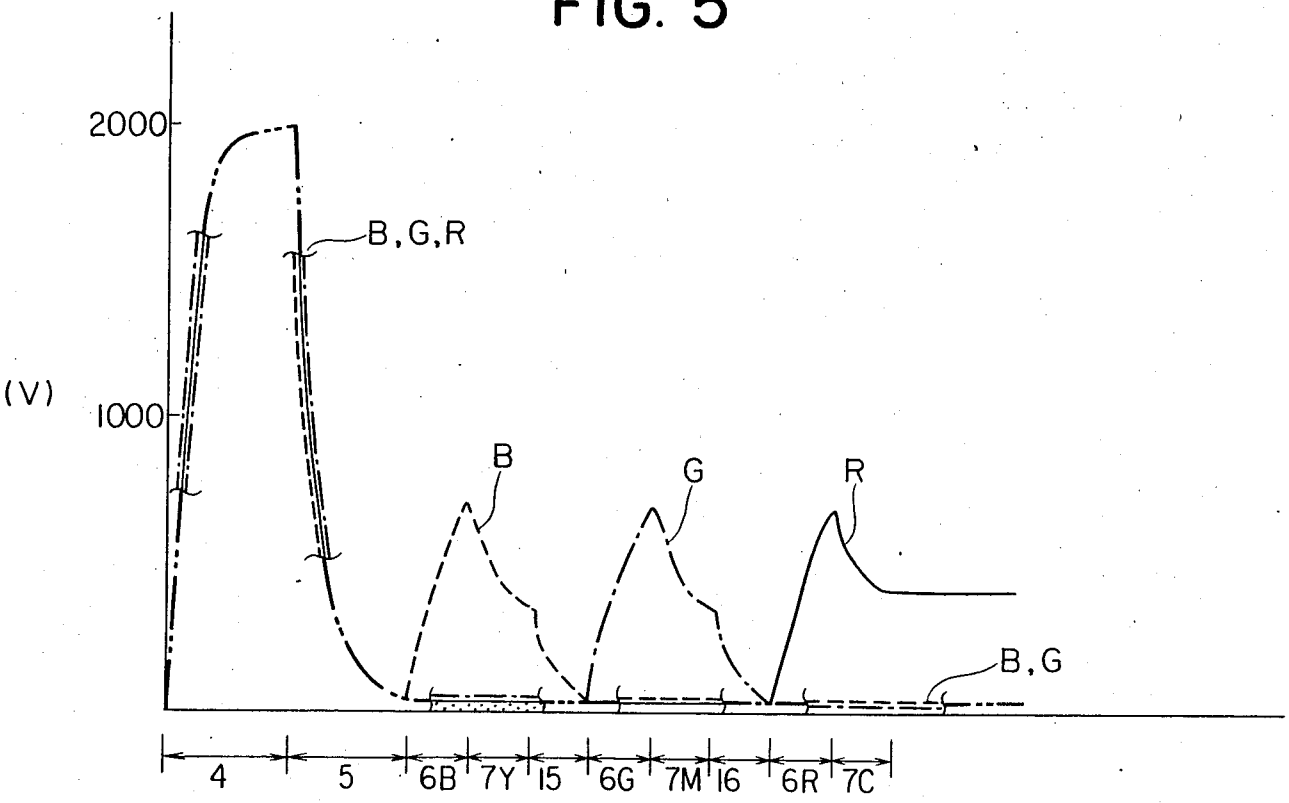
FIG. 5 illustrates a state where the surface potential of a photoreceptor is varied according to the process illustrated in FIG. 4.

FIG. 1(*a*) through FIG. 1(*d*) are cross-sections schematically illustrating the structures of the photoreceptors capable of being used in the invention, respectively, FIG. 2(*a*) through FIG. 2(*c*) are plan views illustrating the filter arrangements for a filter distribution layer in an insulating layer of a photoreceptor, respectively. FIG. 3 is a schematic construction of an embodiment of a device capable of embodying the method of the invention. FIG. 4 is a flow diagram illustrating the method of the invention. FIG. 5 is a graph indicating in time-series a state where the surface potential of a photoreceptor is varied according to the progress of process.

In FIG. 1(*a*) through FIG. 1(*d*), 1 is an electroconductive member made of such a metal as aluminium, iron, nickel, copper or the like, or the alloy thereof, and suitably formed cylinder-like or endless-belt-like according to demand; Z is a photoconductive layer comprising a photoconductor made of sulfur, selenium. amorphous silicon, an alloy containing selenium, tellurium, arsenic, antimony or the like, an inorganic photoconductor made of zinc, aluminium, antimony, bismuth, cadmium, molybdenum or the like, or an organic photoconductor in which such an organic photoconductive substance as vinyl carbazole, anthracene phthalocyanine, trinitrofluorenone. polyvinyl carbazole, polyvinyl anthracene, polyvinyl pyrene or the like is dispersed in such an insulating binder resin as a polyethylene, polyester, polypropylene, polystyrene, polyvinyl chloride, polyvinyl acetate, polycarbonate, acrylic resin, silicone resin, fluororesin, epoxy resin or the like; 3 is an insulating layer containing a red (R), green (G) and blue (B) color-separation-filter-distributed layer 3*a* which is made of various polymers, resins or the like and such a coloring agent as dyestuff or the like.

In the photoreceptor illustrated in FIG. 1(*a*), the insulating layer 3 is formed by making adhere such an insulating substance as resins or the like which is colored by adding a coloring agent for forming the respective color-separation filters, onto the photoconductive layer 2 in a specific pattern by means of printing or the like.

In the photoreceptor illustrated in FIG. 1(*b*), the insulating layer 3 is formed in such a manner that a transparent insulating layer is formed in advance onto photoconductive layer 2 by means having so far been well-known, and a coloring agent, a colored resin or the like is made adhere in a specific pattern to the surface of the transparent insulating layer by means of printing, evaporation or the like.

In the photoreceptor illustrating in FIG. 1(*c*), the insulating layer 3 is formed by further providing a transparent insulating layer onto insulating layer 3 by means having so far been well-known.

In the photoreceptor illustrated in FIG. 1(*d*), the insulating layer 3 is formed in such a manner that a coloring agent is made adhere in a specific pattern directly onto photoconductive layer 2 by means of printing, evaporation or the like, and further thereonto or onto insulating layer 3 illustrated in FIGS. 1(*a*) or 1(*b*), a transparent insulating layer is provided, similar to the case of insulating layer 3 illustrated FIG. 1(*c*).

The formation of such insulating layers 3 shall not be limited to the above-given examples, but shall be allowed to realize in such a manner that, in advance an insulating film or sheet containing a color-separation filter-distributed layer 3 is formed and then the resulted film or sheet is attached or made adhere onto photoconductive layer 3 by a suitable means.

In insulating layer 3, color-separation filter-distributed layer 3*a* formed by making a coloring agent, a colored resin or the like adhere thereto shall not particularly be limited to the shapes and arrangements of fine filters in R, G, B, or the like, but such a stripe-patterned filter-distribution as shown in FIG. 2(*a*) is preferred from the viewpoint of a simple pattern formation, and such a mosaic-patterned filter-distribution as shown in FIG. 2(*b*) or 2(*c*) is preferred from the viewpoint of the reproducibility of delicate multi-colored images. The direction of arranging filters in R, G, B, or the like may be any direction on the surface of the photoreceptor, even in either case of a stripe-pattern as well as a mosaic-pattern. In other words, in the case of a drum-type photoreceptor rotating by itself, for example, the longitudinal direction of the stripes may be in parallel with, at right angles to or spiral to the axis of the photoreceptor. Filters are not limited to the three kinds of R, G and B, but Y (yellow), M (magenta) and C (cyan) filters may be used, and besides, when using such color-separation filters in the case of not a full-color but a two-color reproduction, such color-separation filters may be those in which white-light transmittable portions and specific color (e.g., red) light transmittable portions are distributed. If each size of such filters in R (red), G (green) and B (blue), or others is too large, the resolution and color miscibility of an image will be worsened to deteriorate the image quality. If each size thereof is too small to the order of not larger than the particle size of toner, a color portion will incline to affect the other color portions adjacent thereto or the distribution pattern of filters will become difficult to form. It is, therefore, preferred that the length l of one cycle of each repetition arrangement of filters are from 30 $\mu$m to 300 $\mu$m in width or in size, in the case of such a distribution of three kinds of filters as illustrated in the drawings. It is a matter of course that, if the number of filter kinds is varied, the preferred range of the above-mentioned length l is also varied, accordingly.

The image reproducing apparatus illustrated in FIG. 3 is to reproduce multi-color images in the method of the invention, particularly by making use of a drum type image-carrier 4 comprising such a photoreceptor as described above. To be more concrete, multi-color images are reproduced thereby in such a series of steps that a charger 5 charges uniformly the surface of image-carrier 41 by rotating the image-carrier 41 in the direction of arrow; an image-wise exposure is made on the charged surface with an image exposure device (having a discharger 5 attached with a slit) by making incident the reflection light or transmission light of white light which scanned over an original document through the slit of an A.C. charger 5 or a charger 5 which corona-discharges oppositely to the charger 4, while charging further the charged surface of the image-carrier 41; next, a color-exposure device 6B makes uniformly incident blue-light $L_B$ through a blue filter $F_B$ to the charged surface of the image-carrier 41, thereby an electrostatic latent image is so formed on the image exposed surface as to give a complementary color image in blue; the resulting electrostatic latent image is developed by a developing device 7Y using yellow toner as the developer; after the development, charger 15 corona-discharges to image-carrier 41, similar to the case of the charger of the image exposure device 5, so that the potential of the image-carrier 41 can be smoothed; a color-exposure device 6G makes uniformly incident a green-light $L_G$ through a green filter $F_G$ to the potential-smoothed surface, so as to form an electrostatic latent image capable of giving a complementary color image in green; the resulting electrostatic latent image is developed by a developing device 7M using magenta toner as the developer; after the development, charger 16 corona-discharges to the image-carrier 41 so as to smooth the potential of the image-carrier 41, similar to the charger 15; color-exposure device 6R makes uniformly incident red-light $L_R$ through a red filter $F_R$ to the smoothed surface of the image-carrier 41 so as to form an electrostatic latent image capable of giving a complementary color image in red; the resulting electrostatic latent image is developed by a developing device 7C using cyan toner as the developer; and thereby, a multi-color image comprising the superposition of three-color-image in yellow, magenta and cyan is formed on the image-carrier surface. And, the resulting multi-color image is transferred by an image-transferring device 9 onto recording paper 8 which is fed in by a paper-feed device (not shown) and the recording paper to which the image was transferred is separated from the surface of the image-carrier 41 by a separating device I0 and is then fixed by a fixing device (not shown), and is finally delivered to the outside of the apparatus. On the other hand, the surface of the image-carrier 41 which has already transferred the multi-color image is electrically neutralized by a neutralizer 11 which performs exposures and discharging, and therefrom the residual toner is removed by a cleaning device 12, and is finally restored to the original state ready for the next multi-color image formation.

With reference to FIG. 4, a further description of each step of the multi-color image reproducing method of the invention will now be made. FIG. 4 illustrates an example in which a photoconductor of an n-type semiconductor such as cadmium sulfide is used in the photoconductive layer 2 of image-carrier 41, and in FIG. 4, the reference numerals thereof are identical to those in FIGS. 1 and 2 to denote the same functional members.

FIG. 4[1] illustrates a state that an image-carrier 41 is rotated to be uniformly charged by positive corona-discharges from charger 4, wherein a positive charge is generated on the surface of insulating layer 3 and corresponding thereto a negative charge is induced on the boundary surface between photoconductive layer 2 and insulating layer 3. Consequently, the surface of the image-carrier 41 displays a uniform charge as shown in the graph exhibiting potential E.

FIG. 4[2] illustrates the variations on the charged surface of the image-carrier 41 caused by red-color component $L_R$ out of the original image exposure light incident from image-exposure device 5 to the charged surface. Such red-light component $L_R$ passes through the R-filter portions of insulating layer 3 so as to make conductive the photoconductive layer 2 below the insulating layer 3. In the portions of the photoconductive layer 2, therefore, the negative charge on the boundary surface between the photoconductive layer 2 and insulating layer 3 is eliminated and at the same time the positive charge on the surface of insulating layer 3 is also eliminated by the discharge from the charger of image-exposure device 5, so that any charge is not present. (For convenience of describing the principle, the heavy portions of red-color component $L_R$ are herein described.) On the other hand, the G and B filter portions do not pass through the red-color component $L_R$, therefore, the negative charge of photoconductive layer 2 remains as it is in the particular portions, and thereby a positive charge will remain on the surface of insulating layer 3 after the photoconductive layer passes the position of image-exposure device 5 even if a discharge is made by a discharger. However, in the portions of G and B filters in which a charge still remains, as well as in the portions of R filter in which any charge is eliminated, the surface potential of image-carrier 41 which depends on a positive or negative charge will become almost nil, as is seen in the graph of potential E. Each of the green-light component and the blue-light component of an image-exposure light (not shown in FIG. 4 by omission) will give the same results. The state where the above-mentioned three kinds of color components are integrated together is a state where an image-exposure is made by image-exposure device 5; and this state is a state where a primary latent image incapable of functioning as a electrostatic image is formed.

FIG. 4[3] illustrates a state that a blue-light $L_B$ is made uniformly incident through a blue filter $F_B$ to the aforementioned image-exposed surface by color-exposure device 6B. The blue-light $L_B$ does not pass through the R and G filter-portions, therefore such portions are not changed thereby, but the blue-light $L_B$ passes through the B-filter portions and makes photoconductive layer 2 below electrophotoconductive and thereby a charge is neutralized on the boundary surfaces of the upper and the lower sides of the photoconductive layer 2 in the corresponding portions. Consequently, in the B-filter portions, a potential is generated on the surface of insulating layer 3 so as to give the complementary color image in blue which has previously been formed by the image-exposure, as shown in the graph of potential E.

FIG. 4[4] illustrates a state that an electrostatic latent image formed by a uniform exposure to blue-light $L_B$ is developed by a developing device 7Y using yellow toner $T_Y$ which corresponds to the complementary color of B. Such yellow toner $T_Y$ adheres only the B-filter portions displaying potentials, but not to adhere to the R and G-filter portions not displaying any potential. With this yellow toner $T_Y$, a color-separated single yellow toner image is formed on the surface of the image-carrier 41. The potential in the B-filter portions are lowered because of the adhesion of the yellow toner $T_Y$ thereto, but they remain, as shown in the graph of potential E, to make the other toners adhere to these portions in the next developing process, so that a color turbidity will possibly be caused.

FIG. 4[5] illustrates a state that a corona-discharge is applied by a charger 15 to the surface of image-carrier 41 developed by developing device 7Y with the purpose of preventing the B-filter portions from the adhesion of other toners. Such discharge from the charger 15 is so different from a high-tension discharge from charger 4 that the R and G-filter portions are least affected and the potential is lowered in the B-filter portions to which the yellow toner $T_Y$ mainly adhere. Accordingly, the surface potential of the image-carrier 41 will display almost nil uniformly, as shown in the graph of potential E. Therefore, in the next developing process, other toners are prevented to adhere to the B-filter portions to which yellow toner $T_Y$ has adhered, and a color turbidity may also be prevented to cause.

Now, when a uniform exposure of green-light $L_G$ is made to the surface of the image-carrier 41 illustrated in FIG. 4[5] onto which the yellow toner image is formed, by making use of color-exposure device 6G, an image-wise charge is generated in the G-filter portions at this time, as described of FIG. 4[3]. When this electrostatic latent image is developed by developing device 7M using magenta toner as the developer, the magenta toner will adhere only to the G-filter portions to form a magenta toner image, similar to the case of FIG. 4[4]. Thus, the two toner images in different color are superposed. Then, a corona discharge is also applied to the image-formed surface by charger 16, and the potential is lowered in the G-filter portions to which the magenta toners adhere, so as to prevent the G-filter portions from making other toners adhere.

Further, even if a uniform exposure of red-light $L_R$ is made by color-exposure device 6R to the surface of image-carrier 41 on which two-color toner image is formed, no image-wise potential is generated this time in the R-filter portions. Therefore, the electrostatic latent image thereof is not developed by developing device 7C using cyan toner as the developer so that no cyan toner image can be formed. Consequently, a sharp and clear red-color image comprising yellow and magenta colors can be formed without any color-slip and color turbidity on the image-carrier 41.

FIG. 4 illustrates an example embodied in the case that an n-type photo-semiconductor in the photoconductive layer of image-carrier 41, however, it is a matter of course to use a p-type photo-semiconductor made of selenium, for example, in photoconductive layer 2. In the latter case, every basic processes are the same except only that every plus or minus sign of charges is reversed. If it is difficult to apply charges to image-carrier 41 by making use of charger 4, it may be allowed to use a uniform irradiation of light, jointly. In FIG. 4[2], the surface potential of the image-carrier 41 was dropped to almost nil after it was charged, however, it does not matter even if the surface potential is biased slightly to plus or minus.

Table 1 exhibits the relation between the colors of an original document and image-formations utilizing the aforementioned three-color separation method and using three primary color toners. In this Table 1, the mark ◌ represents a state that a charge is present in a photoconductive layer in the process of the primary latent image formation; the mark ○ represents a state that charges in a photoconductive layer is eliminated by a flood exposure and the potential is raised; the mark ◍ represents a state that a development was carried out; and the mark ↓ represents that a state indicated in the upper column remains as it is. The column in blank represents a state that no charge is present in the photoconductive layer. Further, the mark - in the columns of adhered toner indicates that no toner adheres; and the marks, Y, M, and C indicates that yellow toners, magenta toners and cyan toners adhere, respectively.

Table 1

| Original document | White | | | Red | | | Green | | | Blue | | | Yellow | | | Magenta | | | Cyan | | | Black | | |
|---|---|---|---|---|---|---|---|---|---|---|---|---|---|---|---|---|---|---|---|---|---|---|---|---|
| Filter distributed layer 3a | R | G | B | R | G | B | R | G | B | R | G | B | R | G | B | R | G | B | R | G | B | R | G | B |
| Image-exposure | | | | | ◌ | ◌ | ◌ | | ◌ | ◌ | ◌ | | | | ◌ | | ◌ | | ◌ | | | ◌ | ◌ | ◌ |
| Blue flood exposure | | | | | ↓ | ○ | ↓ | | ○ | ↓ | ↓ | | | | ○ | | ↓ | | ↓ | | | ↓ | ↓ | ○ |
| Yellow development | | | | | ↓ | ◍ | ↓ | | ◍ | ↓ | ↓ | | | | ◍ | | ↓ | | ↓ | | | ↓ | ↓ | ◍ |
| Green flood exposure | | | | | ○ | | ↓ | | | ↓ | ○ | | | | | | ○ | | ↓ | | | ↓ | ○ | |
| Magenta development | | | | | ◍ | | ↓ | | | ↓ | ◍ | | | | | | ◍ | | ↓ | | | ↓ | ◍ | |
| Red flood exposure | | | | | | | ○ | | | ○ | | | | | | | | | ○ | | | ○ | | |
| Cyan development | | | | | | | ◍ | | | ◍ | | | | | | | | | ◍ | | | ◍ | | |
| Adhered toner | - | - | - | - | M | Y | C | - | Y | C | M | - | - | - | Y | - | M | - | C | - | - | C | M | Y |
| Reproduction | White | | | Red | | | Green | | | Blue | | | Yellow | | | Magenta | | | Cyan | | | Black | | |

Further, FIG. 5 illustrates a state that the surface potential of the respective filter portions in B, G and R are varied according to the above-mentioned image forming processes, wherein 4, 5, 6B. 7Y, 15, 6G, 7M, 16, 6R and 7C represent the processes, respectively, in which the members having the same reference numerals as those in FIG. 3 or 4 work to image-carrier 41, and B, G and R denote a maximum or average potential of each filter portion.

In the image reproducing methods of the invention, the developments are to preferably be carried out in a magnetic-brush method, and therein the so-called single component developer comprising only toners or two-component developer using toners and magnetic carriers either can be used for the developers thereof. In such a developing process, it is allowed to use a direct magnetic brushing method. However, with the purpose of avoiding the damages of toner images formed after the secondary development, it is particularly preferred to apply such a developing method that any developer layer does not come into contact with the surface of a photoreceptor, for example, the methods such as described in U.S. Pat. No. 3,893,418; and Japanese Patent O.P.I. Publication Nos. 18656/1980, 181362/1984, 129760/1985, and 129764/1985. A preferable method among the above-mentioned methods is that a two-component type developer containing non-magnetic toners capable of choosing any colors freely is used to form an alternating electric field in the development areas, and the development is carried out without bringing the developer layer substantially into contact with the image-carrier. In order to carry out a development without bringing the developer layer substantially into contact with the image-carrier, the space between the image-carrier and a developing sleeve of the developing device, which conveys the developer layer is to be made wider than the thickness of the developer layer being conveyed into a development area.

Color toners capable of being used in such developments include an electrostatic image developing toner, which is prepared by the well-known techniques, comprising a well-known bonding resin normally used in toners, various colored or non-colored coloring agents such as an organic or inorganic pigment, dyestuff or the like. Carriers thereof include various well-known carriers such as magnetic carriers, which are normally used in electrostatic image formation, comprising iron powder, ferrite powder, resin coated matters thereof, the matters in which magnetic materials are dispersed in resins, and the like.

It is also possible to apply the developing methods which are described in Japanese Patent O.P.I. Publication Nos. 140362/1985 and 131549/1985 which have previously been applied by the present applicants.

A further preferable developer, developing condition and the like will now be described below.

As for the two-component type developers, those of which carriers and toners can satisfy the following proper conditions are preferred to use, such as described in, for example, Japanese Patent O.P.I. Publication Nos. 75850/1985, 76766/1985, 95456/1985 and the aforementioned 181362/1984.

At first, such carriers will be described. The globularity of magnetic carrier particles will lead to improve both of the agitation of toners or carriers and the transportability of developers, and further to improve the charge controllability of toners, and still further to make hardly occur a cohesion of toner particles each other or toner particles and carrier particles together. However, if magnetic carrier particles are large in average particle size, it is possible to raise the following problems;

1. Ears of a magentic brush formed on a developer transport member will become rough. Resultantly, a toner image is apt to have an irregularity even if the electrostatic image is developed while vibration is given by an electric field, and 2. The toner density in the ears will become lower. Resultantly, a high density development may not be performed.

To solve the problem 1, it is good enough to make an average size of carrier particles smaller. As the results from the experiments, it was found that the effects began to display from the time when the average particle size was not larger than 50 μm, and the problem 1 was not substantially raised when the average particle size was not larger than 30 μm. On the other hand, the problem 2 may also be solved by such a measure to counter the problem 1 as that magnetic carriers are made fine grained, so that the toner density of the ears will become higher to perform a high density development.

However, if the carrier particles are too fine in size, the following problems may be raised; 3. The carrier particles adhere together with toner particles to the surface of the image-carrier, and 4. The carrier particles are apt to fly about.

The abovementioned phenomena depend upon the tension of a magnetic field which works to the carrier particles and the magnetic power of the carrier particles generated by the magnetic field. According to the experiments, these phenomena tend to show gradually when an average particle size of the carrier particles was not larger than 15 μm, and to show remarkably when it was not larger than 5 μm. Carrier particles adhered to the surface of a image-carrier are normally in darkish color, and a part thereof will move together with toners to a recording paper, so that a color image will seriously be affected.

It is, therefore, the proper conditions that an average particle size of magnetic carriers is from not larger than 50 μm and preferably not larger than 30 μm to not smaller than 5 μm and preferably not smaller than 15 μm, and that they are globe-shaped. The abovementioned particle size is in terms of a weight-average particle size which is determined by a Courcounter manufactured by Courter Company or a Omnicon-Alpha manufactured by Bosch & Romb Company.

Such magnetic carrier particles as mentioned above may be prepared in such a manner that there makes fine in size or globe-shaped ferromagnetic or paramagnetic particles including, for example, a metal such as iron, chromium, nickel, cobalt and the like or the compounds or alloys thereof such as triiron tetraoxide, γ-ferric oxide, chromium dioxide, manganese oxide, ferrite, a manganese-copper alloy and the like, which serve as the magnetic substances similar to those used in conventional magnetic carrier particles; or in such a manner that the surface of each magnetic substance particle covered globularly with such a resin as a styrene resin, a vinyl resin, an ethyl resin, a rosin-denautured resin, an acryl resin, a polyamide resin, an epoxy resin, a polyester resin and the like, or such a fatty acid wax as those of palmitic acid, stearic acid and the like; or in such a manner that resin particles or fatty acid wax particles each containing dispersed fine grains of magnetic substances preferably in particular in the globular-shape are prepared in a pulverizing method or a granuration-polymerization method; so that the particle size of the resulting particles is selected by a conventionally known average particle size selecting means to obtain the magnetic carrier particles.

Globular formation of carrier particles made of resins or the like as mentioned above will give such effects, besides the abovementioned effects, that a dveloper layer formed on a developer transport member is uniformed and a high bias voltage may be applied to the developer transport member. Namely, the globular formation of carrier particles will give such effect (1) that carrier particles are generally apt to be magnetized and adsorbed in the longitudinal direction, however, they are lost to the directional qualities because of the globular formation thereof, therefore, the developer layer is uniformly formed so that local areas of low resistance and uneven layer thickness may be prevented; and (2) that, in addition to that the carrier particles are made highly resistive, such an edge-effect as seen in the conventional carrier particles is eliminated so that no concentration of electric fields to the areas of edge effect can be avoided, and consequently, even if a high tension bias voltage is applied to the developer transport member, no electrostatic latent image can be disturbed by discharging to the surface of an image-carrier, or the bias voltage cannot be broken down.

Such application of a high tension bias voltage will lead to satisfactorily display the effects to be mentioned later, which will be enjoyed in the case that a development is carried out in an oscillation electric field by applying an oscillating bias voltage.

In the carrier particles capable of displaying such effect as mentioned above, waxes may also be used as mentioned before. It is, however, preferred to use such a resin as mentioned before, and it is further preferred to use the carrier particles in which insulating magnetic particles may be formed so that the resistivity of such carrier particles may be not less than $10^8\Omega$ cm and particularly not less than $10^{13}\Omega$ cm. Such particle-resistivity as mentioned above is a value obtained in such a manner that the particles are put in a vessel having a cross-sectional area of 0.50 $cm^2$ and tapped, and then a load of 1 $kg/cm^2$ is applied onto the tapped particles of which the thickness is made to be of the order of 1 mm, so that the value of the electric current can be obtained when applying a voltage capable of generating an electric field of 1,000 V/cm between the load and a base electrode. If this resistivity is low, the carrier particles are charged so as to be apt to adhere to the surface of an image-carrier, or the bias-voltage is apt to be broken down.

Putting all accounts together, the proper conditions of magnetic carrier particles are that they are so made globular in shape as to be not more than three times in the ratio of the major axis to the minor axis thereof, and have no protrusion such as needle-like or edge portions, and further the resistivity thereof is not less than $10^8\Omega$ cm and preferably not less than $10^{13}\Omega$ cm. And, they are prepared in the manner that, when they are magnetic particles or resin-coated particles, the magnetic particles are selected from those being as globularly as possible and thereto a resin-coating process is applied; and when they are magnetic carriers in which the magnetic substances are fine in size and dispersed in the carriers, the magnetic substances whose sizes are as finely as possible are used to form dispersed resin particles and then to apply a globularizing process, or dispersed resin particles are prepared in a spray-dry method.

Next, now that toners are described, it is general that, if the toner particles of a two-component type developer are small in average particle size, the charged volume thereof is qualitatively reduced in proportion to the square of the particle size and such an adhesive power as Van der Waals force is relatively increased so that the carrier particles can hardly be separated from toner particles, or, when the toner particles adhere once to the non-image areas of the surface of an image-carrier, the adhered toner particles cannot easily be removed by rubbing with a conventional magnetic brush, so that the non-image areas will be fogged. Such a problem as mentioned above will become remarkable in the conventional magnetic brush methods, when toner particles are not larger than 10 μm in average particle size. This problem can be solved when a development is made in an oscillating electric field, because, to be more concrete, toner particles which adhere to a developer layer are separated from the developer layer by being given an electrical oscillation and are apt to move to the image- and non-image areas of the surface of an image-carrier, and in addition to the above, almost all of the low-charged toner particles do not move to such image- and non-image areas and are not rubbed with the surface of the image-carrier, therefore they do not adhere to the image-carrier because of no frictional charge, so that toners having even the average particle size of the order of 1 μm can be used. It is, accordingly, possible to obtain an excellently reproducible and sharp toner image in which an electrostatic latent image is developed with a high-fidelity. Besides the above, there reduces the adhesion of carrier particles with which toner particles accompany to the surface of the image-carrier. In the image and non-image areas, highly charged toner particles are are oscillaged in an oscillating electric field, and carrier particles are also oscillated according to the strength of the electric field, and thereby the toner particles are selectively moved to the image areas of the surface of the image-carrier. The adhesion of the carrier particles to the surface of the image-carrier may sharply be reduced.

On the other hand, when the average particle size of toners becomes larger, the roughness of the toner image will appear remarkably as aforementioned. To develop an image in which fine lines juxtaposed by the pitch of the order of 10 lines/mm can be resolved, it is no problem even if toners of the order of 20 μm in average particle size are used. However, when using fine-grained toners of not larger than 10 μm in average particle size, there gives a sharp and high quality image in which the resolving power is greatly improved and the contrast and others are reproduced with fidelity. By the reasons mentioned above, the proper conditions of the toner particle sizes are not larger than 20 μm, and more preferably, not larger than 10 μm in average particle size. To make toner particles follow-up an electric field, it is desired that a charged volume of the toner particles is not less than 1 to 3 μC/g, and preferably 3 to 100μC/g. When such particle size is small, a highly charged volume is particularly desired to apply. For this purpose, the resistivity of toners is recommended to be not less than $10^8\Omega$ cm and more preferably not less than $10^{13}\Omega$ cm.

Such toners as mentioned above may be prepared in the similar manner to that for preparing the conventional toners. To be more concrete, there may be used such toners that nonmagnetic or magnetic toner particles in globular or amorphous shape are selected from the conventional toner particles by making use of an average particle size selecting means. Among them, it is preferred that such toner particles are the magnetic particles each containing particles of magnetic substances, and more preferably, they contain magnetic fine particles in an amount of not more than 60 % by weight. In addition, for the purpose of obtaining color-clearness, it is better to reduce the amount of the magnetic fine particles to not more than 30% by weight. When toner particles contain the particles of magnetic substances, the toner particles are influenced by the magnetic force of the magnets incorporated into a developer transport member, therefore the uniform formation of a magnetic brush can be greatly improved and a fog can also be prevented, and further the toner particles can hardly be flown about. However, if the toner particles contain magnetic substance in an excess amount, a satisfactory developing density may not be obtained because the magnetic force becomes too strong between the toner particles and the carrier particles; and the frictional charge is hardly regulated and the toner particles are easily damaged and further a cohesion is apt to produce between the carrier particles because the fine particles of the magnetic substance come out on the surface of the toner particles.

Putting all accounts mentioned above together, the preferred toners can be prepared in such a manner that the resins as mentioned in the carriers and the fine particles of a magnetic substance are used, and thereto such a coloring component as carbon or the like and, if required, a charge-regulating agent or the like are added and a similar process to the conventionally known toner particle preparation process is taken; and, the average particle size thereof is not larger than 20 μm and more preferably not larger than 10μm.

In the image reproducing method of the invention, there preferably uses such a developer that globular-shaped carrier particles and toner particles as mentioned above are mixed up in the similar proportion to those in the conventional two-component type developers, and whereto a fluidizing agent for improving the fluidized slipperiness of the particles, a cleaning agent for helping the cleaning of the surface of an image-carrier and the like may be mixed up, if necessary. Such fluidizing agents capable of being used include, for example, a colloidal silica, silicone varnish, metal soap, or nonionic surface active agent. Such cleaning agents capable of being used include, for example, a surface active agent or the like made of a fatty acid metal salt, organic group-substituted silicone, fluorine or the like.

The preferred conditions of the developers are as mentioned above. The color turbidity which may be caused between the mosaic filters can be prevented by making use of such a developer as mentioned above.

Now, the description will be made on a developer transport member on which a developer layer is formed by a developer and an electrostatic latent image is developed on an image carrier.

As for the developer transport members, such as is similar to those used in the conventional developing methods capable of applying a bias voltage thereto can be used. In particular, there are preferably used a developer transport member having such a structure that a rotary magnet member having a plurality of magnetic poles is provided to the inside of a sleeve for forming a developer layer on the surface thereof. In such a developer transport member as mentioned above, a developer layer formed on the surface of the sleeve is moved wavewise with a rise-and-fall by the rotation of the rotary magnet member, therefore the fresh developers are supplied successively. Therefore, even if the developer layer on the surface of the sleeve should be somewhat uneven in thickness, the bad influences thereof can well be compensated by the abovementioned wavelike rise and fall of the developer layer so as not to cause a trouble in practical use. Further, it is preferred that the rotating speed of the rotary magnet member or the developer transport speed produced by the sleeve rotation is almost the same as or faster than the speed of moving an image-carrier. It is also preferred that the direction of the rotation of the rotary magnet member and the direction of the developer transport produced by the rotation of the sleeve are in the same direction. The image reproducibility in the case in the same direction is superior to the case in the opposite direction, however, it is to be understood that the invention shall not be limited thereto.

The thickness of a developer layer to be formed on a developer transport member is preferred to be such a thickness that the developer adhered will form a uniform layer by scraping off the extra developer with a thickness regulating blade. The gap between the developer transport member and the image-carrier is preferred to be from some tens μm to 2,000 μm. If such gap between the surface of the developer transport member and the surface of the image-carrier becomes too narrow, it will become difficult to form the ears of a magnetic brush for performing a uniform development in the gap, and a sufficient amount of toner particles will hardly be supplied to developing areas, therefore, any stable development may not be performed; and if the gap becomes too large, say 2,000 μm or over, a satisfactory developing density cannot be obtained because an opposite electrode effect is deteriorated, therefore, there will increase such an edge effect that a toner-adhesion to the outline portions of an electrostatic image becomes more than to the central portions thereof. As is described above, if the gap become excessively large or small between a developer transport member and an image-carrier, the thickness of the developer layer on the developer transport member cannot be adjusted suitably in such a gap. However, when the gap is within the range of from some tens μm to 2,000 μm, the thickness of the developer layer can suitably be adjusted in the gap. Accordingly, it is particularly preferred to establish such conditions that, in the state of not applying any oscillating electric field, the abovementioned gap and the thickness of a developer layer are to be so arranged that a gap of from 10 μm to 500 μm can be maintained between the ears of a magnetic brush and the surface of an image-carrier so as not to come into contact with each other but to make them closer each other. When developing an latent image under such conditions as mentioned above, brush-trucks made by rubbing a toner image with a magnetic brush or a fog can be prevented.

In addition, a development under an oscillating electric field is preferred to be carried out by applying an oscillating bias voltage to a developer transport member. As for the bias voltage, it is preferred to use a voltage being overlapped a D.C. voltage which prevents the adhesion of toner particles to non-image areas with an A.C. voltage which makes toner particles easily separate from carrier particles. The developing methods capable of being taken in an oscillating electric field shall not be limited to a method performed by applying an oscillating voltage to a sleeve and a method performed by applying a voltage overlapping a D.C. with an A.C.

Figure 6:
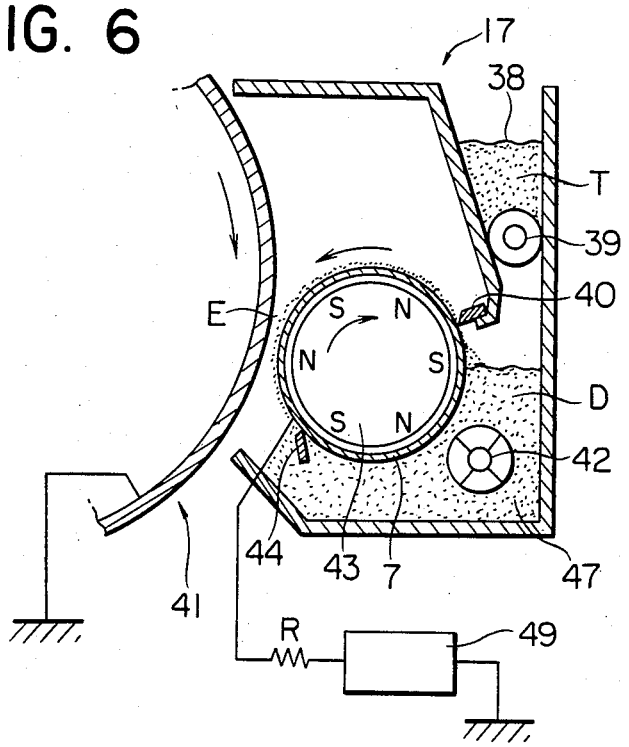
FIGS. 6 and 7 each are the schematic structure of the respective examples of the developing units capable of being used in the invention.
Figure 7:
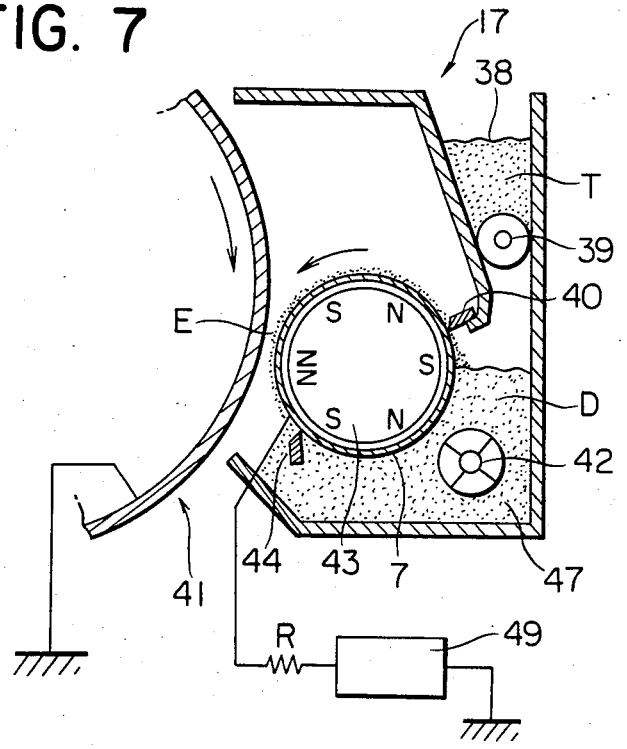

The developing methods such as described above can be embodied by a developing unit comprising a developing sleeve 7 and a developing device 17 such as exemplified in FIGS. 6 and 7.

In FIGS. 6 and 7, reference numeral 41 indicates an image carrier similar to that shown in FIG. 3; 7 is a sleeve comprising such a non-magnetic material as aluminium or the like, which faces the image carrier 41 with the interposition of developing area E between them; 43 is a magnet member having a plurality of N,S magnetic poles on the surface thereof in the circumferential direction, being provided to the inside of the sleeve 7; and the sleeve 7 and the magnet member 43 forms a developer transport member. Sleeve 7 and magnet member 43 are capable of rotating relatively, and the drawing illustrates a case that sleeve 7 is rotating in the direction of arrow. The N, S magnetic poles of magnet member 43 are normally magnetized in magnetic flux density of from 500 to 1,500 Gauss, and thereby a magnetic brush, i.e., a layer of developer D such as described before, is formed on the surface of sleeve 7. Numeral 40 is a regulating blade comprising a magnetic or non-magnetic member, for regulating the height and amount of the magnetic brush; 44 is a cleaning blade for removing the magnetic brush passed over the developing area E, from the surface of sleeve 7; the surface of sleeve 7 comes into contact with developer D in developer reservoir 47 so as to supply developer D; and 42 is a stirring screw for stirring developer D to make the components of the developer uniform. When a development is carried out, the toner particles of developer D remaining in developer reservoir 47 are consumed, therefore, such a toner particles T as described before are replenished from toner-hopper 38 to developer reservoir 47 by toner supplying roller 39 having a hollow portion on the surface thereof; and 49 is a bias power source capable of applying a bias voltage (a D.C. and an A.C.) to sleeve 7 through a protective resistor R.

The difference between the developing units shown in FIGS. 6 and 7 is that, in the developing unit shown in FIG. 6, sleeve 7 is rotated in the direction of arrow and the magnet member 43 is rotated (at 200–2,000 rpm, preferably) in the opposite direction of the arrow, and further the every magnetic flux density of the N,S magnetic poles is approximately equal; and on the other hand, in the developing unit shown in FIG. 7, sleeve 7 is rotated in the direction of the arrow and magnet member 43 is fixed, and the every magnetic flux density of the N,S magnetic poles of the fixed magnet member 43 is not equal, but the magnetic flux density of the N magnetic poles oppositely facing image carrier 41 is larger than the magnetic flux density of the other N,S magnetic poles. In the arrangements of the poles oppositely facing the image carrier 41, it is a matter of course that the N magnetic poles are allowed to juxtapose each other so as to oppositely face the image-carrier, or the N,S magnetic poles are allowed to juxtapose so as to oppositely face the image carrier. It is possible to enjoy such an effect that a development can be more stabilized in the case of oppositely facing a plurality of magnetic poles to an image carrier than in the case of oppositely facing a single pole thereto.

In such a developing unit as described above, when developing an electrostatic image on image carrier 41 after setting the gap between the surfaces each of sleeve 7 and the image carrier 41 to the range of from some tens μm to 2,000 μm, the magnetic brush formed on the surface of sleeve 7 will move with oscillation on the sleeve 7 because the magnetic flux density of the surface thereof is varied according to the rotations of the sleeve 7 or the magnet member 43. By the oscillating movement of the magnetic brush, the magnetic brush will pass through the gap between the sleeve 7 and the image carrier 41 stably and smoothly to give a uniform developing effect to the surface of the image carrier 41 when passing through the gap, so that the development can be performed in a stable and high toner concentration. In this case, with purposes of preventing a fog and improving a developing effect, a bias voltage having an oscillating A.C. component is applied from a bias power source 49 to the gap between sleeve 7 and the electroconductive member 1 of the grounded image carrier 41. As for the bias voltage, there may be used a voltage overlapping preferred D.C. and A.C. voltages, in which the D.C. component will prevent a fog and the A.C. component will give an oscillation to a magnetic brush so as to improve a developing effect. Normally, a voltage approximately equivalent to or 50–600 V higher than the voltage in a non-image area is used as the D.C voltage component; and a frequency of from 100 Hz to 10 KHz and preferably from 1 KHz to 5 KHz is used as the A.C. voltage component. Such D.C. voltage component is allowed to be lower than the potential in the non-image areas when toner particles contain magnetic subtances, provided that it is better that the quantity of the magnetic substances is rather small, in order to maintain a color clearness. If the frequency of the A.C. voltage component is excessively low, an oscillation-giving effect cannot be obtained; and there tends to lower a developing density so as not to obtain a clear and high-quality image, because the developer cannot follow the oscillation in the electric field, if the frequency is excessively high. The voltage of the A.C. voltage component relates also to the frequency, however, the higher the voltage is, the more the magnetic brush is oscillated, so that the effects thereof will be increased as much. To the contrary, the higher the voltage is, the more fog is apt to cause and such a dielectric breakdown as a lightening stroke phenomenon is also apt to take place. The carrier particles of developer D spheroidized with resins or the like will prevent a dielectric breakdown, and the D.C. voltage component will prevent a fog. It is also allowed to insulate or semiinsulate by coating resins or an oxidized coating materials on the surface of sleeve 7 to which the above-mentioned A.C. voltage is applied.

FIGS. 6 and 7 each illustrate the examples in which an oscillating bias voltage is applied to a developer transport member, as described above. The developing methods to be carried out in an oscillating electric field shall not be limited thereto, but, for example, the developing effect can also be improved in such a manner that some lines of electrode-wires are suspended over the circumference of a developing area between a developer transport member and an image carrier, and whereto an oscillating voltage is applied to give the oscillation to a magnetic brush. In this case, too, it is allowed to apply a D.C. bias voltage to the developer transport member, or to apply an oscillating voltage having a different oscillation frequency thereto.

In the image reproducing method of the invention, the abovementioned developing conditions are applied. Therefore, in summary, the following effects can be enjoyed:

(1) Non-magnetic toners and clear color-toners can be used. In this case, two-component type developers also assure the high reliability in the transport, charging and the like of developers.

(2) Toners which are made fine in size (not larger than 10 μm, in particular) are preferred to develop a filter-portion with high fidelity, because each of the mosaic-filter sizes is of the order of 50 μm per one third of a length, l. To the contrary, if the toner size is large, it will become closer to the filter size, so it will make an image noisy. Besides the above, if the toners are made fine in size, there may raise such a problem that the fluidity thereof will be deteriorated and the toners cannot satisfactorily move unless the toners are charged with a high tension voltage. In a non-contact developing method, the problems of the toner transport and charging can be solved by carriers, while in the case of using a single-component type developer it is difficult to solve the problems.

(3) In the method of the invention, a color reproduction is carried out in an additive mixture method, therefore an image density will be lowered unless a sufficient amount of toners is made adhere to each mosaic-filter. It is, accordingly, desired to adopt a developing process for amking a great amount of toners adhere thereto. The desire is satisfied by adopting a developing process using a two-component type developer fully capable of making carriers fine in size (whereby the toner concentration can be greater.) and charging and transporting toners (whereby the charged toners can be supplied in a larger amount).

(4) In the case that a development is made with a two-component type developer, the conditions of superposing toner images can satisfactorily be performed by using a relatively lower A.C. bias voltage in comparison with the case of using a single-component type developer. In the former case, the charged volume of toners is more stable and narrower than in the case of using a single-component type developer, therefore, the superposing conditions can be established easily and stabilized.

Hence, in the invention, a charger capable of performing a deviated or not-deviated A.C. corona-discharge or a D.C. charger is used as a charger for charging the surface of an image carrier on which a development was made before every flood-exposure after the second flood-exposure. In the case if using such a D.C. charger, in particular, a Scorotron charger having a grid capable of regulating charging potentials is more preferable than a Corotron charger having only charging wires; and the charging potential is preferred to be almost equivalent to that at the time of completing a synchronous process of the secondary charge and an imagewise exposure. For example, in the case that the potential is about 0 V at the time of comleting the synchronous process of the secondary charge and an imagewise exposure and the potential in a toner-adhered portion is deviated to be positive, the grid of a Scorotron charger is to be set to about 0 V (e.g., to ground) and a negative voltage is to be applied to charging wires.

The effects obtained in the abovementioned charging process include, for example, the already-mentioned effect that the remaining potential is lowered enough in the portions to which the toners adhered through the previous development and, thereby the other toners are prevented from adhering to the same portions; and besides, such an effect that any potential raise on the surface of an image carrier caused by the dark-decay of potential in a photoconductive layer can be prevented; and such an effect that a satisfactory amount of charge can can be applied to toners so that a toner image can excellently be transferred later on. With the purpose of comparing these effects with those obtained from the examples of the invention described with reference to FIGS. 3 and 4, a three-color-image formation was tried under the same conditions, except that chargers 15 and 16 provided immediately after the developing units 7Y and 7M were removed. Resultantly, it was found that the recorded images thereby obtained were poor in color-shade and were markedly inferior to the original color-documents. In contrast therewith, in the case of the aforementioned examples of the invention, there resulted the effects such as that not only there obtained clearly colored recorded images having the almost the same color-shade as those of the original color documents, but also the transferability of toners was improved so that an excessive amount of toners recovered in cleaning device 13 could be reduced.

As is obvious from the above, a charging process to be made immediately after a development is very important for reproducing an excellent multi-color image.

To be more concrete, in the image reproducing apparatus shown in FIG. 3, the reproduction of three-color images were tried in the following conditions and arrengements, respectively.

Namely, the image carrier 41 comprises the photoreceptor having the layer arrangement illustrated in FIG. 1(*d*), wherein the photoconductive layer 2 comprises CdS of 30 μm in thickness and the insulating layer 3 is of 20 μm in thickness and a filter is contained in which the length l of the R, G, B filter distribution shown in FIG. 2(*b*) is 100 μm; and the image carrier is 120 mm in diameter and is rotated in the direction of the arrow at a surface speed of 200 mm/sec.;

the charger 4 makes the surface potential of the image carrier 41 at 1.5 KV after charging with a Corotron charger;

the charger of image-exposure device 5 makes the surface potential of the image carrier 41 at −200 V after discharging with a Scorotron charger;

in such a developing unit of from 7Y through 7C as shown in FIG. 6, a magnetic brush type developing device is so provided that a developing sleeve having the outer diameter of 25 mm comprising a non-magnetic stainless steel is to be rotated counterclockwise at a rotating speed of 153 rpm, and a magnet member provided inside thereof having 8 magnetic poles capable of giving a magnetic flux density of 800 Gauss at maximum arranged in the circumferential direction on the surface of the developing sleeve, and the magnet member is rotated clockwise at a rotating speed of 800 rpm so as to transport a developer layer;

the gap between the surfaces each of the image carrier 41 and the developing sleeve of each developing device 7Y-7C is set to 1 mm;

in each of the developing devices 7Y-7C, there uses a developer prepared by mixing the respective toners in yellow, magenta and cyan each of which average particle sizes is 10 μm and the frictional charge is from −10 to −20 μC/g, with the carrier of 25 μm in average particle size comprising the resins containing the dispersed magnetic substance of which the specific resistance is not less than $10^{13}$ Ωcm, in a proportion of 1:4 by weight; and the developer layer is formed on the developing sleeve so as to be 0.5 mm in thickness;

when developing with the developing devices 7Y-7C, respectively, there are applied to the developing sleeve with the developing bias which overlapped a D.C. voltage of −150 V with an A.C. voltage of effective value of 1 KV and frequency of 2 KHz; and the smoothing process made by chargers 15 and 16 is carried out under the conditions, for example, that a D.C. voltage of −200 V is applied to a back plate and an A.C. voltage of 6 KV is applied to the charging electrode; or that the back plate is grounded and a D.C. voltage of −5.5 KV is applied to the charging electrode so as to set the grid voltage to −200 V.

Resultantly, there were obtained clearcut images having no color-slipping at all and excellent color-reproduction.

In the invention, there is provided to only one place between an image-exposure device and a developing device with a color-exposure device capable of switching a plurality of color-filters each other, and the color-filters are switched every time when an image carrier is rotated once. There may be able to use an image reproducing unit in which the discharger of the image-exposure device is utilized in a charging process immediately after developing, that is, an image reproducing unit in which a superposition of toner images can be carried out every time when the image carrier is rotated once. This system will be described in detail later.

According to the multi-color image reproducing methods of the invention, only one single image-exposure is enough to form an indivisual colored electrostatic latent image, therefore, any color-slipping is not taken place in a multi-color image; and any other toner does not adhere to the portions to which the previous toners adhered when superposing toner images, therefore, any color turbidity is not taken place; so that many excellent effects such as that a high-quality image which is sharp and clear without any colorslipping can be obtained; and the apparatus can be made compact in size and inexpensive in cost because the image carrier, the driving mechanism of the exposure-scanning unit, and the like may be simplified in construction similar to the case of the monocolor copying machines; and further, the reliability thereof can also be improved.

Now, another example will be explained referring to FIG. 8. A part of the photoreceptor wherein an n-type (namely. large electron mobility type) photo-semiconductor like cadmium sulfide is used as a photoconductive layer is picked up and an image-forming process thereon is shown schematically in FIG. 8 and hatching for sectional view of each part is omitted. In the figures, 1 and 2 represent a conductive substrate and a photoconductive layer respectively and 3 is an insulating layer including filter portions R, G and B of tricolor separation. A graph under each figure shows the potential on the surface of each part on the photoreceptor.

Figure 8:
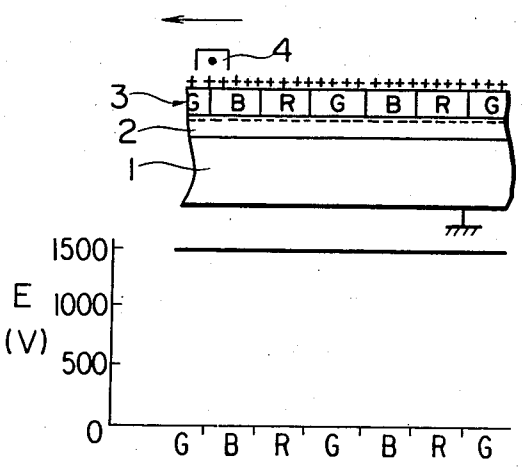
FIGS. 8[1] through 8[10] are the descriptive illustrations showing in order a series of the process taken in the method of embodying another example of the invention.
Figure 8:
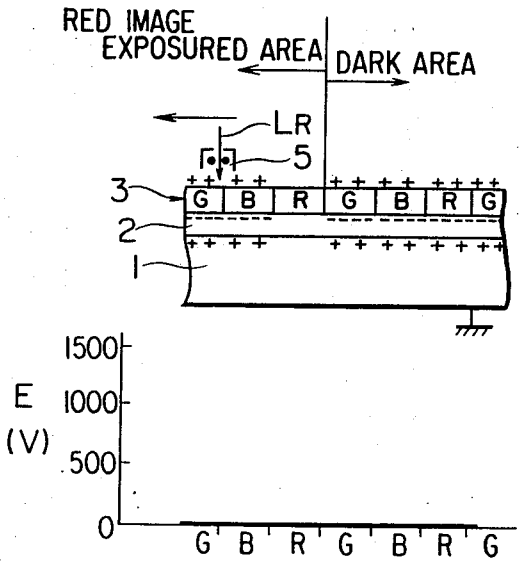
Figure 8:
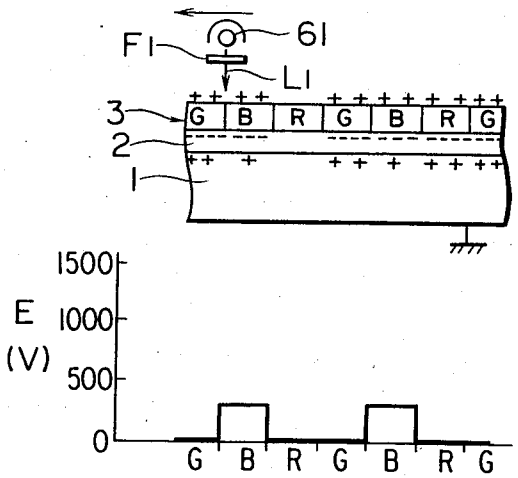
Figure 8:
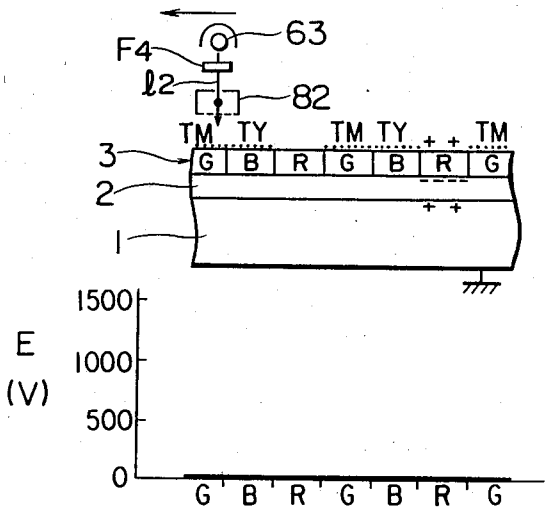
Figure 8:
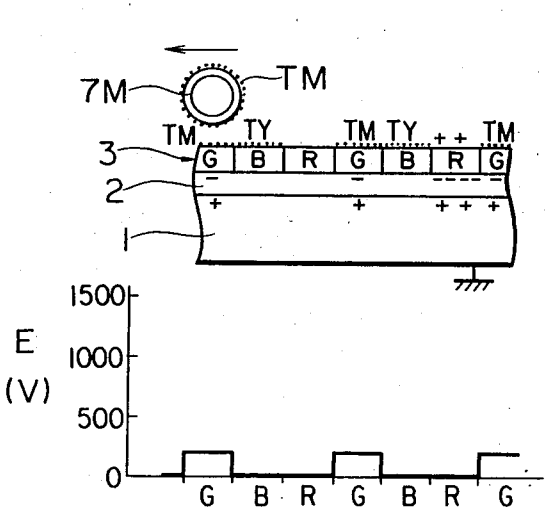

First, as shown in FIG. 8[1], if the charger 4 gives a positive corona discharge on the entire surface. positive charges are produced on the surface of insulating layer 3 and thereby negative charges corresponding to aforesaid positive charges are induced on the boundary surface between photoconductive layer 2 and insulating layer 3.

Next, as shown in FIG. 8[2], an image-exposure is given to the insulating layer 3 while the charges on the surface of insulating layer 3 are being eliminated by giving alternating current or negative discharge thereto by means of a charger 5 equipped with an exposure slit.

As an example, the status of the portion where red color component is irradiated is shown in the figure. The red-light transmits a red filter portion R in the insulating layer 3 and causes the photoconductive layer 2 located underneath the red filter portion R to be conductive and thereby the charges in the photoconductive layer 2 at aforesaid filter portion are eliminated. However, the charges on red filter portions where no image-exposure is given remain uncharged. (In the figure, both filter portion exposed and filter portion unexposed are shown.) Against the foregoing, green filter portion G and blue filter portion B do not transmit the red-light, thereby. negative charges on the photoconductive layer 2 remain there as they are. Owing to the action of the charger 5, the charge distribution on the insulating layer 3 is charged so that the surface potential of the photoreceptor is uniformalized. Thus, the primary latent image is formed. The same results as the foregoing are brought about on each filter portion of the area where green color component and blue color component of the document are irradiated. The primary latent image is a status wherein each of all color components exists under each filter portion respectively as a charge distribution in the form of image. In this stage, the portion on the photoconductive layer 2 where charges are eliminated, needless to say and the portion where charges remain also keep a uniform potential and therefore they do not function as a latent image. In FIG. 8[2], there is shown the case where the voltage after charging is almost zero but this may also be charged down to negative values.

Next, as shown in FIG. 8[3], if a flood exposure is given by the use of the light that transmits one kind of filters contained in the insulating layer 3, for example, by the use of the light $L_1$ that is caused by the light source 61 and a filter $F_1$ and transmits blue color filter portion B but does not transmit green color filter portion G and red color filter portion R ('does not transmit' means 'does not substantially transmit' hereinafter and 'transmit' means 'transmit substantially'), the photoconductive layer 2 underneath the blue color filter B is caused to be conductive and a part of negative charges thereon in the photoconductive layer 2 and charges on the conductive substrate are neutralized, thus only charges on the surface of filter B remain, thereby a potential pattern is generated. This is a secondary latent image. There is no charge produced on the portions of G and R through which the blue light does not transmit. When charge images on the filter B are developed with a developer containing yellow toner TY charged negatively, toners adhere only to the surface of the filter B having a relatively high potential and thus the development is performed (FIG. 8[4]). In this case, negative charges still remain on the portions of photoconductive layer corresponding to the toner-adhering area as shown in the figure. In order to eliminate at least a part of aforesaid residual charges, the surface of the photoreceptor is charged evenly by means of a charger 8I while being given a flood exposure sufficiently thereto by the light l1 that is caused by the light source 62 and a filter $F_2$ and transmits only blue color filter portion B (FIG. 8[5]).

Next, if a flood exposure is given by the light $L_2$ that is caused by the light source 62 and a filter $F_3$ and transmits green color portion G but does not transmit red color portion R, the secondary latent image is formed on the part of green color filter portion G as shown in FIG. 8[6]. If this is developed with magenta toner TM, toners adhere only to the portion of G as shown in FIG. 8[7]. Further, in order to eliminate charges on the photoconductive layer corresponding locationally to magenta-adhering area, the photoreceptor is uniformly charged by the charger 82 while being given a flood exposure sufficiently by the light l2 that is caused by the light source 63 and a filter $F_4$ and penetrates green color portion G but does not penetrate red color portion R (FIG. 8[8]).

Then, as shown in FIG. 8[9], if a flood exposure is given by the light $L_3$ that at least transmits red color filter portion R, a latent image is formed on the red color portion R. If this is developed with cyan toner TC, a cyan image is formed on R portion where the potential in dark area is enhanced as shown in FIG. 8[10].

Above process may be indicated in the same way as Table 1 shown before.

If Such multi-color toner images thus obtained, after being given negative charges, are transferred onto the transferring member like paper and others and then fixed, multi-color images are formed on the transferring member. In the case of this multi-color image, overlapping of different toner, namely the turbidity of color may be avoided because a flood exposure for the purpose of eliminating at least a part of charges on the photoconductive layer corresponding locationally to the adhering area of each toner, is given to the photoreceptor each time the development with chromatic color toner is performed.

Aforesaid flood exposure after the development may be conducted with the light that transmits a filter portion at toner-adhering area but does not transmit other filter portions (the light does not need to have the same spectral characteristics as that of $L_1$ which is the light used for the flood exposure mentioned before). Further, the flood exposure may be conducted concurrently with the uniform charging.

As a transferring-fixing method, a pressure transferring.fusing method and others may also be employed besides an electrostatic transferring method.

Figure 9A:
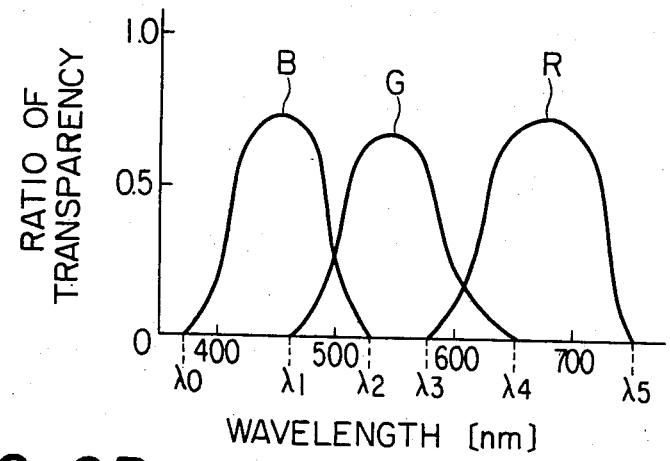
FIG. 9A illustrates the percent transmissions of the color filters, B, G and R each provided on a photoreceptor and used as an example of the invention.

The light $L_1$, $L_2$ and $L_3$ for the flood exposure in aforesaid process do not necessarily be a monochromatic light whose spectral distribution is narrow. When spectral transmittance characteristics of color-separation filters contained in the insulatin9 layr of a photoreceptor are given as in FIG. 9A, as an example, the spectral distributions of $L_1$, $L_2$ and $L_3$ are required to satisfy the following condition.

$L_1$ . . . $\lambda 0 \leqq$ longest wavelength $\leqq \lambda 1$ $L_2$ . . . $\lambda 1 \leqq$ longest wavelength $\leqq \lambda 3$ $L_3$ . . . the one including wavelength component not smaller than $\lambda 3$ and not greater than $\lambda 5$ Therefore, the materials of the light source and the filter which produce the light for each flood exposure do not need to be strictly restricted and therefore the manufacturing thereof is easy and it is possible to obtain them at a low price.

Contrary to the aforesaid example. it is possible to conduct latent-image-forming.development in the order of R, G and B. In this case, each of the light for flood exposure ($L_1' \rightarrow L_2' \rightarrow L_3'$) is required to satisfy the following conditions.

$L_1'$. . . $\lambda 4 \leqq$ shortest wavelength $\leqq \lambda 5$ $L_2'$. . . $\lambda 2 \leqq$ shortest wavelength $\leqq \lambda 4$ $L_3'$. . . the one including wavelength component not smaller than $\lambda 0$ and not greater than $\lambda 2$ Further, it is possible to conduct latent-image-forming.development in the order of B, R (or R, B) and G. In this case, the light for the flood exposure ($L_1'' \rightarrow L_2'' \rightarrow L_3''$) (or $L_2'' \rightarrow L_1'' \rightarrow L3''$) *need to satisfy the following conditions.*

$L_1''$. . . $\lambda 0 \leqq$ lognest wavelength $\leqq \lambda 1$ $L_2''$. . . $\lambda \leqq$ shortest wavelength $\leqq \lambda 5$ $L_3''$. . . the one including wavelength component not smaller than $\lambda 1$ and not greater than $\lambda 4$ The foregoing represents the characteristic of the light for exposure for the formation of potential pattern before the development. In the case of the light transmitting the filter portion that has been developed, the present invention can prevent the filter portion from toner adhesion by eliminating charges in the photoconductive layer.

Incidentally, aforesaid explanation refers to the example wherein the layer of n-type photo-semiconductor is used but it is naturally possible to use p-type (namely, large Hall mobility type) photo-semiconductor like selenium or the like. In this case, however, the sign of plus or minus for charges is just opposite against the foregoing but the basic processes are all the same. Incidentally, when it is difficult to inject charges in the initial charging, the uniform irradiation by means of the light may jointly be employed.

As obvious in the aforesaid explanation, the photoreceptor for the formation of multi-color images in the present example is given an image-exposure while it is being charged and after that the process for providing a flood exposure with the light transmitting at least one kind of plural kinds of filters and for conducting the development, is repeated according to the number of kinds of aforesaid filters. In this process. therefore, the photoreceptor wherein plural color-separation filters are arranged in the line form or mosaic form on the photosensitive layer having the photosensitivity over the entire range of visual rays, is used and an image-exposure is first given to the entire surface of the photoreceptor and thereby the primary latent image corresponding to the separated image density is formed on the photosensitive layer underneath each filter and then a flood exposure by the light transmitting the first color-separation filter is given thereto, thus the primary latent image corresponding to the primary latent image is formed on the aforesaid filter portion. Then, the primary latent image is developed with a color toner whose color is the one corresponding to the color of the filter, preferably the color that is a complimentary color for the color transmitting the filter, and the same operation is repeated for each color-separated image and multi-color images and formed on the photoreceptor, thus multi-color images may be recorded at a stroke on the transferring member through a single transferring.

As an example of the photoreceptor usable in the present invention, the one having a section shown schematically in FIG. 1(*a*) or FIG. 1(*b*) is given.

Further, the shape and the layout of fine color-separation filters in plural kinds constituted of aforesaid colored portions are not limited in particular but the shape and layout shown in aforesaid FIG. 2(*a*), (*b*) and (*c*) are considered.

Incidentally, the filter portion of the insulating layer is not necessarily be limited to blue, green and red but it may be the one containing, for example, a neutral density filter or the portion transmitting ultraviolet rays or infrared rays.

In the aforesaid image-reproducing process, the developer to be used may be either of a single-component developer wherein non-magnetic toner or magnetic toner is used and two-component developer wherein toner and magnetic carrier such as iron powder or the like are mixed. For the development, a method wherein a magnetic brush rubs directly may be used but for the development at least in the second time or thereafter, it is essential to use a non-contact developing method wherein the developer layer on the developer-carrying member does not rub the surface of the photoreceptor, in order to avoid the damage of the toner-images formed on the photoreceptor. This conforms to the Example explained before. In the non-contact developing method, a single-component developer or a two-component developer having non-magnetic toner whose color can freely be selected or having magnetic toner is used, an insulating electric field is produced in the developing area and thus the development is made with a developer layer that does not rub the electrostatic-image-carrier (the photoreceptor). This will be explained in detail as follows. Following description on non-contact developing is applicable to both Example of the present invention described before and Examples which will be explained later.

In the repeating-development wherein aforesaid alternating electric field is used, it is possible to repeat developing several times the photoreceptor having toner images thereon but it has some disadvantages that the toner images formed on the photoreceptor in the previous stage are disturbed in the development of the following stage if the optimum developing conditions are not set and toners already adhered on the photoreceptor return to the developer-carrying member and thereby they enter into the developing unit in the following stage containing the developer whose color is different from that of the developer in the previous stage, thus mixing of color takes place. A method for avoiding aforesaid disadvantages is basically to operate without causing the developer layer on the developer-carrying member to rub or contact the photoreceptor. For this purpose, the clearance between the image-carrier and the developer-carrying member is to be kept to be greater than the thickness of the developer layer on the developer-carrier member (provided however that there is no voltage difference). The experiments conducted by the inventors of the present invention have clarified that there are preferable developing conditions for avoiding thoroughly aforesaid problems and for forming each toner image in a sufficient image density. Regarding the conditions, it has been clarified that the clearance d(mm) between an image-carrier and a developer-carrying member in the developing area (hereinafter referred simply to clearance d) and the amplitude $V_{AC}$ and frequency f(Hz) both of an alternating component of developing bias that generates an alternating electric field do not cause an excellent image quality when the values of them are determined individually each other and aforesaid parameters are closely connected.

The background for the foregoing will be explained as follows.

Figure 10:
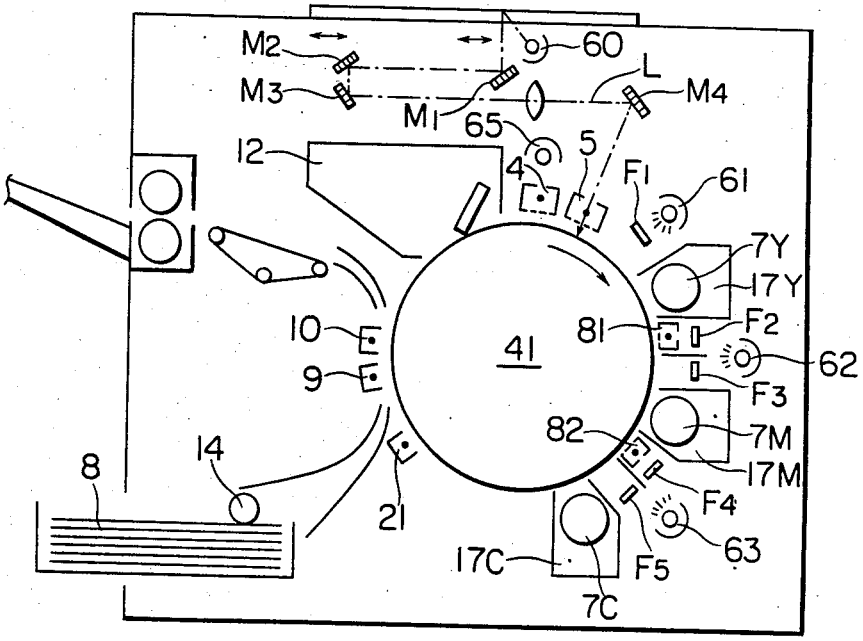
FIG. 10 is an example of a color copying machine in which the example shown in FIG. 8 out of the embodiments of the invention is applied.

The experiments were conducted by the use of the color copying machine shown in FIG. 10 and the influence of parameters such as voltage, frequency or the like of an alternating component of the developing bias for the developing unit 17M was investigated when two-color toner images were formed on the developing units I7Y and I7M.

Figure 11:
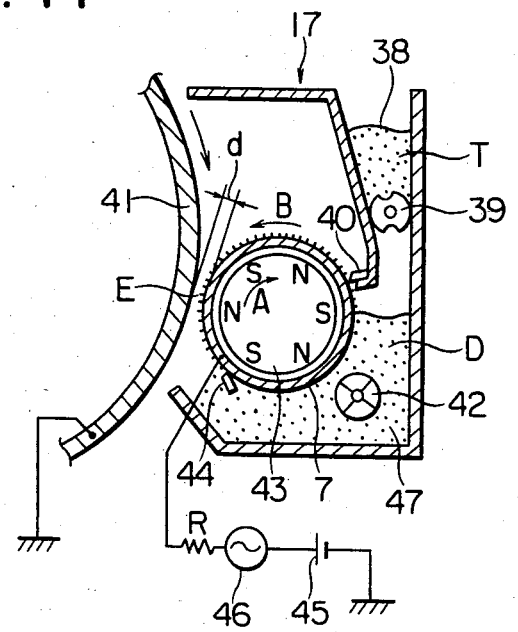
FIG. 11 illustrates a schematic diagram of a developing unit.

FIG. 11 shows as example of a basic structure of each developing unit I7Y, 17M, 17C shown in FIG. 10 which is almost the same as FIG. 6 and in FIG. 11, a D.C. power supply 45 nd an alternating power supply 46 both for applying the developing bias are indicated in the form of series connection between the sleeve 7 and the photoreceptor drum 41.

As one of the examples firstly, the developer D loaded in the developing unit 17M is a magneLic single-component developer and the one wherein 70% by weight of thermoplastic resin, 10% by weight of pigment (carbon black), 20% by weight of magnetic substance and charge-control agent are kneaded and smashed for obtaining an average particle size of 15 μm and fluidizing agent is further added, is used. The charging amount is to be controlled by a charge-controlling agent.

Figure 12:
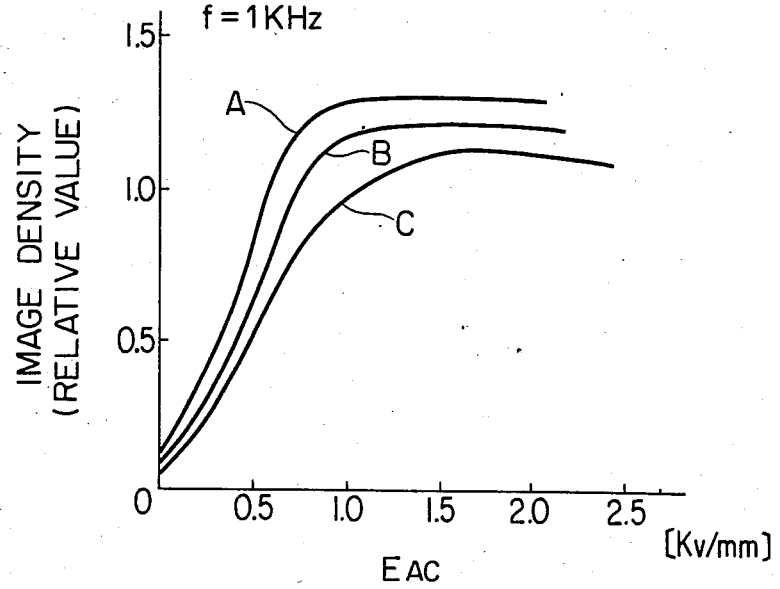
FIGS. 12 and 13 each illustrate the experimental data of the development characteristics obtained by making use of a single-component type developer.
Figure 13:
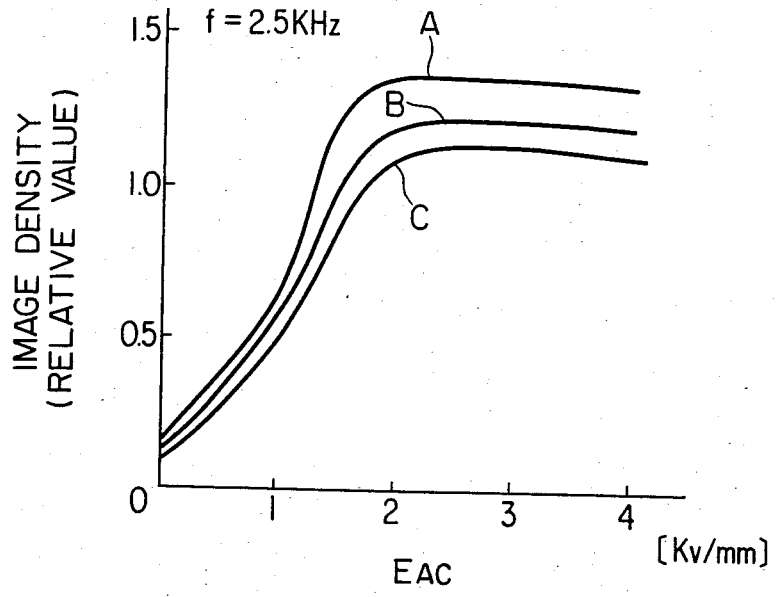

The results shown in FIG. 12 and FIG. 13 were obtained from the experiments.

FIG. 12 shows the relation between an amplitude of an alternating component and an image-density of a black toner image obtained when the photoreceptor was developed after it was given a surface potential of 500 V and given a uniform exposure under the conditions wherein the distance between the photoreceptor drum 41 and the sleeve 7 was 0.7 mm, the thickness of the developer layer was 0.3 mm, D.C. component of the developing bias to be applied on the sleeve 7 was 50 V and the frequency of an alternating component of the developing bias was 1 KHz. Further, yellow single-component developer is loaded in the developing unit 17Y in this case. The amplitude $E_{AC}$ of alternating electric field strength is a value obtained by dividing the amplitude $V_{AC}$ of alternating voltage of the developing bias with the distance d. The curves A, B and C shown in FIG. 12 represent the results obtained when magnetic toners having average charge amounts of −5 μc/g, −3 μc/g and −2 μc/g were used respectively. Three curves of A, B and C commonly showed that an image density was great with the amplitude of alternating comonent of the electric field ranging between 200 V/mm and 1.5 KV/mm and the toner image formed in advance on the photoreceptor drum 41 was partially damaged.

FIG. 13 shows the variation of the image density corresponding to the variation of alternating electric field strength obtained under the conditions that the frequency of alternating component of the developing bias was 2.5 KHz and the same conditions as in the experiments of FIG. 12 were used.

According to the results of aforesaid experiments the image density was great with the amplitude $E_{AC}$ of aforesaid alternating electric field strength ranging between 500 V/mm and 3.8 KV/mm and a part of the toner image formed in advance on the photoreceptor drum 41 was damaged with the amplitude $E_{AC}$ of 3.2 KV/mm or more (not illustrated).

Incidentally, FIG. 12 and FIG. 13 show that the image density changes in a way that it is saturated or it is lowered slightly with a certain border value of the amplitude. The value of the amplitude, as obvious from the curves A, B and C, is not so dependent on the average charge amount.

Figure 14:
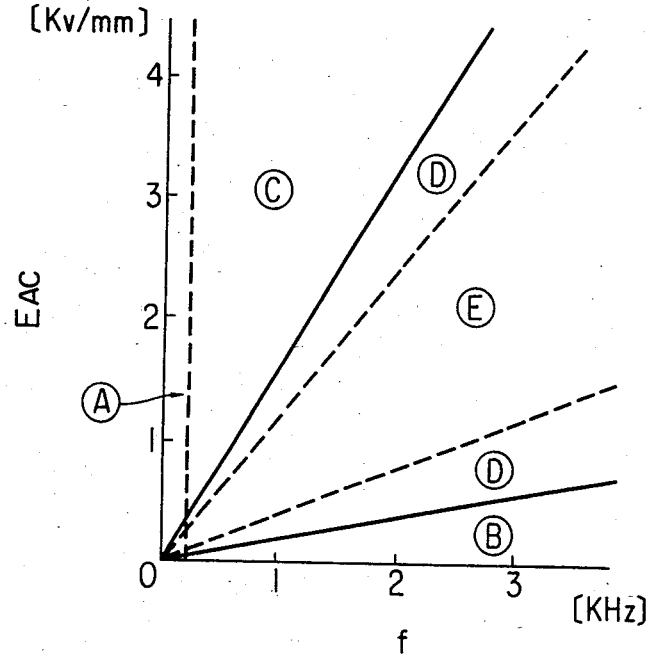
FIG. 14 is a graph exhibiting the suitable developing conditions in the case of using a single-component type developer.

After the experiments similar to FIG. 12 and FIG. 13 were conducted under the conditions which were changed for each experiment, the relation between the amplitude $E_{AC}$ of alternating electric field strength and the frequency was put in order and the results shown in FIG. 14 were obtained.

In FIG. 14, zone (A) is the area where the streaks tend to occur, zone (B) is the area where the effect of alternating component is not shown, zone (C) is the area where the toner image already formed tends to be damaged, (D) and (E) zones are the areas where the effect of alternating component is shown. sufficient developing density is obtained and the toner image already formed is not damaged, and (E) zone is the area that is especially preferable among the foregoing.

The result of the foregoing shows that there is a proper zone for the amplitude and the frequency both of alternating electric field strength for developing the toner images in the next (following) stage giving the optimum density without damaging the toner image formed on the photoreceptor drum 41 previously (in the preceding stage).

In the area where the image density is in an increasing tendency against the amplitude $E_{AC}$ of alternating electric field strength, namely in the area where the amplitude $E_{AC}$ of alternating electric field strength is $0.2 \sim 1$ KV/mm concerning the density curve A in FIG. 12, for example, an alternating component of the developing bias actuates the threshold value with which toners scatter from the sleeve to be easily exceeded, thus toners with a small charge amount can even be adhered on the photoreceptor drum 41 and thereby the development is conducted. As the amplitude $E_{AC}$ of alternating electric field strength grows greater, therefore, the image density grows greater.

On the other hand, there are considered some reasons why the image density is saturated or it is lowered slightly as the amplitude of alternating electric field grows greater (e.g. the area where the amplitude of alternating electric field strength is 1 KV or more concerning the density curve A in FIG. 12). As the amplitude $E_{AC}$ of alternating electric field strength grows greater, toners vibrate hard, a toner cluster formed by the cohesion of toner tends to be broken, thus toners having great charge only are adhered selectively to the photoreceptor drum and toners having small charge tend not to be used for developing. Further, toners having small charge, after being adhered to the photoreceptor drum 41, tend to return to the sleeve 7 with alternating bias because their image-force is weak. Further, if the amplitude of electric field strength of an alternating component is too big, the phenomenon that toners tend not to be used for development tends to happen due to the leakage of charges on the surface of the photoreceptor drum 41. It is considered that aforesaid reasons actually cause together the image density to be saturated or lowered.

On the other hand, if the amplitude $E_{AC}$ of alternating electric field strength is made larger, the toner image formed in advance on the photoreceptor drum 41 is damaged and the greater an alternating component is, the greater the degree of damage is as explained above. The cause for this is considered to be that a force caused by an alternating component actuates toners adhered on the photoreceptor drum 41 to be brought back to the sleeve 7. When the development is conducted so that toner images are superposed on the photoreceptor drum 41, it is a serious problem that the toner image formed already in the preceding stage is damaged in the following stage.

Further, as the comparison between the result of FIG. 12 and that of FIG. 13 shows, the experiments conducted with frequency of alternating component changed for each experiment showed a tendency that the higher the frequency is, the smaller the image density is. The cause for this is that toner particles can not follow the variation of the electric field thereby the range of vibration thereof is narrowed, thus the toner particles become hard to be adsorbed.

Based upon aforesaid results of experiments, inventors of the present invention have concluded that it is possible to conduct the following development with a proper density without disturbing the toner image formed on the photoreceptor drum 41 in the preceding development if the development is conducted in each developing step under the condition that satisfies $$0.2 \leqq V_{AC}/(d.f) \leqq 1.6$$

where, the amplitude of alternating component of the developing bias is $V_{AC}$(v), the frequency is f(Hz) and the distance between the photoreceptor drum 41 and the sleeve 7 is d(mm). In order to obtain the sufficient image density and in order not to disturb the toner image or images formed in the preceding stage or stages, it is more preferable to satisfy the condition of $$0.4 \leqq V_{AC}/(d.f) \leqq 1.2$$

which is an area where the image density shows an increasing tendency against an alternating electric field in FIG. 12 and FIG. 13. Further in the aforesaid area, it is more preferable to satisfy $$0.6 \leqq V_{AC}/(d.f) \leqq 1.0$$

which is an area corresponding to the slightly lower electric field rather than the image density saturated.

Further. when the frequency f of alternating component is set at 200 Hz or more and a rotating magnetic roll is used as a means to supply the developer to the photoreceptor drum 41 in order to avoid the streaks caused by alternating component, it is further preferable to set the frequency of alternating component at 500 Hz or more for the purpose of eliminating the influence of a beat caused by an alternating component and the rotation of a magnetic roll.

Next, the experiments were conducted using two-component developer and the color copier shown in FIG. 10 in the same manner as the foregoing. The developer D loaded in the developing unit 17M is a two-component developer consisting of magnetic carrier and non-magnetic toner and aforesaid carrier is a carrier prepared by dispersing fine powder of iron oxide in the resins so that the physical properties of average particle size of 20 μm, magnetization of 30 emu/g and a specific resistance of $10^{14}\Omega$.cm are shown. Incidentally, the specific resistance is a value.

The toners to be used therein are prepared in such a manner that a small amount of a charge-regulating agent is added in the mixture comprising 90% by weight of a thermoplastic resin and 10% by weight of a pigment, i.e., carbon black, and the resulting matter is kneaded and then pulverized so that an average particle size of the pulverized matters can be 10 μm. Next, the developer D is prepared by mixing up that 80% by weight of the carrier with 20% by weight of the toners. In this instance, the toners are negatively charged by the friction thereof with the carriers.

Figure 15:
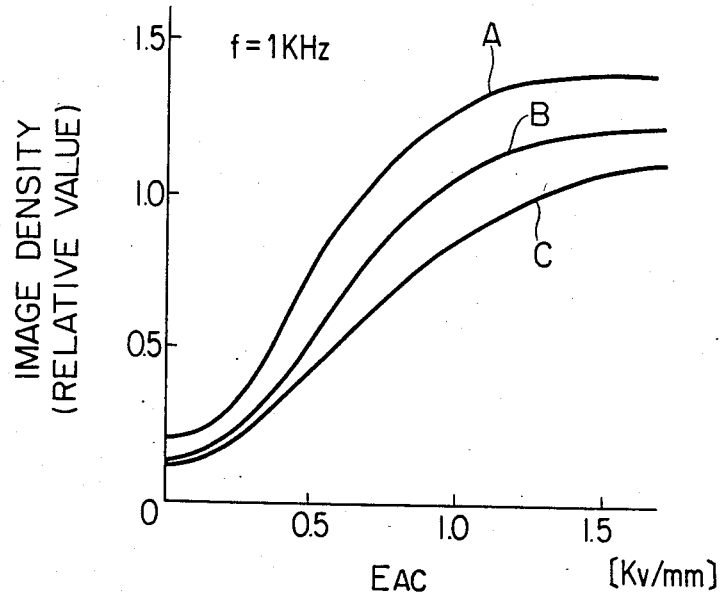
FIGS. 15 and i6 each are the graph exhibiting the experimental data of the development characteristics obtained by making use of the two-component type developers, respectively.
Figure 16:
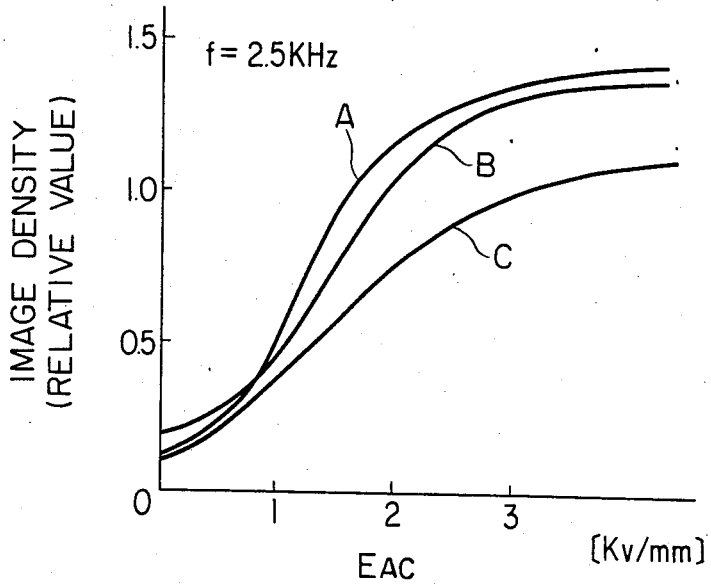

The results obtained from the experiment are shown in FIGS. 15 and 16.

FIG. 15 illustrates the relation between the amplitude of an A.C. component and the image density of a different color toner image in the case of developing the areas where the surface potential of a photoreceptor to which a uniform-exposure was applied is 500 V, under the condition that the gap between photoreceptor 41 and sleeve 7 is 1.0 mm, the developer layer is 0.7 mm in thickness, the charged potential of the photoreceptor is 500 V, the D.C. component of the developing bias is 50 V, and the frequency of the A.C. component is 1 KHz. A two-component type developing agent for yelow-color development is stored in developing unit 17Y. Amplitude $E_{AC}$ of the strength of the A.C. electric field is expressed by a value obtained by dividing an amplitude $V_{AC}$ of the A.C. voltage of the developing bias by a gap d.

In FIG. 15, the curves A, B, C exhibit the results obtained in the cases of using the toners in which the average charged amounts are regulated to −30 μc/g, −20 μc/g and −15 μc/g, respectively.

It can be observed that everyone of the three curves, A, B, C displays the effects of the A.C. component when the amplitude of the A.C. component of the electric field is not lower than 200 V, and the toner images formed in advance on the photoreceptor drum are partly destroyed when the amplitude is not lower than 2,500 V.

FIG. 16 illustrates the variations of an image density at the time when the frequency of an A.C. component of a developing bias is 2.5 KHz, and the strength of an A.C. electric field $E_{AC}$ is varied under the same conditions as those in the experiment illustrated in FIG. 15.

According to the results of the experiment, the image density becomes greater when the amplitude $E_{AC}$ of the strength of the A.C. electric field exceeds 500 V/mm, and the toner image formed in advance on the photoreceptor drum 41 is partly destroyed when the amplitude $E_{AC}$ exceeds 4 KV/mm.

As is obvious from the results shown in FIGS. 15 and 16, an image density is varied to saturate or slightly lower when an amplitude is in certain confines. The value of such amplitude on the confines may be obtained without depending much on the average charged amount of toners, as easily understandable from the curves, A, B and C. The reasons thereof may be presumed as follows. Namely, in a two-component type developer, the toners thereof are charged, however, not so much as in a single-component type developer, by the friction with carriers or by the mutual friction with other toners, and the charged amount of the toners may supposedly be distributed over widely, therefore, the toners having a larger amount of charge may be preferentially developed and, even if an average charged amount is regulated by making use of a charge-reglating agent, there is not a remarkable change in the proportion of the toners having the above-mentioned large amount of charge, therefore, a change in the development characteristics may be seen in a way but not so much seen.

In an area where an image density intends to increase with respect to an amplitude $E_{AC}$ of the strength of an A.C. electric field, for example, in an area where an amplitude $E_{AC}$ of the strength of an A.C. electric field becomes 0.2 to 1.2 KV/mm with respect to the density curve A shown in FIG. 15, the A.C. component of the developing bias works to easily exceed a threshold value for flying the toners from the sleeve and then to make even less-charged toners adhere to photoreceptor drum 41 so as to be supplied for a development. Accordingly, the larger the amplitude of the strength of an A.C. electric field is, the more an image density is.

On the other hand, in an area where an image density is saturated with respect to an amplitude $E_{AC}$ of the strength of an A.C. electric field, that is, the area in curve A shown in FIG. 15 where the amplitude $E_{AC}$ of the strength of the A.C. electric field is not lower than 1.2 KV/mm the above-mentioned phenomena may be described as follows. Namely, in the area, toners will be oscillated more violently as the amplitude of the strength of an A.C. electric field is getting increased so that the clusters formed by making toners cohere are apt to be cracked up, and only toners having a higher charge will selectively adhere to photoreceptor drum 41, so that the toner particles having a less charge will hardly be developed. In addition, such toners having a less charge are weak in mirror image power, therefore, they are apt to be returned to sleeve 7 by an A.C. bias, even if they adhere once to the photoreceptor 41. Further, the charge applied on the surface of photoreceptor 41 leaked because of the too large amplitude of the strength of the electric field of an A.C. component, and there is accordingly apt to cause such a phenomenon that toners will hardly be developed. It may be presumed, in practice, that an image density may be kept in a constant degree to the increase of the A.C. components because the above-mentioned factors coincide with each other.

Furthermore, it was found, as mentioned before, that the toner image previously formed on photoreceptor 41 was destroyed when the strength of an A.C. electric field is increased, that is, for example, the amplitude thereof is set to not less than 2.5 KV/mm under the conditions obtained the curve A in FIG. 15, that the degree of such destruction will be getting serious as an A.C. component will become greater. The causes thereof are presumably that the pulling-back force of the A.C. component is applied to the toners adhered to photoreceptor drum 41 so as to let the toners come back to sleeve 7.

In the case that toner images are superposed and developed on photoreceptor drum 41, it is a vital problem that the toner image previously formed is destroyed in a following development process.

As is understandable from the comparison of the results shown in FIGS. 15 and 16 with each other, when a series of experiments was tried respectively by varying the frequency of the A.C. component, it was found that the higher the frequency was made, the lower the image density became. This phenomenon is caused from the fact that toner particles oscillate in a narrow range because they cannot follow the variation of an electric field, so that they can hardly adhere to photoreceptor drum 41.

Figure 17:
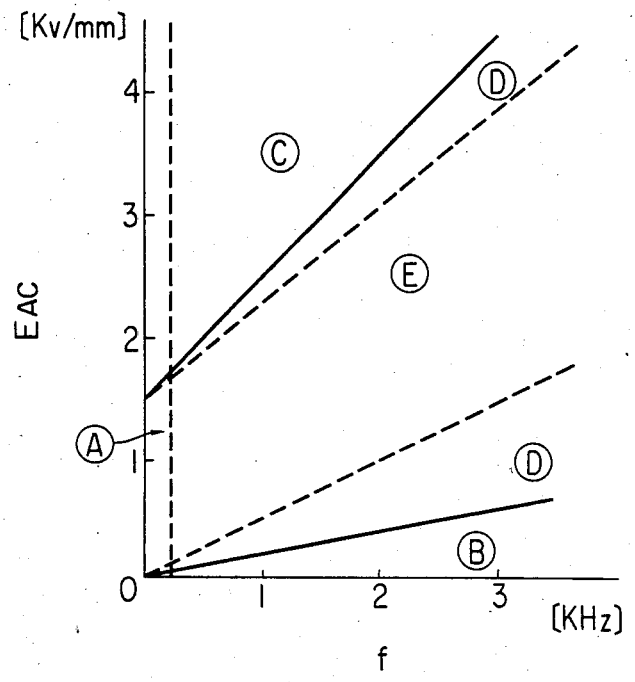
FIG. 17 is a graph exhibiting the suitable developing conditions in the case of using a two-component type developer.

Now, after the experiments conducted in the same manner as FIG. 15 and FIG. 16 with conditions changed for each experiment thereof, the relation between the amplitude $E_{AC}$ of alternating electric field strength and the frequency f was put in order and the results shown in FIG. 17 were obtained.

In FIG. 17, (A) zone is an area when streaks tend to take place, (B) zone is an area where the effect of alternating component does not appear, (C) zone is an area where the toner images formed already tend to be damaged, (D) and (E) zones are an area where the effect of alternating component appears, sufficient developing density is obtained and the toner images already formed are not damaged and (E) zone is an area which is more preferable.

Aforesaid results show that there is an optimum area for the amplitude of alternating electric field strength and its frequency when developing the toner images in the next (following) step without damaging the toner images formed on the photoreceptor drum 41 in the preceding step.

Based on the aforesaid results of the experiments, the inventors of the present invention have concluded that it is possible to develop with a proper density in the following step without disturbing the toner images formed already on the photoreceptor drum 41, if each development is conducted satisfying the following conditions;

$$0.2 \leqq V_{AC}/(d.f)$$

$$\{(V_{AC}/d)-1500\}/f \leqq 1.0$$

where, $V_{AC}$(V) is an amplitude of alternating component of the developing bias; f(Hz) is a frequency; and d(mm) is a distance between the photoreceptor drum 41 and the sleeve 7. It is more preferable to satisfy the following conditions among the aforesaid conditions in order to obtain the sufficient image density and in order not to disturb the toner images formed in the preceding step or steps.

$$0.5 \leqq V_{AC}/(d.f)$$

$$\{(V_{AC}/d)-1500\}/f \leqq 1.0$$

If the following conditions among the foregoing are further satisfied, multi-color images which are more clear and have no color turbidity can be obtained, and it is also possible to prevent the developing unit from being mixed therein with any different color-toners even if operating the unit repeatedly.

In the case that the frequency of an A.C. component is set to not lower than 200 Hz and a rotatable magnetic roller is used for a means of supplying developers to photoreceptor 41, similar to the case of using a two-component type developer, with the purpose of preventing an uneven development caused by the A.C. component, it is further preferred to set frequency of the A.C. component to not lower than 500 Hz, so that to eliminate any influence of a best caused from the A.C. component and the rotation of the magnetic roller.

As mentioned above, an excellent effect can be displayed if a development is carried out with a two-component type developer under an A.C. electric field.

It is particularly preferred to take the following characteristics into consideration; and the characteristics can also be applied to the other embodiments.

(1) Non-magnetic toners may be used, and clear color-toners may also be used.

Two-component and non-contact type developments are highly reliable when being used with an apparatus especially including, for example, a developer transport system, a charging mechanism and the like. (2) The microstructure of toners (especially, not larger than 10 μm in size) is desirable for developing each mosaic filter portion with fidelity, because such mosaic filter size (see FIG. 2) is of the order of from 1/3 to 50 μm.

If toners are large in size, the size thereof will be as large as the filter-size, so that an image-noise will be produced.

If toners are prepared in microstructure, however, there may raise such a problem that the fluidity thereof may be lowered, or they may not satisfactorily move under an oscillating electric field unless a highly charged volume is applied thereto.

In contrast with the above, in a two-component and non-contact type developing method, it is possible to solve such a problem as a developer transport a toner charging difficulty. To the contrary, such problems can hardly be solved in a single-component type developing method. (3) If a color reproduction is carried out in an additive color mixture method, an image density will be lowered unless a satisfactory amount of toners is made adhere to each mosaic filter. It is, therefore, desired to use a developing process in which a large amount of toners is to be made adhere. Such developing process can be materialized by using a two-component type developer satisfactorily capable of micro-structuring the carriers thereof (i.e., the toner concentration is made higher) and charging and transporting the toners thereof. (4) The conditions of superposing toner images can be satisfied by making use of a rather lower A.C. bias voltage than that used in a single-component type developer.

Also, in the invention, a toner-charged distribution is stabler and narrower and the superposing conditions are easier to establish and stabler than in a single-component type developer. It is, therefore, preferred to use a two-component type developer. A developer containing carriers which is to be used in the invention is desired to be those in which the carriers and toners can satisfy the following proper conditions, as described in, for example, Japanese Patent Open to Public Inspection (hereinafter called Japanese Patent O.P.I. Publication) Nos. 75850/1985, 76756/1985, 95456/1985 and 181362/1984.

At first, carriers will now be described. The spheroidization of magnetic carrier particles means that a stirring effect on carrier and transportability of developer are improved and the charge-regulation property of toners are also improved, and thereby a cohesion of toner particles themselves or of toner particles and carrier particles can hardly be produced. In the invention, however, if magnetic carrier particles are large in average particle size, such a problem as mentioned below is possibly raised. (1) An evenness is apt to be produced in a toner image even if an electrostatic image is developed while oscillations are given thereto by an electric field, because of the rough ears of a magnetic brush formed on a developer transport member; and (2) a development of high density image may not be made, because the toner concentration of the ears will become lower; and the like. The problem (1) may be solved by making the carrier particles smaller in average size. As the results of experiments, it was found that the effects on the resolution of the problem (1) begin to display when the average particle size thereof is not larger than 50 μm, and, in particular, the problem (1) is not raised substantially when the average particle size becomes not larger than 30 μm. The problem (2) can also be solved, because the toner concentration of the ears is made higher and a development of a high concentration can be made by the microstructured magnetic carriers for solving the problem (1). On the contrary, if the carrier particles are too fine in size, there may be the following problems; (3) Such carrier particles together with toner particles will adhere to the surface of an image carrier; and (4) the carrier particles are apt to fly about. These developments in which such too fine carrier particles are used depend on the strength of a magnetic field which works on the carrier particles and also on the strength of magnetization of the carrier particles applied by the magnetic field. And yet, according to the experiments, the above-mentioned problems begin to raise gradually when the average particle size of the carrier particles is not larger than 15 μm, the problems raise remarkably when the average particle size thereof is not larger than 5 μm. Carrier particles which adhered to the surface of an image carrier of the invention are normally dark-colored, and a part thereof moves together with toners to a recording paper so as to affect a color image seriously.

It is, accordingly, the proper conditions that the average particle size of the magnetic carriers is to be not larger than 50 μm but not smaller than 5 μm, and more preferably not larger than 30 μm but not smaller than 15 μm, and it is also preferred that they are spheroidized. For reference, an average particle size referred in the invention is in terms of a weight average particle size obtained by making use of a Coulter-Counter manufactured by Coulter Company or a Amnicon-Alpha manufactured by Bosch and Romb Company.

Such Magnetic carrier particles can be obtained, with the use of a conventionally well-known average particle size selecting means, by selecting out from the particles prepared in such a manner that there microstructures and preferably microspheroidizes a ferromagnetic or paramagnetic substance, which is similar to the magnetic substances used in the conventional magnetic carrier particles, that is a metal such as iron, chromium, nickel, cobalt or the like, or the compounds or alloys thereof such as triiron tetraoxide, γ-ferric oxide, chromium dioxide, manganese oxide, ferrite, a manganese-copper alloy or the like; or, preferably, the surface of the above-mentioned magnetic particle is spherically coated with a resin such as a styrene resin, a vinyl resin, an ethyl resin, a rosin modified resin, an acryl resin, a polyamide resin, an epoxy resin, a polyester resin, or with a fatty acid wax made of palmitic acid, stearic acid or the like; or, further preferably, there pulverizes or granulation-polymerizes the particles of a resin or fatty acid wax containing dispersed microstructured magnetic substances so as to prepare spherical particles.

The spherical carrier particles formed, as mentioned above, by making use of the resins or the like will give the other effects, besides the above-mentioned effects, that the developer layer formed on a developer transport member is uniformed and a high bias voltage can be applied to the developer transport member. In other words, the spherical carrier particles formed by making use of the resins or the like will give the following effects: Namely, (1) generally, speaking, carrier particles are apt to be magnetically absorbed in the direction of the major axis. However, the orientation thereof is eliminated by the spheroidization of the particles. Therefore the developer layer is formed uniformly and the local occurrence of low-resistive areas or the uneven layer thickness can be prevented; and (2) as well as the high resistivity of carrier particles, such an edge portion as seen in the conventional carrier particles are eliminated so as not to concentrate an electric field into the edge portions. Consequently, even if a high tension bias voltage is applied to a developer transport member, there is neither disturbance of an electrostatic latent image nor break-down of the bias voltage, with a discharge to the surface of an image carrier. The application of such a high tension bias voltage means that the later-mentioned effects can fully be displayed by the application thereof, in the case that, in a preferred embodiment of the invention, a development is made by the application of an oscillating bias voltage under an oscillating electric field.

As aforementioned, waxes may be used for the carrier particles capable Of displaying the above-mentioned effects, however, it is preferred from the viewpoint of the durability of carriers to use the carrier particles comprising such a wax as described above, and more preferably to use those in which the insulating magnetic particles are so formed that the resistivity of carrier particles can be not lower than $10^8$ Ω.cm, and particularly not lower than $10^{13}$ Ω.cm. This resistivity is to be expressed as a value obtained in the maner that particles are put in a vessel having a sectional area of 0.50 $cm^2$ and tapped, and a load of 1 $kg/cm^2$ is applied onto the particles, and then a voltage capable of generating an electric field of 1000 V/cm is applied to the position between the load and a bottom electrode, and the resulting electric current value is read, provided that the thickness of the particles is about 1 mm. If the resistivity is low, the carrier particles are apt to adhere to the surface of an image carrier, or the bias voltage is apt to be broken down, because the carrier particles are charged when the bias voltage is applied to a developer transport member.

Summarizing the above, the proper conditions of the magnetic carrier particles are that there are to be spheroidized so that the ratio of the major axis thereof to the minor axis is at least not higher than three times, and they have no such a protrusion as a needle-like portion or edged portion, and also the resistivety thereof is not less than $10^8$ Ω.cm, and more preferably, not less than $10^{13}$ Ω.cm. Such magnetic carrier particles as described above are prepared in such a manner that the particles of a magnetic substance are to be selected from those which are as spherically as possible and thereto a resin-coating process is to be applied to use them as the spherical magnetic particles or resin-coated carriers which are made highly resistive; and the particles of a magnetic substance which are as finely as possible are to be used and thereto a spheroidizing process is to be applied after forming the dispersed resin particles to use as the magnetic fine particle dispersed type carriers; or, dispersed resin particles are to be prepared in a spray-dry method.

Next, toners will be described below. The toner particles of a two-component type developer become smaller in average particle size, the charged volume thereof will qualitatively be reduced in proportion to the square of the particle size and adherence force such as Van der Waals force will become stronger relatively so that the toner particles will hardly be separated from the carrier particles; or, when the toner particles adhere once to the non-image areas of the surface of an image carrier, such adhered toner particles will not easily be removed by rubbing with a conventional type magnetic brush so that a fog will be produced. In the conventional magnetic brush developing methods, such problems as mentioned above have remarkably been raised when toner particles become not larger than 10 μm in average particle size. In the method of the invention, the above-mentioned problems can be solved in such a manner that the development of a developer layer, i.e., a development made with the so-called magnetic brush, is carried out in an oscillating electric field. To be more concrete, toner particles which adhere to a developer layer are apt to separate therefrom and to move to the image areas and non-image areas of the surface of an image carrier and further to separate therefrom, because of an oscillation being given electrically. Almost none of the toner particles having a low charged volume is moved to the image areas and non-image areas and no rubbing thereof is made with the surface of the image carrier so that such low-charged toner particles will not adhere to the image carrier because of no frictional charge. Therefore, even the toners having an average particle size of the order of 1μm may be available to use. Accordingly, it is possible to obtain an excellently reproducible and clear-cut toner image capable of developing an electrostatic latent image with fidelity. In addition to the above, an oscillating electric field will weaken the binding of toner particles to carrier particles, therefore, there reduces the adhesion of carrier particles to an image carrier which may be accompanied with the toner particles. Toner particles having a high charged volume are oscillated in an oscillating electric field and according to the strength of the electric field the carrier particles are also oscillated, and thereby the toner particles are selectively moved to the image areas of the surface of the image carrier, therefore, the adhesion of the carrier particles to the surface of the image carrier can sharply be reduced.

On the other hand, when such toners become larger in average particle size, the roughness of images will become remarkable, as aforementioned. In order to develop an image in which juxtaposed fine lines with a pitch of the order of 10 lines/mm can be resolved, it is possible to use toners having an average particle size of the order of 20 μm, without any practical problem. When using toners so microstructured as to be not larger than 10 μm in average particle size, the resolving power can greatly be improved, so that a sharp and high-quality image capable of reproducing various color shades and the like with fidelity. By the reasons mentioned above, it is, therefore, the proper conditions that the average particle size of toners is not larger than 20 μm, and preferably, not larger than 10 μm. In order to that such toner particles can follow up an electric field, it is desired that the charged volume of the toner particles is from 1 μc/g to 3 μc/g or higher, and preferably from 3 to 100 μc/g. Particularly, when the particle size is small, a higher charged volume thereof is to desirably be applied. It is also desired that the resistivity thereof is to be not lower than $10^8$ Ω.cm, and preferably not lower than $10^{13}$ Ω.cm.

Such toners as mentioned above can be prepared in the same processes as those for preparing the conventional type toners. In other words, it is possible to use the toners selected by means of an average particle size selecting means from the spherical or amorphous and non-magnetic or magnetic toner particles used in the conventional type toners. Among them, it is preferred that such toners are of magnetic particles containing the particles of a magnetic substance, and particularly it is preferred that the quantity of the fine particles of such magnetic substance will not exceed 60% by weight, and in addition, a small amount thereof not more than 30% by weight is also preferable to assure the clearness of colors. In the case that such toners contains magnetic particles, the toner particles are influenced by the magnetic force of the magnets incorporated into a developer transport member, so that the uniform formation of a magnetic brush may greatly be improved and a fog occurrence may be prevented, and in addition, the toners may hardly fly about. When the contents of the magnetic substance are too large, the magnetic force generated between the magnetic substance and the carrier particles becomes too powerful, so that a satisfactory developing concentration cannot be obtained, and also that the magnetic fine particles will appear on the surface of the toner particles, therefore, the frictional charge will hardly be regulated and the toner particles are apt to be cracked and further the toner particles are apt to cohere between the carrier particles.

In summary of the above description, the toners which are preferable to be used in an image reproducing method of the invention can be prepared in the same method as the conventionally well-known toner particle preparing methods in which such resins or the fine particles of a magnetic substance as described before about the carriers are used, and to which such a coloring component as carbon or the like and a charge regulating agent or the like if necessary are added; and such preferred toners each comprise the particles having an average particle size of not larger than 20 μm, and more preferably, not larger than 10 μm.

In the image reproducing method of the invention, there preferably uses a developer in which spherical carrier particles and toner particles which are described above are mixed up in the same proportion as in the conventional type of two-component type developers, and, in addition, thereto if necessary a fluidizing agent for making particles fluidly slippery, a cleaning agent for serving to clean up the surface of an image carrier, and the like may also be mixed up. As for the fluidizing agents, a colloidal silica, a silicone varnish, a metal soap, a nonionic surface active agent and the like may be used; and as to the cleaning agents, a surface active agents made of a metallic salt of a fatty acid, an organic group substituted silicone, fluorine and the like.

The above-mentioned are the preferable conditions of the developers to be used, and these developers can prevent the color turbidity caused between the mosaic filters.

In such an apparatus as exemplified in FIG. 11 in which the developing method based on the invention such as described above can be embodied, each of sleeve 7 and magnet member 43 is capable of rotating relatively. FIG. 11 illustrates the case that sleeve 7 is rotated in the direction of the arrow. Wherein, the magnetic poles N, S, of the magnet member 43 are magnetized normally to the magnetic flux density of from 500 to 1500 Gauss, whereby such a layer of developer D, i.e., a magnetic brush, as aforementioned is formed on the surface of sleeve 7. Each of the rotating speeds of sleeve 7 in the direction of the arrow and of magnet member 43 in the opposite direction thereof is preferably from 200 to 2000 rpm. And, the magnetic flux density of each of the N, S magnetic poles is about the same.

In the meantime, it is also allowed that the magnet member 43 is fixed while sleeve 7 is rotated in the direction of the arrow, or that every magnetic flux density of the N, S magnetic poles of the fixed magnet member 43 is not the same, but the magnetic flux density of the N pole facing to an image carrier 4I is greater than the magnetic flux density of the other N, S magnetic poles. It is a matter of course that it is also allowed either to juxtapositionally facing the N poles or to juxtapositionally facing both of the N, S poles, respectively to the image carrier 41. Thus, by making a plurality of magnetic poles face to image carrier 41, there can be displayed such an effect that a development can more be stabilized than in making a single pole face thereto. A developer transport speed generated by the rotation of the rotating magnet member or further by the rotation of the sleeve is to preferably be almost the same as an image carrier moving speed or faster. It is also preferable that a developer transport direction determined by the rotation of the rotating magnet member or by the rotation of the sleeve is to be in the same direction. The case in the same direction is superior to the case in the opposite direction, in image reproducibility. It is, however, to be understood that the invention shall not be limited thereto.

In the above-mentioned, there described an example in which as oscillating bias voltage is applied to a developer transport member, however, the developing methods of the invention shall not be limited thereto. For example, it is also possible to improve the developing effect with giving an oscillation to a magnetic brush in such a manner that some lines of electrode wire are suspended over around the developing area between an image carrier and a developer transport member, and an oscillating voltage is applied thereto. In this case too, it is allowed to apply a D.C. bias voltage to the developer transport member, or to apply thereto with an oscillating voltage having a different oscillation number.

Next, the image forming process based on the invention is as exemplified above, and in addition it is further preferred to take the following processes independently or in combination arbitrarily, wherein, with the purposes of not destroying a toner image formed on photoreceptor drum 41, and developing the successive toner images in a certain concentration one after another on the photoreceptor drum 41, at every time when the successive developments are processed repeatedly, (1) Higher charged toners are to be used in order.

(2) Amplitudes of the electric field strength of the A.C. component of a developing bias are to be decreased in order.

(3) Frequencies of an A.C. component of a developing bias are to be made higher in order.

The more the toners are charged, the more they are affected by an electric field. Therefore, if the highly charged toner particles adhere to photoreceptor 41 in the stage of the initial development, there may be some instances where such toners are returned to the sleeve in the successive developments. Accordingly, in the above-mentioned method (1), such toner particles are prevented from their returning to the sleeve in the successive developments, by making use of the less-charged toner particles in the initial development. The method (2) is to prevent the toner particles having already adhered to the photoreceptor from their returning to the sleeve, by reducing the strength of the electric field in order as a series of the developments is progressed, namely, as the developments are made in succession. There are some methods of making the strength of an electric field less, such as a method in which the voltage of an A.C. component is lowered in order, or a method in which the gap d between photoreceptor 41 and sleeve 7 is widened more as the every successive development is completed in order. The above-mentioned method (3) is to prevent the toner particles having already adhered to the photoreceptor 41 from being returned to the sleeve 7, by making the frequency of an A.C. component higher in order as the developments are repeated.

These methods (1), (2) and (3) may be able to display the effects even when they are used independently. However, a combination of these method can display further more effects. For example, as the developments are repeated in succession, the charged volume of the toners are increased in order and at the same time the A.C. biases are decreased in order, or the similar combination thereto. And, when adopting the above-mentioned three kinds of methods, it is also possible to maintain a suitable image density or a color-balance, by adjusting the A.C. biases, respectively.

EXAMPLE

FIG. 10 is a schematic diagram illustrating a color copying machine capable of suitably embodying the method of the invention.

Figure 9B:
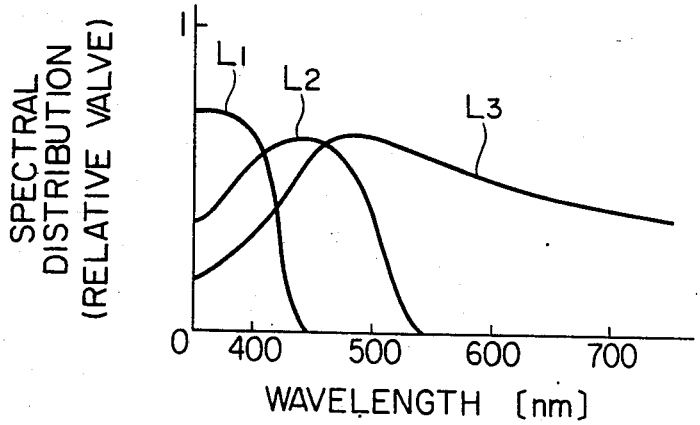
FIGS. 9B and 9C each illustrate the examples of the spectral distribution characteristics of the respective flood-exposure lights.

In the drawing, the reference numeral 4I denotes a photoreceptor drum having the structure shown in FIG. 1(*d*). The insulating layer thereof contains the color-separation filters B, G, and R which are so shaped and arranged as to have been illustrated in FIG. 2(*b*), and these filters each have the spectral transmittance characteristics as shown in FIG. 9. And, the photoconductive layer comprises CdS.

The photoreceptor drum 41 is irradiated, if necessary, from a light-source 65, as is being rotated, so as to be given a positive charge over to the whole surface thereof by a charging electrode 4. Next, the photoreceptor drum 41 is given the exposure L according to an original document image, as is being received an A.C. corona-discharge or that having a signal opposite to that of electrode 4, from electrode 5 having an exposure-slit. 60 denotes the light-source, and $M_1$ through $M_4$ are mirrors, respectively.

The first latent image forming process is completed by the above-mentioned steps.

Next, the photoreceptor drum 41 is flood-exposed to light $L_1$ obtained in combination of light-source 61 and filter $F_1$ so that a latent image may be formed in a blue-filter area B of the photoreceptor drum 41. The latent image is developed by the developing device 17Y in which yellow toners are stored. After the development, the potential remaining in the B areas of the photoconductive layer is eliminated, and as the photoreceptor is flood-exposed to light emitted from light-source 62 through filter $F_2$ so as to uniform the surface potential of the photoreceptor drum 41, and then the photoreceptor drum is charged by electrode 81. This flood-exposure light is particlarly desired to be able to pass through the B areas but not to pass through the G and R areas.

In succession, the photoreceptor drum 41 is flood-exposure to light from the same light-source 62 through filter $F_3$, so that a latent image is formed in G areas. The latent image is developed with developing device 17M containing magenta toners. In order to eliminate the potential remaining in G areas of the photoconductive layer and to uniform the surface potential of the photoreceptor drum 41, and as the photoreceptor drum is being flood-exposed to the light from light-source 63 through filter $F_4$, i.e.. a light capable of passing through the G areas but unable of passing through the R areas, the photoreceptor drum is charged by electrode 82.

After then, the photoreceptor drum 41 is flood-exposed to light $L_3$ from light-source 63 through filter $F_5$, and a latent image is thereby formed in R areas. And, the latent image is developed with developing device 17C containing cyan toners.

Following the above-mentioned processes, there forms a multi-colored toner image on the photoreceptor drum 41. This colored toner image is applied with a potential in a specific polarity. i.e., a negative polariity, so that an electrostatic transfer may easily be carried out.

Thereafter, each of the steps such as a transfer, separation, fixation and cleaning steps are then carried out. To be more concrete to describe, the multi-colored toner image is transferred onto copy-paper 8 fed by paper-feed means 14, by means of transfer-electrode 9. The copy-paper carrying thereon the multi-colored toner image to be transferred is separated from the photoreceptor drum by separation electrode 10 and then fixed by fixing device, so that a finished multi-colored copying matter can be delivered to the outside of the machine. Before the photoreceptor drum 41 having already completed the above-mentioned transfer is to be re-used again, the surface thereof is cleaned up by cleaning device 12 to remove the toners remained thereon.

FIG. 9(*b*) illustrates the spectral distributions of the flood-exposure lights $L_1$ to $L_3$ which are to be applied to the above-mentioned processes. The values of $\lambda 0$ to $\lambda 5$ in the spectral transmittance characteristics of the respective filter areas B, G and R of a photoreceptor are as follows:

$\lambda 0 < 350$ nm, $\lambda 1 \sim 460$ nm, $\lambda 2 \sim 520$ nm, $\lambda 3 \sim 580$ nm, $\lambda 4 \sim 650$ nm, $\lambda 5 < 760$ nm.

Next, Table 2 exhibits the detailed conditions of the experiments tried by the inventors in the example.

When a multi-colored image is tried to form under the above-mentioned conditions, there obtained an image in which the color reproduction was excellent and no color turbidity is produced, and further, the image density is satisfactorily endowed.

TABLE 2

| | |
|---|---|
| Photoreceptor | Photoreceptor layer: CdS (40 μm in thickness)<br>Filter: Mosaic-shaped {FIG. 1(d), FIG. 2(b)}<br>(Insulating layer: 20 μm in thickness = 30 μm)<br>Drum = 180 mm in diameter<br>Line-speed = 200 mm/sec. |
| Developing Unit | Sleeve: Non-magnetic stainless steel made.<br>Diameter = 30 mm<br>Rev. Speed: Line-speed = 150 mm/sec.<br>Magnet Roll: Nos. of magnetic poles: 8<br>Magnetic flux density: 800 G, max. (on the sleeve surface)<br>Rev. Speed: 500 r.p.m. |
| Gap between Sleeve and Photoreceptor | 0.7 mm |
| Developer | Toners: (Black, Yellow, Magenta, Cyan)<br>Average particle size: 10 μm<br>Negative charge: −10 to −20 μc/g<br>Carriers: Magnetic substance + resin dispersed type<br>Average particle size: 25 μm<br>Resistivity: $10^{13}$ Ω.cm. or higher<br>Mixing ratio by weight: Toner: Carrier = 1:4 |
| Thickness of Developer layer | 0.4 mm |
| Initial applied voltage | +1.5 KV (by Colotron charger) |
| Simultaneously applied voltage with an imagewise exposure | −200 V (by Scolotron charger) |
| Uniformed voltage | −200 V (by Scolotron charger) |
| Developing bias (Common) | DC150 V<br>AC1.0 KV (at effective value), 2 KHz |

EXAMPLE

Next, the invention is to be further embodied in the apparatus shown in FIG. 10.

The different points of this example from the former example are as follows:

(1) The positions of developing devices 17M and 17C are replaced by each other.

(2) The order of forming images is TY→TC→TM→TK.

(3) The photoreceptor is also sensitive to ultraviolet and infrared spectral regions.

Figure 9C:
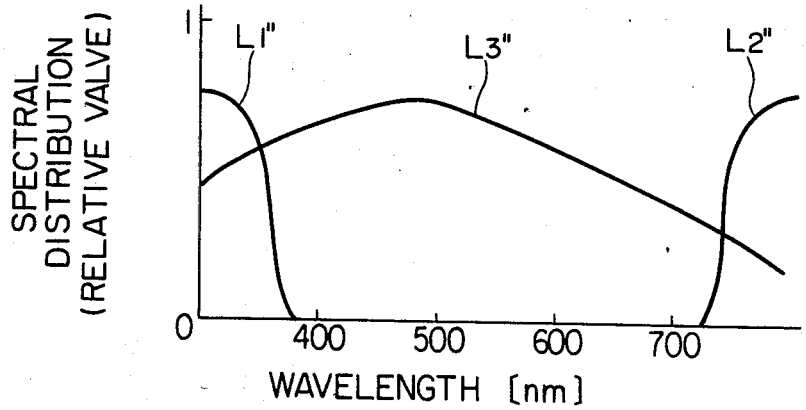

(4) The spectral characteristics of the flood-exposure light ($L_1''$→$L_2''$→$L_3''$) are as shown in FIG. 9C.

As the result of the image formation, there obtained a multi-color image in which all colors were excellently reproduced and no color turbidity was produced and, further, the image density was satisfactory.

The invention shall not be limited to the developing methods described above. As for the modified examples of such developing methods in which a photoreceptor is not rubbed to make a development, it is needless to say that there may be included multi-color image reproducing methods of the invention such as the methods described in Japanese Patent O.P.I. Publication Nos. 42565/1984 and 123859/1985 in which only toners are taken out from a complex type developer onto a developer transport member and a single-component type development is made with the toners in an insulating electric field; the methods described in Japanese Patent O.P.I. Publication No. 125753/1981 in which a line-type or net-type regulating electrode is provided and a single component type development is made in an insulating electric field; and a method described in Japanese Patent O.P.I. Publication No. 223467/1984 in which a regulating electrode similar to the above is provided to make a development with a two-component type developer.

In the abovegiven examples, a corona-transfer system is used for transferring a toner image, but the other systems may also be used. For example, when using an adhesion transfer system described in Japanese Patent Examined Publication Nos. 41679/1971 and 22763/1973, every transfer can be performed without taking the polarity of toners into consideration. In addition, it is possible to adopt such a system than a toner image can be fixed directly on a photoreceptor surface, like an electrofax.

It is also possible that a photoreceptor is so arranged as to comprise a transparent insulating layer, a photoconductive layer, a transparent conductive layer and a filter layer, and a charging is made from the transparent insulating layer side, and an imagewise exposure and a flood-exposure are given from the rear side, that is, from the filter layer side, and then a development is made from the transparent insulating layer side.

Every description above is of the examples of color copying machines in which the so-called three-color-separation filters and three-primary-color toners are respectively used. It is, however, to be understood that the invention shall not be limited thereto, but the invention can also be applied widely to various kinds of multi-color image reproducing apparatuses, color-photographic printers, and the like.

It is needless to say that any combination of the colors of any color-separation filters and the colors of toners corresponding thereto can arbitrarily be selected according to the purposes of using them. Further, the structures of such filters of the photoreceptors shall not also be limited thereto, but the patterns, arrangements and the like thereof can variously be modified. For example, it may be possible to devise a process in which a two-colored copying matter may be obtained. If this is the case, it may be also to use such a photoreceptor in which a group of green (G) filters are scatteringly distributed and an original document comprising partly red areas and partly black areas. On the other hand, if using a process basically similar to the aforementioned process, provided that the flood-exposure is to be made with either G and R or G and B in this case, in the resulting copying matter, the black areas of an original document will come out in a nearly black areas comprising black toners and red toners and the red areas will come out in the red areas comprising red toners. In the case that the words, 'a plurality if kinds of the filters', are used in this specification, there include such a case that, even if a photoreceptor bears thereon a layer comprising an area where there is none of any single kind of colored filter (there may be a transparent resin, the air or the like.), the no-filter areas may be considered as transparent filters. The above-mentioned recognition shall be applied not only to the present example but also to every embodiment of the invention.

Further, in the case that the word, 'charge', is used in this specification, there includes such a case that, when a charge is applied, the surface potential will become nil or eliminated.

In the present description, the spectral characteristics of the specific lights for a flood-exposure used therein are those of the same colors with green (G), blue (B) and red (R) respectively used in the filters of the photoreceptor, how ever, such spectral characteristics thereof shall not be limited to G, B and R. In conclusion, it is good enough that such spectral characteristics is capable to form an electric potential pattern only in a specific filter portions corresponding to the specific lights emitted onto a photoreceptor through a flood-exposure with the specific lights. There may be given such a case as an example that, when forming a potential pattern in blue filters, a flood-exposure is made by a light having the broad spectral characteristics containing the wavelength of from not longer than about 500 mm to not shorter than 400 mm.

Further, as another example, if positive charges are given by the charter 4 on the entire surface, positive charges are produced on the surface of the insulating layer 3 and corresponding thereto, negative charges are induced on the boundary surface between the photoconductive layer 2 and the insulating layer 3.

Figure 18:
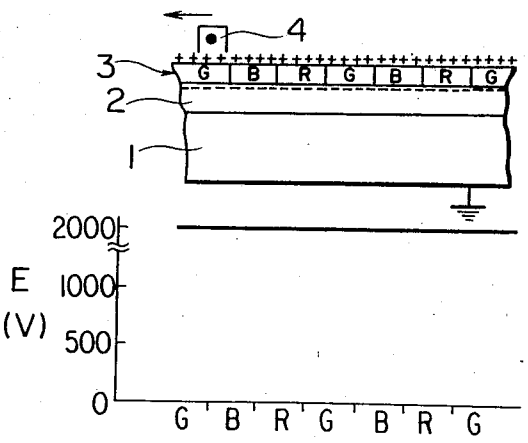
FIGS. 18[1] through 8[8] are the schematic diagrams illustrating the respective processes capable of embodying a further example of the methods of the invention.
Figure 18:
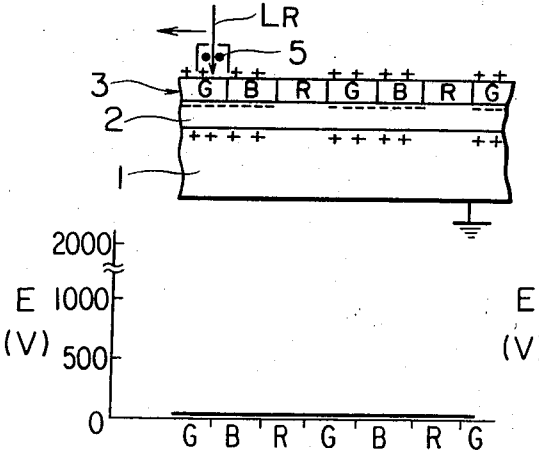
Figure 18:
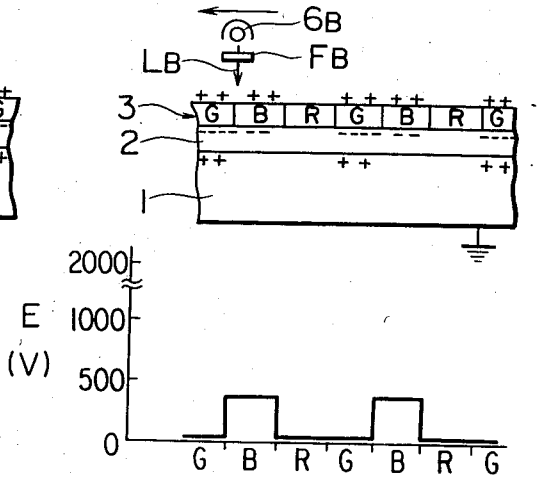
Figure 18:
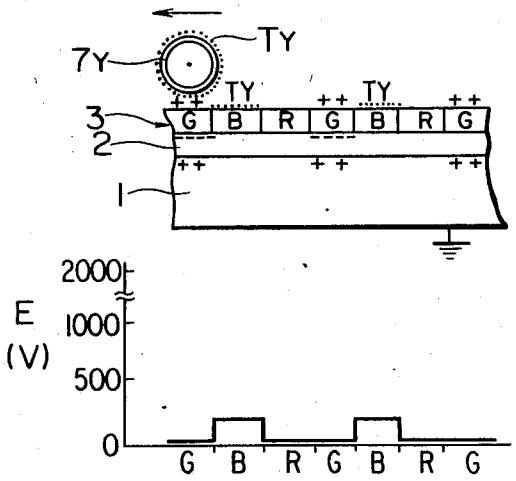
Figure 18:
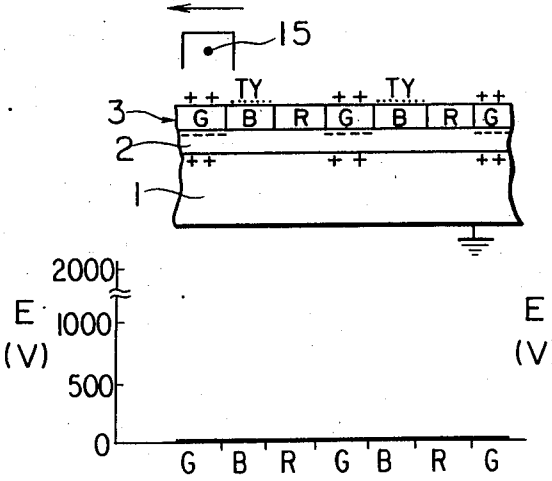
Figure 18:
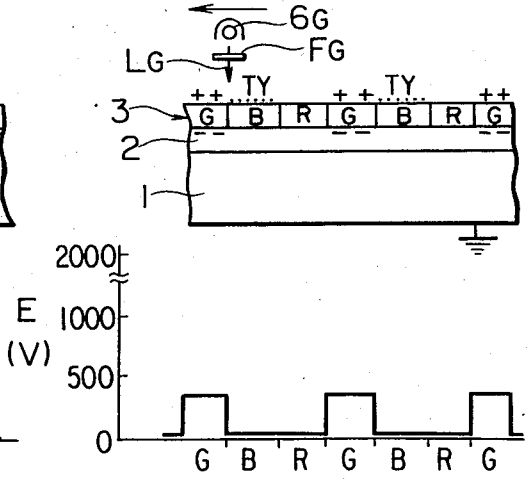
Figure 18:
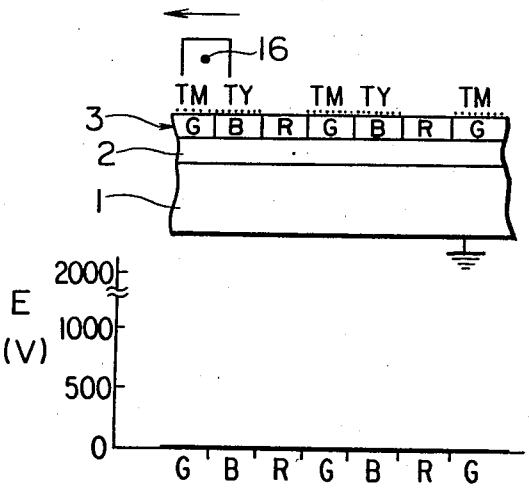
Figure 18:
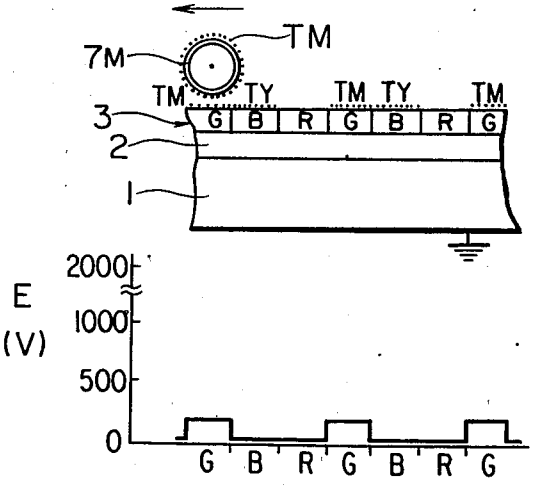

Next, as shown in FIG. 18, an exposure of colored images, for example, the exposure $I_R$ of red images is given while eliminating the charges on the surface of the insulating layer 3 by giving the alternating or negative charges by means of the charger 5 equipped with an exposure slit.

The red light penetrates the red filter portion R of the insulating layer 3 and causes the photoconductive layer 2 located underneath the red filter portion R to be conductive and thereby the positive charges on the insulating layer 3 and the charges in the photoconductive layer 2 are eliminated at the aforesaid filter portion. However, the green filter portion 3G and the blue filter portion 3B do not transmit the red light and therefore, a part of positive charges on the insulating layer and negative charges on the photoconductive layer 2 remain as they are.

The foregoing corresponds to the formation of the primary latent image and on this stage, 3G and 3B where charges remain, to say nothing of red filter portion R are at the same potential on the insulating layer and therefore there is no function as an electrostatic image. In FIG. 18, the potential after charging which is almost zero is shown and it may be charged down to the negative value.

Next, as shown in FIG. 18, if a flood exposure is given by the light of the same color as a certain color in the filters contained in the insulating layer 3, that is, the light source 6B for example, and blue light $L_B$ obtained from the blue filter $F_B$, the photoconductive layer 2 underneath the filter portion B that transmits the blue light is caused to be conductive and a part of negative charges on the photoconductive layer 2 corresponding to aforesaid location and the charges on the conductive base board are neutralized and thus the potential pattern is produced only on the surface of the filter B. No change is made at the portions of G and R both transmitting no blue light. If the charge image on the filter B is developed with a developer containing negatively-charged yellow toner TY, toners adhere only to the insulating layer B portion having potential, thus the development is made (FIG. 18[4]).

Next, if a flood exposure is given with the green light $L_G$ as in FIG. 18[6] after the charging is made by the charger 5 as shown in FIG. 18[5] for the purpose of eliminating the potential difference produced, the latent image is formed at the green filter portion G like the aforesaid occasion of flood exposure by the blue light. If the latent image is developed with magenta toner TM as shown in FIG. 18[7], magenta toner TM adheres only to the portion of the filter G. Though a flood exposure is given next with the red light as shown in FIG. 18[8] after re-charging, a potential pattern is not formed at the red filter portion R and therefore cyan toner does not adhere thereto in spite of the development with cyan toner.

If the toner image thus obtained is transferred to the transferring member such as a copy paper and then is fixed, the red image caused by the mixed color of yellow toner and magenta toner is reproduced on the transferring member.

Also for other color, the color reproduction by the combination of a three-color-separation method and toner of three primary colors is made as the described Table 1 shows.

Incidentally, aforesaid explanation refers to the example wherein an n-type sexiconductor is used, it is naturally possible to use a p-type (namely, high-Hall-xobility type) photo-semiconductor layer and in this case the basic process is entirely the same except that the signs of plus or minus for charges are all opposite. Incidentally, when it is difficult to inject charges in the primary charging, the uniform irradiation by means of the light is to be used together.

As is clear from the aforesaid explanation, the process wherein a flood exposure by means of the light identical in color to one kind of filters of plural kinds is given and then the development is done after the image exposure is given while the photoreceptor for multi-color-image-forming is being charged, is repeated according to the number of kinds of aforesaid filters in the present example. Namely, fine color-separation filters are arranged on the photoreceptor and after the image exposure (a step of FIG. 18[2]), a flood exposure by means of the specific light is given (steps of FIG. 18[3] and [6]), a potential pattern is formed at each color portion of color-separation filters and the development is done by the use of toner having the corresponding color (steps of FIG. 18[4] and[7]) and the foregoing is repeated to obtain the multi-color images. According to this process, therefore, the photoreceptor wherein plural color-separation filters are arranged in a fine line form or mosaic form on the photosensitive layer having the photosensitivity for the entire range of visible rays, is used and an image-exposure is given to the entire surface of the photoreceptor so that the primary latent image corresponding to the separation image density is formed on the photosensitive layer underneath each filter and then the flood exposure by means of the specific light (same color as that of filter in the present example) is given to the photoreceptor and thereby the secondary latent image is formed only on the filter of aforesaid specific color and thus the potential pattern corresponding to the light intensity in the process for forming the primary latent image is fomred. Then, the development is made by the color toner whose color is the one corresponding to the color of the filter, preferably the one that is in the relation of complementary color for the color penetrating the filter and the same operation as the foregoing is repeated for each color-separation image for forming the multi-color images on the photoreceptor, thus it is possible to record at a stroke the multi-color images on the transferring member through a single transferring.

Figure 19:
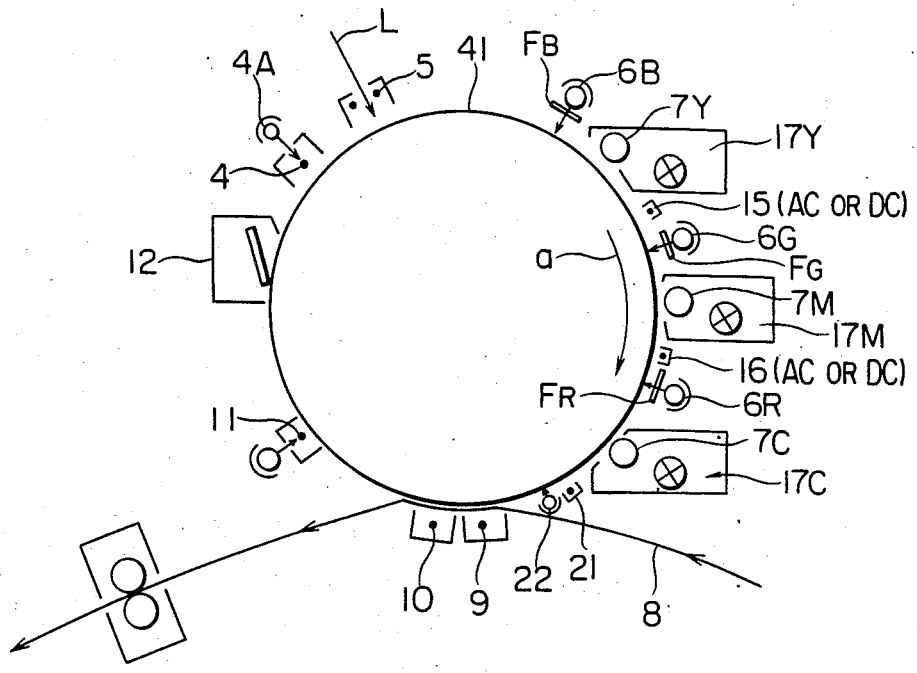
FIG. 19 illustrates an example of the multi-color image reproducing apparatus wherein the example illustrated in FIG. 18 is embodied

FIG. 19 is a schematic diagram of the image-forming section of a color copying machine that is suitable for the working of aforesaid process in the present example. In the figure, 41 is a photoreceptor drum consisting of the photoreceptor having the structure shown in FIG. 18 and it rotates in the direction of an arrow "a" during the copying operation. The photoreceptor 41 (is given charges on the entire surface thereof by the charging electrode 4 while it is rotating and is being irradiated by the light source 4A when necessary and then is given the exposure L of a document while receiving from the next electrode 5 equipped with an exposure slit the corona discharge that is of alternating or of a sign opposite to the electrode 4, thus a process of forming a primary latent image is completed. Then, a flood exposure of the blue light obtained through the combination of the light source 6B and the blue filter $F_B$ for the light source is given and then the development is done by the developing sleeve 7Y of the developing unit 17Y wherein yellow toner is loaded. Then, the re-charging by means of the charger 15, a succeeding flood exposure by means of the green light obtained from the light source 6G and the green filter $F_G$ for the light source and the succeeding development by means of the developing sleeve 7 M of the developing unit 17 M wherein magenta toner is loaded, then, the recharging by means of the charger 16, a succeeding flood exposure by means of the red light obtained from the light source 6 R and the red filter $F_R$ for the light source and the succeeding development by means of the developing sleeve 7C of the developing unit 17C wherein cyan toner is loaded are performed for forming multi-color images on the photoreceptor drum. The multi-color toner images thus obtained are transferred by the transferring electrode 9 onto the copy paper 8 which is fed by the paper-feeding means that is not shown in the figure. Incidentally, 21 is an electrode for pre-charging before transferring and 22 is a lamp for pre-exposure before transferring. The copy paper 8 carrying the multi-color toner images transferred is separated from the photoreceptor drum 41 by the separation electrode 10 and then fixed by the fixing unit 13 and delivered out of the apparatus as a finished multi-color copy. On the other hand, the photoreceptor drum 41 from which the image has been transferred is neutralized by the neutrailizing electrode 11 while being irradiated, when necessary, by the neutralizing light and thereby the residual toner on the surface thereof is removed by the cleaning blade 12, thus the photoreceptor drum is used again.

In the aforesaid image-forming process, any of mono-component developer employing non-magnetic toner and magnetic toner and two-component developer wherein toner and magnetic carrier like iron powder are mixed may be used as a developer. In the development, though it may be possible to use a method wherein a magnetic brush rubs directrly but it is essential at least in the second development and thereafter to employ the non-contact developing method wherein the developer layer on the developing sleeve does not rub the photoreceptor surface, in order to avoid the damage of the toner images formed. In the non-contact developing method, mono-component or two-component developer contaning non-magnetic toner whose color can freely be selected or magnetic toner is used, an alternating electric field is formed at the developing area and thereby the development is done without rubbing between the electrostatic image-carrier (photoreceptor) and the developer layer. This will be explained in detail as follows.

In the aforesaid repeating development, it is possible to repeat the development several times on the photoreceptor having the toner images formed thereon but there aare promblems that the toner images formed on the photoreceptor in the preceding stage are disturbed in the development in the succeeding stage, or toners adhered on the photoreceptor return to the developing sleeve which is a developer-conveyor and further enter the developing unit in succeeding stage which contains a developer whose color is different from that of the developer in the preceding stage, thus color-mixing takes place, if optimum developing conditions are not set. From the aforesaid viewpoint, it has become clear that there exist image-forming conditions for the recording having the preferable density, no disturbance of images and no color-mixing in the use of mono-component developer or two-component developer for the process employing mono-component developer and for the process employing two-component developer. Aforesaid developing conditions essentially mean that the developer layer on the developing sleeve does not basically contact the photoreceptor for the operation. For this purpose, the distance between the image-carrier and the developing sleeve needs to be kept larger than the thickness of the developer layer on the developing sleeve (provided, however, that there is no potential difference between both).

In the process for forming the latent image on the image-carrier and in the developing process where plural toner images are formed on the image-carrier after developing aforesaid latent images with mono-component toner, the preferable conditions are to satisfy the following relation just like the aforesaid example, $$0.2 \leqq V_{AC}/(d.f) \leqq 1.6$$

where, the amplitude of alternating component of the developing bias is $V_{AC}$ (V), the frequency is f(Hz) and the distance between aforesaid image-carrier and the developer-conveyor that conveys developer is d(mm).

Further, in the process for forming the latent image on the image-carrier and in each developing process in the imageforming method wherein aforesaid latent image is developed by the use of developer consisting of plural components and thereby plural toner images are formed on aforesaid imagecarrier, it is preferable to satisfy the following relation, $$0.2 \leqq V_{AC}/(d.f)$$

$$\{(V_{AC}/d)-1500\}/f \leqq 1.0$$

where, the amplitude of alternating component is $V_{AC}$(V), the frequency is f(Hz) and the distance between aforesaid image-carrier and the developer-conveyor that conveys developer is d(mm).

The developing conditions are the same as those in the non-contact developing shown in aforesaid example, the detail of which will be omitted here.

Next, the concrete example performed under the abovementioned constitution will be explained referring to the developing unit that is the same as that shown in FIG. 19 and FIG. 11.

The recording apparatus shown in FIG. 19 was used. However, the image-carrier 41 consists of the CdS-photosensitive layer that has a thickness of 40 μm and is sensitized for the long wavelength and of the insulating layer that is arranged on the photosensitive layer and consists of filters whose thickness is 30 μm, structure is that shown in FIG. 10 (*a*) and FIG. 11 (*c*) and size is 300 μm×300 μm, and the peripheral speed of the image-carrier was 180 mm/sec. The image-carrier 41, while being given a uniform exposure by the lamp 4A of the primary charger 4, was charged by D.C. Corotron corona discharger 4 so that the surface potential of the image-carrier 41 might show +2000 V. Next, the image-carrier, while being given an image-exposure, was charged by the secondary charger 5 consisting of Scorotron corona discharger having alternating component so that the surface potential of the image-carrier 41 might show −50 V. When the image-exposure was given, infrared rays and ultraviolet rays were cut by the filter in advance.

Next, the electrostatic image having the contrast of −50 V—300 V was formed owing to a uniform exposure given through the blue filter. This potential contrast was about one-third of that in an occasion of a transparent insulating layer. The elctrostatic image thus formed was developed by the developing unit 17Y shown in FIG. 11.

In the developing unit 17Y, the developer consisting of carrier wherein magnetite is dispersively contained in the resins at the rate of 50% by weight and an average particle size is 30 μm, magnetization is 30 emu/g and a specific resistance is $10^{14}\Omega$cm or more and of non-magnetic toner wherein 10 weight part of benzidine derivatives, as yellow pigment, and other charge-controlling agent were added to styleneacrylic resin and an average particle size is 10 μm, was used under the condition that the ratio of toner to carrier was 20% by weight. Further, the outside diameter of the developing sleeve 7 was 30 mm, its number of revolutions was 100 r.p.m., the magnetic flux density of N and S magnetic poles of magnetic body 43 was 900 gauss, the number of revolutions was 1000 r.p.m., the thickness of the developer layer at the developing area was 0.7 mm and the distance between the developing sleeve 7 and the image-carrier 41 was 0.1 mm and the development was a non-contact developing method wherein a superposed voltage (the amplitude of a sine wave is $\sqrt{2}\times 2000$ V) of D.C. voltage of +50 V and A.C. voltage of 2.5 KHz, 2000 V (example) was applied on the developing sleeve 7.

Incidentally, while the latent image was being developed by the developing unit 17Y, other developing units 17M and 17C as shown in FIG. 19 were kept under the condition wherein no development was made. This is achieved by separating the developing sleeves from the power sources 45 and 46 and causing the developing sleeves to be in floating status, or by connecting them to the grofund, or by positively applying on the developing sleeve the D.C. bias voltage having the same polarity (namely, opposite polarity against toner charging) as that of the latent image and among them, it is preferable to apply the D.C. bias voltage. Further, the developing unit was not driven during the non-developing time. Since the developing units 17M and 17C are to operate under the condition of non-contact developing that is identical to the developing unit 17Y, it is not necessary to remove the developer layer on the developing sleeve. In the developing unit 17M, the developer with the construction wherein the toner in the developer for the developing unit 17Y was changed to the toner containing polytungstophosphoric acid as magenta pigment in stead of yellow pigment, was used and in the developing unit 17C, the developer with the construction wherein the toner was changed likewise to the toner containing copper phthalo cyanine derivatives as cyan pigment, was used. It is naturally possible to use the toner containing other pigment or dye as a color toner and the sequence of colors for the development may properly determined so that the clear color images can be obtained. Especially, the order of colors for the development is related to the clearness of color images and to the potential contrast obtained and therefore it is necessary to determine it carefully.

The surface of the image-carrier 41 developed by the developing unit 17Y was re-charged by the Scorotron corona charger so that the surface potential might show −60 V and then the uniform exposure through the green filter was given to the surface of the image-carrier. The potential of the latent image thus ontained was +300 V against the background portion of −60 V. Aforesaid electrostatic image was developed by the developing unit 17M under the same condition as that in the developing unit 17Y except that the voltage (example) with D.C. component +50 V and with A.C. component 2.5 KHz, 2000 V was applied on the developing sleeve.

Likewise, the uniform exposure through the red filter was given after re-charging was given by Scorotron charger so that the surface potential might show −70 V. Through the foregoing, the electrostatic image having +250 V against the background of −70 V was formed and this electrostatic image was developed by the developing unit 17C under the same condition as that in the developing unit 17Y except that the voltage having the D.C. component +20 V and the A.C. component 2.5 KHz, 2000 V was applied on the developing sleeve.

At the stage where the tertiary development was over and 3-color images was formed on the image-carrier 41, the corona discharger 21 and the lamp 22 for pre-exposure before trasferring were operated and thereby the color images were caused to be in the status for easy transferring, then were transferred by the transferring unit 9 onto the copy paper 8 which was separated by the separating unit 10 and was fixed by the heat roller fixing unit.

The image-carrier 41 from which the color images had been transferred was neutralized by the neutralizing unit 11 while being irradiated by the white light and then the cleaning blade of the cleaning unit 12 removed the residual toner from the surface of the image-carrier, thus one cycle of color-image-recording process was completed when the surface on which color-images were formed has passed the cleaning unit 12.

The color-images recorded through the aforesaid process had no color-mixing naturally on the portion where each color toner is adhered densely and thus they showed their clearness.

Figure 20:
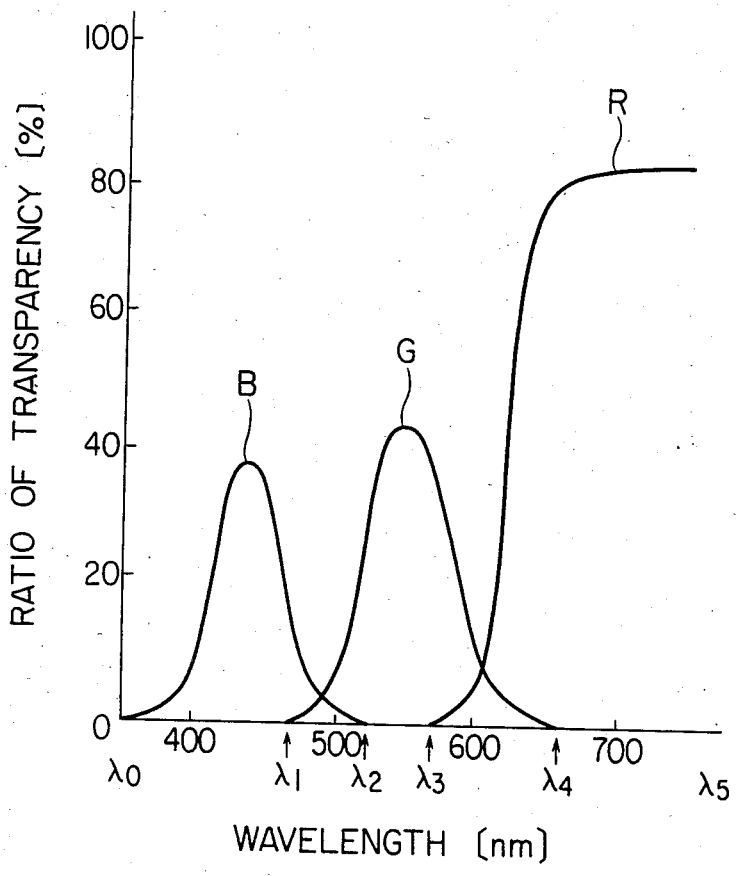
FIG. 20 illustrates the spectral percentage transmission curves of the color-filters, B, G and R, provided onto a photoreceptor, which are used in a further example of the invention.

A still further example of the invention will now be described below:

In this example, there is used a photoreceptor having the mosaic filters such as shown in FIGS. 1 and 2, and particularly the respective spectral filters as shown in FIG. 20.

FIG. 20 illustrates an example of the spectral percent transmission curve of each filter, wherein λ0, λ1 and λ3 are the toe portions on the short wavelength sides of the transmission wavelengths of the blue green and red filters each and λ2, λ4 and λ5 are the toe portions on the long wavelength sides of each of the filters.

Next, the process of forming a multi-color image in the method of the invention will now be described.

Figure 21:
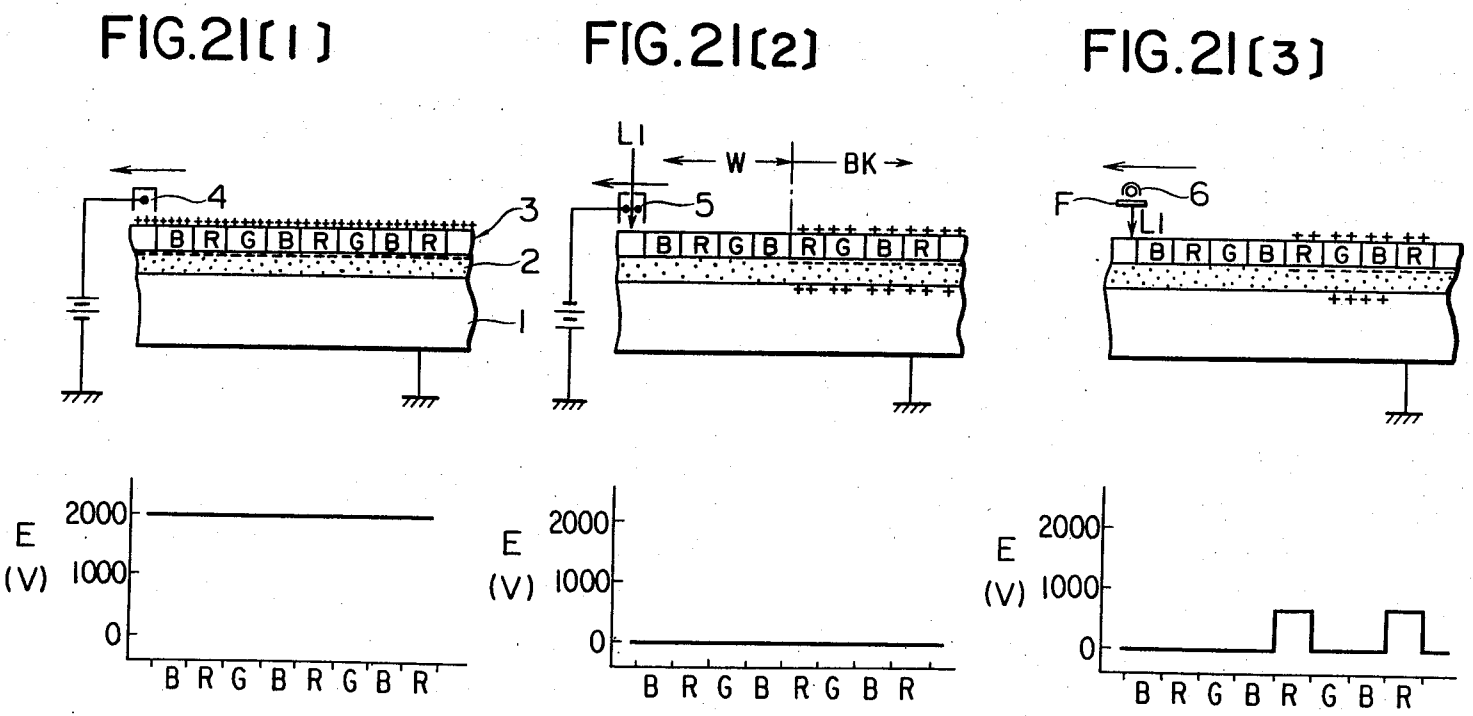
FIGS. 21[1] through 21[5] are the illustrative diagrams showing the respective processes in an example of the methods of the invention.
Figure 21:
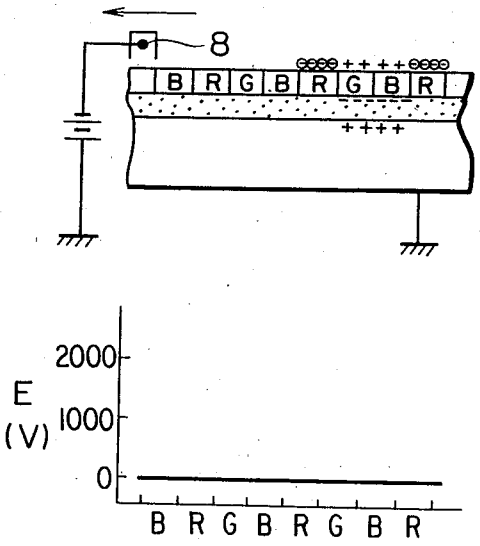
Figure 21:
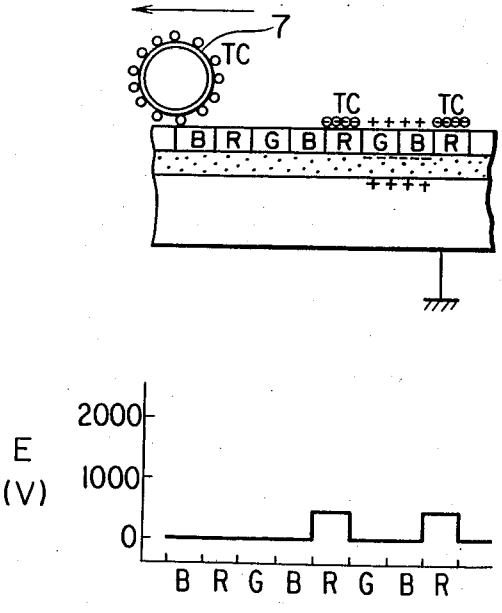

FIG. 21 illustrates an image forming process in which a photoreceptor using an n-type semiconductor such as cadmium sulfide to serve as the photoconductive layer thereof is used and a portion thereof is taken out to form an image therein. In the drawing, reference numerals 1 and 2 represent the electroconductive members and the photoconductive layers similar to those shown in FIG. 1; and 3 represents an insulating layer containing a group of three-color-separation filters. The graphs exhibited underneath the drawings indicate the potentials of various surface portions of the photoreceptor.

Firstly, when a positive corona-charge is applied over to the whole surface of the photoreceptor by making use of a charging electrode 4, a positive potential is generated on the surface of the insulating layer 3 and, corresponding thereto, a negative potential is induced on the boundary surface between the photoconductive layer 2 and the insulating layer 3, and the state will become as shown in FIG. 2.

Next. while an A.C. or negative discharge is being given by making use of a charging electrode 5 having an exposure-slit, an imagewise exposure is given. In the drawing. W is a white colored image portion, and BK is a black image.

FIG. 21 illustrates a state where an imagewise exposure was completed. In the white-colored image portions, the imagewise exposure light passes through each of the filters and then makes electroconductive the photoconductive layer 3 underneath the filters, therefore, the charge having remained in the photoconductive layer 2 is eliminated. To the contary, in the black image portions, each of the filter portions is not hit with any light, therefore, the negative charge in the photoconductive layer 2 will remain as it is. A positive charge is distributed, by the functions of charger 5, onto the both sides of insulating layer 3 and electroconductive member 1 so as to make uniform the surface potential of the photoreceptor.

Such a state as shown in FIG. 2[2] is hereinafter called the primary latent image. There will become the same potential on the surface of the photoreceptor including not only the white-colored image portions where the charge is eliminated, but also in the black image portions where the charge still remains as it is, therefore, such a primary latent image does not function as an electrostatic image. Then, a flood-exposure is given with a light capable of passing through only the specific filters.

FIG. 21[3] illustrates a case that a flood-exposure is made by making use of a light $L_1$ provided with a light-source 6 capable of passing through only the R filter portions and filter F. Light $L_1$ is capable of passing through only the R-filter portions to make a photoconductive layer underneath the R-filter portions electroconductive. Consequently, the potential of the photoreceptor is varied in an area where a charge is present in photoconductive layer 2 and is not varied in an area where no charge is present. Thus, a potential pattern is formed on the surface of the R-filter portions, and in the other filter portions a primary latent image is kept to remain as it is.

Such a state as shown in FIGS. 21[3] is hereinafter called the secondary latent image. When developing such secondary latent image by making use of a developing device 7 filled in with cyan toners, TC, a cyan-toner image is formed in the R-filter portions. (Refer to FIG. 21[4])

Next, the potentials on the surface of the photoreceptor are uniformed by an A.C. discharge through electrode 8. (refer to FIG. 21[5]). This uniformation of the potentials may also be made by a negative discharge with a scolotron discharger. Then, a flood-exposure is made by making use of the second Light $L_2$ such as a light capable of passing through the G filters and unable of passing through the R filters, so that the secondary latent image may be formed on the G filter portions in the same manner. The resulting secondary latent image is developed with magenta toners. In addition, after uniforming the potentials of the surface of the photoreceptor, a flood-exposure is made by making use of a light capable of passing through the B filter portions to serve as the third light $L_3$, so that the secondary latent image may be formed on the B filter portions and developed with yellow toners. Consequently, a three-colored image comprising cyan, magenta and yellow toners is formed on insulating layer 2. According to the example shown in FIG. 21, toners in three colors adhere in a mosaic form to the black image areas indicated by BK in the drawing to reproduce a black image made in a additive color process, and any toner does not adhere to the W areas so as to be in blank if the W areas are transferred to a sheet of paper or the like. Although the colored areas of an original document are not shown in the drawing, the density of a toner image formed in the B, G and R color-filter portions is varied according to the colors of the original document, therefore it needless to say that a colored image may be reproduced in an additive color process. For example, in the red color areas, there is eliminated the charge remaining in the mosaic filters of the R filter portions of a photoconductive layer by an imagewise exposure, i.e., in a process shown in FIG. 21[2], and the primary latent image is formed in both of the B filter portions and the G filter portions. Therefore, even if a flood-exposure is made with light $L_1$ capable of passing through only the R filter portions, i.e., in a process shown in FIG. 21[3], the secondary latent image is not formed, and any cyan toner does not adhere even after making a development. When making a flood-exposure with light $L_2$, the secondary latent image is formed in the G filter portions, and magenta toners adhere thereto through a development, and further, a flood-exposure is made with light $L_3$, thereby the secondary latent image is formed in the B filter portions and yellow toners adhere thereto, so that a red image comprising magenta and yellow toners may be reproduced.

As is obvious from the above description, the key point of the method of the invention is that the secondary latent images are to be formed in order in every color filter portion by making the flood-exposures with a light having a specific spectral distribution after an imagewise exposure. It is, therefore, necessary to suitably select the spectral component of a light to be used for a flood-exposure so that a secondary latent image may be formed on the desired filter portions and only the primary latent images are changed into the secondary latent images so as not to affect the primary latent images in the other filter portions. To be more simple to do so, it will be good enough to use a light emitted from such a wavelength component as is capable of passing through each of the color-separation filters only, that is to say, it will be good enough to use a light such as those from λ3 to λ5 shown in FIG. 20 for visualizing the latent images formed in the R-filter portions, those from λ1 to λ4 for visualizing the latent images formed in the G-filter portions, and those from λ0 to λ2 for visualizing the latent images formed in the B-filter portions, respectively.

A light to be used for the first flood-exposure is essential to comprise only a wavelength capable of passing through either one kind of filter ($F_1$) of three-color separation filters, however, in the second flood-exposure, it is allowed to contain, besides the wavelength capable of passing through the secondary filter ($F_2$) to be subjected through the flood-exposure, the wavelength component which has already served to form an image and is capable of passing through the primary filter ($F_1$), provided that it is not allowed to contain any component capable of passing through the remained tertiary filter $F_3$. Light $L_3$ for making the third flood-exposure, that is the final one, is free from any other restrictions, provided that it contains a wavelength capable of passing through the tertiary filter ($F_3$), and it is most desired to use white light for practical use, because it may easily be obtained.

Figure 22:
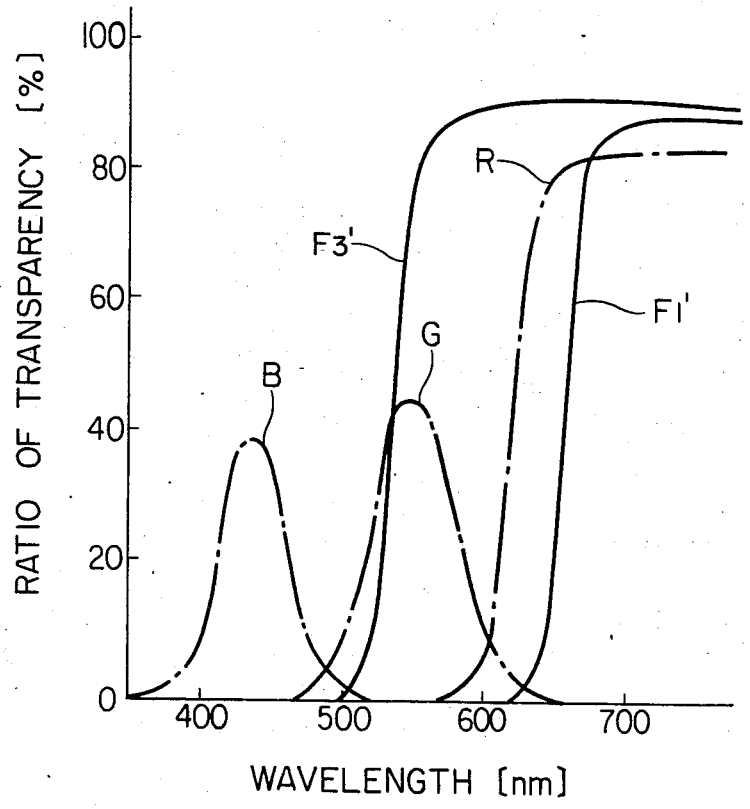
FIGS. 22 and 23 illustrate the two examples of the color filter distribution on a photoreceptor and the spectral percent transmission of the filters for flood-exposure use

To be more concrete, a desired multi-color image may be obtained in such a manner, for example, that a flood-exposure is made at first to the three kinds of filters shown in FIG. 20 by red light to serve as $L_1$ comprising a long wavelength component not shorter than the wavelength λ3, so as to form a secondary latent image in the R-filter portion and the resulting latent image is cyan-developed; next, the second flood-exposure is made by a yellow light to serve as $L_2$comprising a wavelength component not shorter than λ1 capable of assing through both of the filter $F_2$ and the filter $F_1$, so as to form a secondary latent image in the G-filter portion and the resulting latent image is magenta-developed; and further, a flood-exposure is made by a white light to form the secondary latent image in the B-filter portion, and the resulting latent image is developed with yellow toners. FIG. 22 illustrates the relation of the above-mentioned case between the flood-exposure light spectral distributions $L_1$, $L_2$, $L_3$ and the spectral percent transmission of the three-color separation filters B, G and R. The order of forming such color images and the components of the light to be used thereto shall not be limited to the abovegiven example, but any order and any components may be allowed to use provided that they can satisfy the above-mentioned conditions. The preferable examples thereof are shown in Table 3 below:

TABLE 3

| Example | Image forming order | 1 | 2 | 3 |
|---|---|---|---|---|
| I | Flood-exposure wavelength region | > λ3 | > 1 | λ0~λ5 |
| | (Color of light) | (Red) | (Yellow) | (White) |
| | Developing toner | Cyan | Magenta | Yellow |
| II | Flood-exposure wavelength region | < λ2 | > λ3 | λ0~λ5 |
| | (Color of light) | (Blue) | (Red) | (White) |
| | Developing toner | Yellow | Cyan | Magenta |
| III | Flood-exposure wavelength region | < λ2 | < λ4 | λ0~λ |
| | (Color of light) | (Blue) | (Bluish green) | (White) |
| | Developing toner | Yellow | Magenta | Cyan |

The preferable food-exposure ligfht sources include, for examples, such a white light source as a tungsten lamp, a fluorescent lamp and the like to be used as it is or thereto attached with a filter capable of transmitting a light having a desired wavelength. When attaching a filter to a filter-exposure light source, it is advantageous to use a red or yellow filter capable of readily displaying such filter characteristics as the sharp rising of the spectral distribution curve and a high percent transmission. It is, therefore, most preferred for practical use to take such an image formation process as shown in Table 3.

In the case that the spectral sensitivity of a photoconductive layer covers the outside of the visible region. an ultraviolet or infrared region, an ultraviolet light or an infrared light may be used for flood-exposures.

In the case that the quantity of a flood-exposure light $L_1$ (or $L_2$) is insufficient to reach a photoconductive layer. there may be some instances where the charge of the photoconductive layer may not completely be eliminated. In this instance, the remaining charge is eliminated in the successive flood-exposure process and the surface potential in the areas at issue is accordingly varied to make toners adhere thereto, so that there may be a possibility of producing a color turbidity. In order to prevent the color turbidity, it is desired to irradiate a light to the photoconductive layer before the next flood-exposure is made, so as to eliminate the charge remaining in the photoconductive layer. It is also desired that the light has the spectral characteristics which are the same as or similar to those of the flood-exposure light $L_1$ (or $L_2$). It is further preferred to make this exposure at the same time when the surface potentials of a photoreceptor are uniformed by charger 8.

The developers capable of being used in this example include, for example, the so-called single-component type developers using magnetic toners, and the so-called two-component type developers prepared by mixing toners with such a magnetic carrier as iron powder or the like.

In this example, similar to the already described previous example, it is also possible to use the non-contact developing methods and to adopt the preferable superposing conditions.

The methods of the invention will now be described in detail with reference to the following examples. Example The method of this example was applied to a copying machine constructed similarly to the structure afore shown in FIG. 10, provided that a cyan-developing developer 7C is provided to the position where the developer 7Y was provided and to the contrary developer 7Y is provided to the position where the developer 7C was provided, and that the filter $F_5$ for light source 63 is not provided, and further that each of the filters $F_1$, $F_2$, $F_3$ and $F_4$ is not the same in their characteristics.

In this example, the reference numeral 41 is a photoreceptor drum having a structure shown in FIG. 1(*b*) which is provided on the drum-shaped metallic base member with a cadmium sulfide photoconductive layer having a sensitivity covering extensively over the whole visible light area and an insulating layer containing mosaic-formed B, G and R three-color separation filters. FIG. 20 shows the spectral percent transmissions of the B, G and R filters each being contained in the insulating layer provided on the surface of the photoreceptor drum 41, and the transmission wavelength region of each filter is as follows:

| | | |
|---|---|---|
| B | $\lambda 0 < 360$ nm | $\lambda 2 = 530$ nm |
| G | $\lambda 1 = 460$ nm | $\lambda 4 = 650$ nm |
| R | $\lambda 3 = 570$ nm | $\lambda 5 > 750$ nm |

In a copying operation, photoreceptor drum 41 is positively charged over to the whole surface thereof from charging electrode 4, while the photoreceptor drum 41 is being rotated in the direction of the arrow; and the photoreceptor drum 41 is then exposed original-imagewise from an original document scanned by an optical system for exposure (comprising the mirrors $M_1$ through $M_4$, a lens, a lamp 60 and the like), while it is being negatively charged (or, charged by an A.C.) from the electrode 5 having a slit for the next exposure; and thus the primary latent image is formed on the surface of the photoreceptor drum 41.

In succession, a flood-exposure is made by a light $L_1$ which passed through a filter $F_1'$ (hereinafter $F_1'$, $F_2'$, $F_3'$, and $F_4'$ are respectively referred to as the filters provided to the positions of the filters $F_1$, $F_2$, $F_3$ and $F_4$ indicated in the example illustrated in FIG. 10.). The spectral distribution of light $L_1$ is as shown in FIG. 22, and the component thereof is not less than 630 nm and passes through only R-filter portions, but does not include any component capable of passing through B- and G-filter portions. The primary latent image registered on the R-filter portions on the photoreceptor drum 41 is converted into an electrostatic image (i.e., a secondary latent image) by the flood-exposure, and the resulting electrostatic latent image is developed by the developer 7C loaded with a developer containing cyan toners so as to form a cyan image, however, the primary latent image registered on the G- and B-filter portions will not be varied.

The photoreceptor drum 4I whereby the cyan-development was completed is irradiated by a light which passed through filter $F_2''$ from the light source 62 to uniform the potentials of the surface thereof and at the same time to eliminate the charge of the photoconductive layer positioned underneath of the R-filter portions, while receiving a negative discharge from electrode 81. Filter $F_2'$ has the same spectral percent transmission as that of the Filter $F_1'$. After then, a flood-exposure is made by a light $L_2$ which passed through filter $F_3'$ from light source 62. The spectral characteristics of the light $L_2$ are as shown in FIG. 22. The light $L_2$ is a yellow light capable of passing through a light of not less than 520 nm, that is able to pass through the G- and R-filter portions on the photoreceptor drum 41, but does not contain any component capable of passing through the B-filter portion. Accordingly, the primary latent image registered in the G- filter portion on the photoreceptor drum 41 is converted into the electrostatic image. The resulting electrostatic image is developed by a developer 7M loaded with a developer containing magenta toners and the previously formed cyan image is superposed thereonto; and thus, a magenta image is formed.

Further. the photoreceptor drum 41 is irradiated by a light which passed from light source 63 through filter $F_4'$ having the same spectral transmission characteristics as that of filter $F_3'$ while the photoreceptor drum 41 is being negatively discharged by electrode 82, and resultantly, the potentials on the surface thereof are uniformed and the charge on the photoconductive layer underneath the G-filter portion is eliminated.

Next, the photoreceptor drum 41 is flood-exposed to white light emitted from light source 63, and the primary latent image registered in the B-filter portion is converted into the electrostatic image. The resulting electrostatic image is developed by developer 7Y loaded with a developer containing yellow toners, and the cyan toner image and the magenta toner image which were previously formed are superposed thereonto to form a yellow toner image, and thus a full-color image is completely reproduced.

The resulting full-color image is again charged with a charging electrode 21 and then electrostatically transferred onto transfer paper 8 having been fed by paper feed device 14. The transfer paper 8 is thermally fixed by fixing device to become a finished copied matter so as to be delivered to the outside of the copying machine. In the drawing, numeral 9 is a transfer electrode for transferring a toner image; and 10 is a separation electrode for separating a transfer paper from the surface of a photoreceptor drum.

The photoreceptor drum 41 which has finished to transfer is electrically neutralized under an irradiation of light by a neutralizing electrode (not shown) provided with a light source and the toners remaining on the surface of the photoreceptor drum are removed by a cleaning means 12. After then, the photoreceptor drum 41 is ready to re-use.

In the example, the parameters of the developments and others were as shown in Table 4. And, a halogen lamp was used for the light source for each exposure.

TABLE 4

| | |
|---|---|
| Photoreceptor: | Photoconductive layer:<br>CdS, Layer thickness = 30 μm<br>Insulating layerΔ<br>Layer thickness = 20 μm<br>Filter: Mosaic-formed, l = 200 μm<br>{See FIG. 1(b)}<br>Diameter of the drum: 180 mm<br>Line speed: 200 mm/sec. |
| Developing unit: | Sleeve: Non-magnetic stainless steel,<br>Diameter = 30 mm<br>Rev. speed: Line speed =<br>150 mm/sec.<br>Magnet roll: Number of poles = 8<br>Magnetic flux density = 800 G max.<br>(on the surface)<br>Rev. speed = 300 r.p.m. |
| Gap between photo-receptor and sleeve: | 0.75 mm |
| Developer (Yellow, Cyan and Magenta, in common): | Two-component type<br><br>Toner: Average diameter = 10 μm<br>Charged volume = −10 to −20 μc/g<br>Carrier: Magnetic substance + resin dispersed type<br>Average diameter = 25 μm<br>Resistivity = $10^{13}$Ω.cm or more<br>Proportion of toner +<br>carrier mixture: 1:4 |
| At the time of applying non-bias to a developing area, Thickness of developing layer: | 0.4 mm |
| Developing bias: | DC: −100 V<br>AC: −2 KHz, 1.0 KV (at the effective value) |
| Charging conditions: | Initial charging potential = 1.5 kV<br>(By Colotron)<br>Potential of simultaneous charging with an imagewise exposure = −200 V<br>(By Scolotron)<br>Dischaging potential for uniforming charges = The same as above |

When the copying tests of multi-color images were tried according to the above-mentioned conditions, the copied images in which no color-turbidity was produced and the color-reproducibility were excellent were resultantly obtained.

Figure 23:
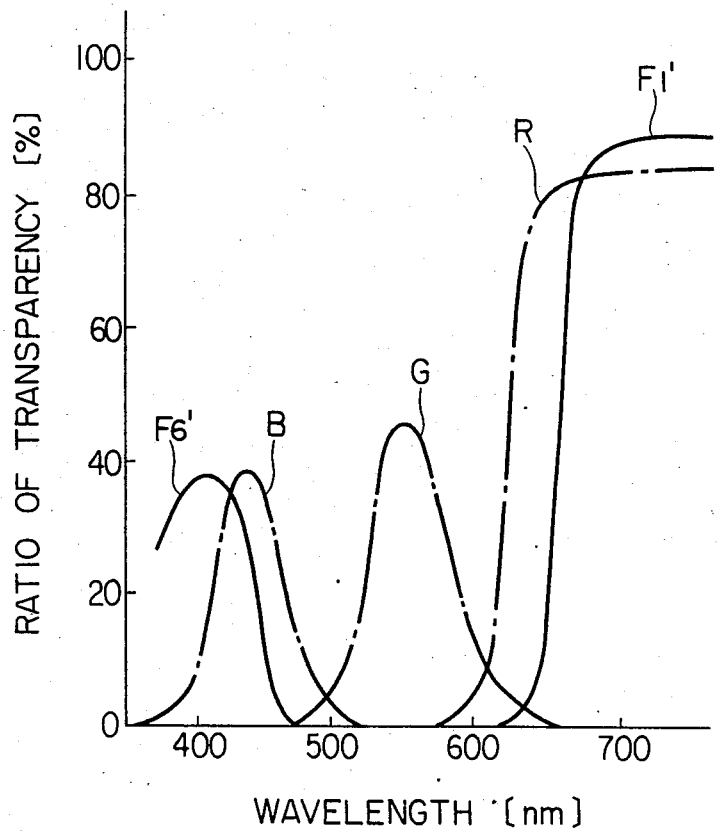
Figure 24A:
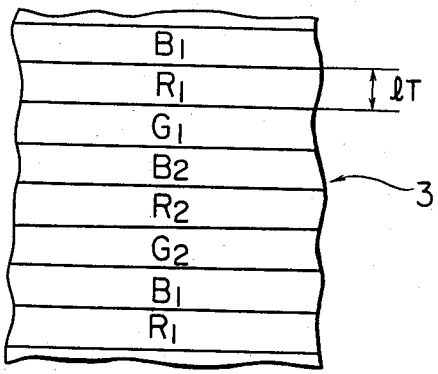
FIGS. 24 and 25 illustrate the other examples of the photoreceptors capable of being used in the invention as still further examples of the invention; and among the drawings, FIGS. 24(*a*) through 24(*e*) show the horizontal arrangements of the color filters, and FIG. 25(*a*) through 25(*d*) show the layer arrangements, respectively.
Figure 24B:
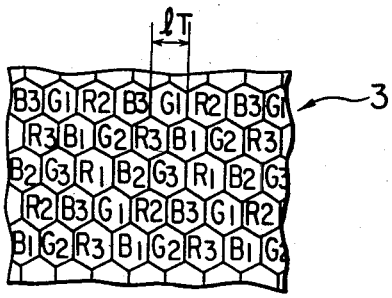
Figure 24C:
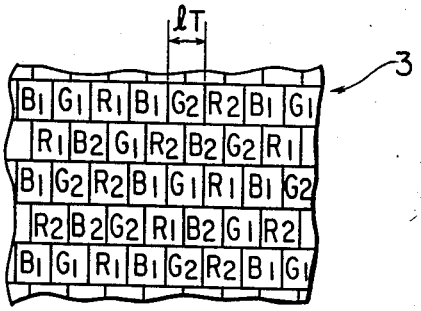
Figure 24D:
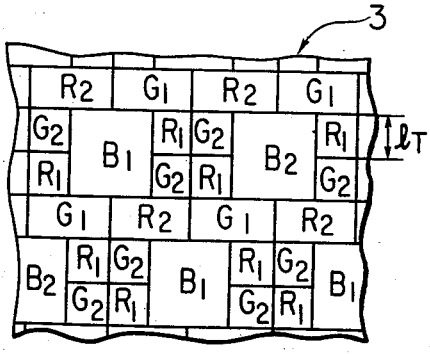
Figure 24E:
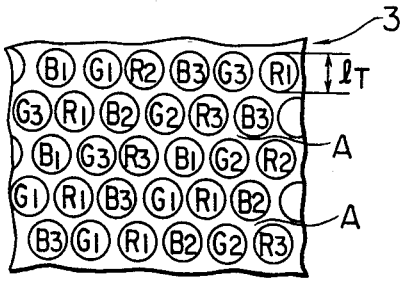
Figure 25A:
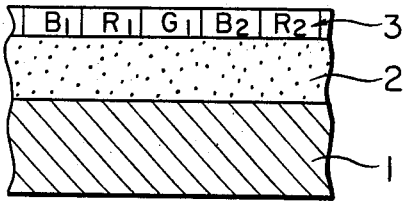
Figure 25B:
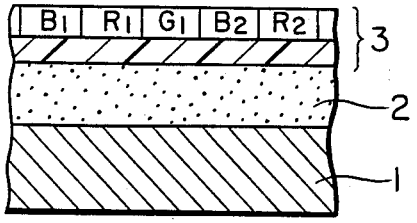
Figure 25C:
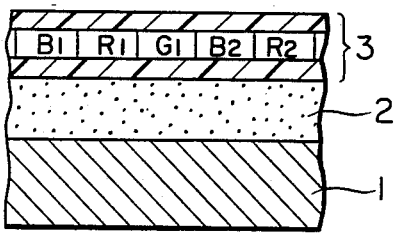
Figure 25D:
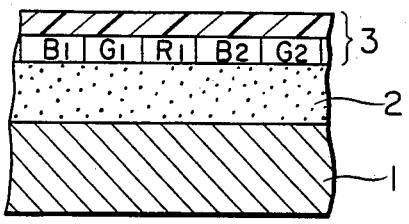

EXAMPLE The filters $F_1'$, $F_2'$, $F_3'$ and $F_4'$ of the apparatus embodied in the above example were replaced by the filters, $F_6'$, $F_7'$, $F_1'$ and $F_2'$, respectively. Resultantly, each of the spectral distributions of the first flood-exposure light $L_1$ and the second flood-exposure light $L_2$ are as shown in FIG. 23.

The spectral transmission characteristics of the filters $F_6'$ and $F_7'$ are the same. The developing devices used were the same as those shown in FIG. 10, but the arrangement thereof were restored to be in the original order of 7Y, 7M and 7C, and the other conditions remained as they were in the previous example. When the copying tests of the multi-color images were tried, the excellent copy images similar to those obtained in the previous example were resulted.

In the specification, the methods of the invention are detailedly described according to the examples of the color copying machines in which the n-type photoconductive receptors are used. However, the methods of the invention can also be applied even when using such a p-type photoconductive receptor as those of a Se-Te type, an amorphous silicon type or the like, if a charging polarity is reversed. The application of the methods of the invention can widely cover, for example, a multi-color image recording apparatus, a color photographic printer and the like, as well as a color copying machines.

Another example of the present invention will be explained as follows. In the following explanation, a full-color-reproducing photoreceptor wherein red filters, green filters and blue filters each of which transmits only red light, green light and blue light only respectively are used as a color-separation filter, will be explained but the colors of filters and the colors of toners to be combined respectively with aforesaid colors of filters are not restricted to the foregoing.

Each illustration in FIG. 24 shows an example of the form and layout of a finely-divided color-separation filter. It is preferable that lr shown in the illustration is established greater than an average particle size of toner used for the development. When the size of a filter is too small, the filter tends be influenced by the neighboring other color portion and when the width of a filter is similar to or smaller than the size of a toner particle, it is difficult to fabricate the filter. On the other hand, if the filter size is too large, an image definition and color-mixing are deteriorated and thereby the image quality is deteriorated.

FIG. shows schematically the sectional view of the photoreceptor usable for the present invention. On the electroconductive member or on the substrate 1, there is provided a photoconductive layer 2 on which an insulating layer 3 containing necessary color-separation filters, that is many portions of red (R) filters, green (G) filters and blue (B) filters, for example, is stratified.

The conductive substrate 1 is allowed to be the one having an appropriate form and structure at need such as a cylindrical form or an endless belt form both made of metal such as aluminum, iron, nickel, copper and others or an alloy thereof.

The photoconductive layer 2 may be composed of a photoconductive substance of an alloy containing sulfur, selenium, amorphous silicon or sulfur, selenium, tellurium, arsenic, antimony and others or of inorganic photoconductive substance of an oxide, an iodide, a sulfide or a selenide of zinc, aluminum, antimony, bismuth, cadmium, molybdenum and others, or of the one wherein organic photoconductive substance such as vinylcarbazole, anthracene phthalocyanine, trinitrofluorenon, polyvinylcarbazole, polyvinyl anthracene, polyvinylpyrene or the like is dispersed in the insulating binder resin such as polyethylene, polyester, polypropyrene, polystyrene, polyvinyl chloride, polyvinyl acetate, polycarbonate acrylic resin, silicone resin, fluorocarbon resin, epoxy resin or the like.

The insulating layer 3 may be composed of a transparent insulating substance such as, for example, various types of polymers, resins or the like and colored portions acting as a color-separation filter are arranged on the surface or inside of the insulating layer. Aforesaid colored portion may be formed in a way wherein insulating substance colored by adding thereto a coloring agent such as a dye having a necessary color is sticked in a prescribed pattern on the photoconductive layer 2 through the means such as a printing or the like as shown in FIG. 25(*a*) or coloring agent is sticked in a prescribed pattern on the colorless insulating layer 3*a* formed uniformly in advance on the photoconductive layer 2 through the means of a printing, a vapor deposition or the like as shown in FIG. 25(*b*).

Further, it is possible to compose a photoreceptor having the structure of FIG. 25(*a*) or (*b*) also by attaching on the photoconductive layer the insulating substance in the form of a film wherein colored portion is formed in advance. Further, the surface of the colored portion formed is allowed to be further covered by the insulating substance 3 to be of the structure like FIG. 25(*c*), (*d*) and (*e*).

Figure 26:
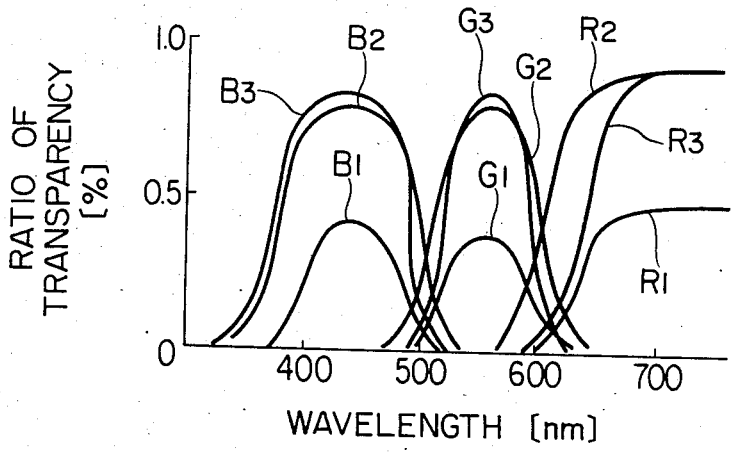
FIG. 26 illustrates an example of the spectral percent transmission distributions of the color filters shown in FIGS. 24 and 25.

Incidentally, FIG. 25(*a*)~(*c*) and FIG. 26(*a*)~(*e*) show the occasion wherein so-called color separation filters in red, green and blue are provided.

Aforesaid filter layer 3, according to the present invention, is composed of filter portions $R_1$, $R_2$, $R_3$, . . . , $G_1$, $G_2$, $G_3$, . . . , $B_1$, $B_2$, $B_3$, . . . , each of which has its spectral transmittance characteristic that differs each other as shown in FIG. 3.

To be concrete, FIG. 26 shows a photoreceptor having a filter layer consisting of plural kinds of color-separation filter portions which transmit mainly the light in different wavelength zones and the photoreceptor has a layer consisting of plural kinds of filter portions whose maximum light transmittance for transmitting mainly the light of the same color and/or the wavelength for maximum light transmission differs each other among aforesaid plural color-separation filter portions.

As the foregoing shows, the filter portion transmitting the light of a certain color has plural filters whose maximum light transmittances differ for example, and therefore, it is possible to moderate the edge effect when developing the finely-divided latent images and thus the color reproduction is achieved satisfactorily.

Besides, as the light transmittance of each color-separation filter portion is complicated in its regularity, there are produced less moires caused by the interference between the spatial frequency of the color-separation filter portion and that of the document.

In order to obtain such remarkable action and effect as the foregoing, it is preferable that the difference of the maximum light transmittance in filter portions transmitting the light in the same color among aforesaid filter portions $R_1$, $R_2$, $R_3$, . . . , $G_1$, $G_2$, $G_3$, . . . , $B_1$, $B_2$, $B_3$, . . . , namely the ratio of $B_1$ (smallest maximum light transmittance) to $B_2$ (greatest maximum light transmittance) for example in FIG. 26 is, $$\frac{\text{minimum value of maximum light transmittance}}{\text{maximum value of maximum light transmittance}} \times 100 = 20\sim80\% \text{ (e.g. 50\%)}$$

Besides the pattern shown in FIG. 24, various types of layout of filters are considered (incidentally, A in FIG. 24 represents a (total) visible-light-absorbing filter portion).

Incedentally, it is possible to control the maximum light transmittance and the wavelength for maximum light transmittance of aforesaid filter portions $R_1$, $R_2$, $R_3$, . . . and others by changing the kind of pigment or dye forming the filter or by changing the thickness of the filter portion.

Next, the process wherein aforesaid photoreceptor is used for forming multi-color images will be explained referring to FIG. 18 showing the constitution of the example explained previously. in FIG. 18, there is shown a part of a photoreceptor employing an n-type (namely, the type of a large electron-mobility) photosemiconductor such as cadmium sulfide as a photoconductive layer, wherein an image-forming process is schematically indicated but hatching for sectional view of each section is omitted. In the figure, 1 and 2 represent a conductive substrate and a photoconductive layer and 3 is an insulating layer containing color-separation filter portions R, G and B. In the present example, however, R, G and B filters whose light transmittances differ are used as shown in FIG. 24~FIG. 26 and therefore $R_1$, $G_1$, $B_1$ and $R_2$, $G_2$, $B_2$ are arranged one after the other but not illustrated in particular. However, the explanation will be made referring to FIG. 18. Further, the graph at the bottom of each diagram shows the potential on the surface of each portion of the photoreceptor.

First, if the positive corona discharge is given to the entire surface by the charger 4 as shown in FIG. 18[1], positive charges are produced on the surface of the insulating layer 3 and corresponding to this, negative charges are induced on the boundary surface between the photoconductive layer 2 and the insulating layer 3.

Next, alternating or negative discharge is given, as shown in FIG. 18[2], by the charges equipped with an exposure-slit and then an exposure by the colored image, the exposure $L_R$ by the red image of the document, for example, is given while uniformalizing the potential on the surface of the insulating layer 3.

Since the red light penetrates the red filter portion of the insulating layer 3 and causes the photoconductive layer 2 located underneath aforesaid red filter portion to be conductive, the charges in the photoconductive layer 2 are eliminated at the position of aforesaid filter portion. On the contrary, since the green filter portion 3G and the blue filter portion 3B do not transmit the red light, negative charges on the photoconductive layer 2 remain as they are. There naturally exists the difference of residual charges despite the same amount of irradiated light because the light transmittance differs between $G_1$ filter and $G_2$ filter or between $B_1$ filter and $B_2$ filter among 3G and 3B filters. Further, owing to the effect of the charger and others, the charge distribution on the insulating layer 3 changes so that the surface potential of the photoreceptor will be uniformalized. The primary latent image is formed in the aforesaid manner. Other areas irradiated by the light of green color component and blue color component of the document also give the same results to each filter portion. The primary latent image is a status wherein each of the components of all colors is existing underneath each filter portion as a charge distribution in the form of an image. In the stage, the area where charges remain as well as the area where charges on the photoconductive layer 2 have been eliminated are in the same potential on the surface of the photoreceptor and therefore they do not function as an electrostatic image.

Incidentally, FIG. 18[2] shows an occasion wherein the potential after charging is almost zero and this potential after charging is allowed to be negative.

Next, if a flood-exposure is given by the light penetrating one kind of filters contained in the insulating layer 3, for example by the blue light $L_B$ obtained from the light source 6B and the blue filter $F_B$, the photoconductive layer 2 underneath the filter B portion transmitting the blue light is caused to be conductive and a part of negative charges on the photoconductive layer 2 corresponding to aforesaid portion and the charges on the conductive substrate 1 are neutralized and only charges on the surface of the filter B remain, thereby the potential pattern is produced. No change is made on the portions of G and R which do not transmit the blue light. Therefore, charges remain only on ($B_1$, $B_2$) of the blue filter B and thereby the surface potential is produced. FIG. 26 showing the transmittance of the filter indicates that $E(B_2)$ [surface potential on filter $B_2$] is higher than $E(B_1)$ surface potential on filter $B_1$], which is not illustrated. This is a secondary latent image. If the charge image on the filter B is developed by the developer containing negatively-charged yellow toner TY, toner adheres only to the surface of the filter B portion where the potential is relatively high, thus the development is made. (FIG. 18[4]).

Next, if the flood-exposure is given by the green light $L_G$ as shown in FIG. 18[6] after uniformalizing the surface potential by the charger 15 as FIG. 18[5] shows for the purpose of eliminating the difference in potential produced, the secondary latent image is formed on the portion of green filter portion G like the occasion of flood-exposure by aforesaid blue light. Even in this case, the difference in surface potentials is produced based on $G_1$ and $G_2$, the difference of transmittance of the green filter G. When the secondary latent image mentioned above is developed by magenta toner TM as FIG. 18[7] shows, magenta toner TM adheres only to the portion of filter G. Then, as FIG. 18[8] shows, a flood-exposure by the red light is given after uniformalizing the surface potential in the same way and the secondary latent image thus appeared on the red filter portion R is developed by cyan toner TC. In the illustrated example, charges do not exist on the photoconductive layer 2 at the red filter portion R and therefore the potential difference is not produced despite the flood-exposure given, thereby no cyan toner adheres even if the development is done by the cyan toner.

If the toner images thus obtained are transferred to the transferring member such as a copy paper or the like and then fixed, the red color images caused by the mixing of color of yellow toner and magenta toner are reproduced on the transferring member.

For other colors, the color reproduction caused by the combination of a color-separation method and three-primary-color toner is made as above-mentioned Table 1 shows.

Incidentally, above explanation refers to the example wherein a layer of n-type photo-semiconductor is used but it is naturally possible to use a layer of p-type photo-semiconductor such as selenium or the like, namely the photo-semiconductor having a large Hall mobility and in this case, the positive and negative signs for charges are all opposite but the basic processes are all the same. Incidentally, when it is difficult to inject charges for the primary charging, the uniform irradiation by means of the light may jointly be employed.

As obvious from aforesaid explanation, the photoreceptor for use in forming multi-color images is given an image-exposure while being charged and after that a process wherein a flood-exposure is given to the photoreceptor by the light penetrating one kind of plural kinds of filters and then the development is made is repeated according to the kinds of aforesaid filters, in the present example.

Namely, fine color-separation filters are arranged on the photoreceptor to which an image-exposure (a step of FIG. 18[2]) is given. After that, a flood-exposure by means of the light from the color-separation (a step of FIG. 43[3] and 6[6]) is given to the photoreceptor, the secondary latent image is formed for each color portion of color-separation filters and then aforesaid secondary latent image is developed (a step of FIG. 18[4] and [7]) by the use of the color corresponding to aforesaid secondary latent image and the repetition of aforesaid steps provides multi-color images. In this process, therefore, the photoreceptor wherein plural color-separation filters are arranged in a fine line pattern or in a mosaic pattern on the photoconductive layer having the photosensitivity covering the entire zone of visible light, is used and the entire surface of the photoreceptor is given an image-exposure and thereby the primary latent image corresponding to the separation image density is formed on the photosensitive layer underneath each filter and then the secondary image corresponding to the primary image is formed on the first color-separation filter portion owing to a flood-exposure by the light penetrating the first color-separation filter. Then, the secondary image is developed by the color toner whose color correspond to the color of the filter or preferably is in a relation of complimentary color for the color penetrating the filter, and the foregoing is repeated for each color-separation image, thereby the multi-color images are formed on the photoreceptor and thus it is possible to record at a stroke the multi-color images on the transferring member through a single transferring.

FIG. 19 previously shown is used as an example of the outline of an image-forming section of the color copying machine suitable for the working of aforesaid process. In FIG. 19, 41 is a photoreceptor drum having the structure shown in FIG. 24 and it rotates in the direction of an arrow during the course of copying operation. An operation cycle in this case advances in the same manner as the operation cycle explained in FIG. 19. Each of developing units on the other hand, employs each of structures shown in FIGS. 6, 7 and 11 respectively.

On the other hand, when a monochromatic image is to be formed on the present apparatus, the process up to the step for forming the primary latent image is the same as that for the multi-image-forming but after that, uniform exposures are given to the photoreceptor by the light sources 6B, 6G and 6R and then the development is made by the developer I7K loaded with black toner which will be mounted, for example, at the downstream side of the developing unit 7C for cyan toner relating to the rotational direction of the photoreceptor 41.

In the aforesaid image-forming process, it is possible to use either of single component developer wherein non-magnetic toner or magnetic toner is used or two-component developer wherein toner and magnetic carrier like iron powder are mixed, as a developer to be used. For the development, a method wherein a magnetic brush rubs directly may be used but it is essential to use a non-contact developing method wherein the developer layer on the developer-transport-member does not rub the photoreceptor surface, in at least the second development and thereafter, in particular, in order to avoid the damage of the toner image formed. The non-contact developing method mentioned above may be performed in accordance with the preferable conditions for developing shown in the example described above. Likewise, in order to develop the following toner images on the photoreceptor drum 41 at constant density successively without damaging the toner images formed on the photoreceptor drum 41, it is more preferable to use the following methods independently or in combination thereof:

(1) to charge gradually the toner to be used to the one having greater charge amount as the development is repeated (2) to reduce gradually the amplitude of insulating component of the developing bias as the development is repeated (3) to enhance gradually the frequency of insulating component of the developing bias as the development is repeated.

Namely, the greater the charge amount of toner particles is, the greater the influence of electric field is. Therefore, if the toner particles having a large charge amount dhere to the photoreceptor drum 41 in the early development. there is a chance in the following development that aforesaid toner particles may return to the sleeve. This is a basis for the aforesaid item (1) which means that the toner particles having a small charge amount used in the early development are prevented from their returning to the sleeve in the following development. Item (2) is a method for avoiding the returning of toner particles adhered on the photoreceptor drum 41 by reducing gradually the electric field strength as the development is repeated (namely, as moving to the later development). As a practical method for reducing the electric field strength, a method for lowering gradually the voltage of insulating component and a method for broadening gradually the distance d between the photoreceptor drum 41 and the sleeve 7 as the development advances toward the last one, are avaiable Further, aforesaid item (3) is a method for preventing toner particles adhered on the photoreceptor drum 41 from returning by enhancing gradually the frequency of insulating component as the development is repeated. These methods (1), (2) and (3) are effective even if they are used independently but they are more effective if they are usd in combination thereof such as, for example, that the charge amount of toner is gradually enhanced and the insulating bias is gradually reduced concurrently as the development is repeated. Further, when aforesaid three methods are used, it is possible to maintain the optimum image density or color balance by controlling the D.C. bias for each case.

Based on the aforesaid results, the inventors of the present invention formed multi-color images under the conditions of following Table 5 by the use of the photoreceptor wherein the color-separation filters having the form shown in FIG. 24(*b*) are printed on the insulating layer as shown in FIG. 25(*b*). The results of the multicolor images thus formed were that the recorded image showed an excellent color reproduction and it hardly showed moire phenomena.

TABLE 5

| | |
|---|---|
| Photoreceptor: | Photoconductive layer: CdS (40 μm thick)<br>Filter: mosaic pattern {FIG. 24(b)} (20 μm thick)<br>lr = 30 μm<br>Drum diameter: 180 mm<br>Line speed: 150 mm/sec. |
| Developing unit: (FIG. 5) | Sleeve: Made of non-magnetic stainless steal<br>Diameter = 30 mm<br>Revolving speed:<br>linear speed = 150 mm/sec.<br>Magnet roll: Number of poles: 8<br>Magnetic flux density: max. 800 G (sleeve surface)<br>Revolving speed: 300 r.p.m. |
| Distance between sleeve and photoreceptor | 0.75 mm |
| Developer | Toner (black, yellow, magenta, cyan)<br>Average particle size: 10 μm<br>Negative charging: −10∼−20 μc/g<br>Carrier: Magnetic substance with resins dispersed<br>Average particle size: 25 μm<br>Specific resistance: $10^{13}$ Ω.cm and over<br>Mixing ratio by weight:<br>toner: carrier = 1:4 |
| Thickness of developing layer: | 0.4 mm |
| Initial charging voltage | +1.5 KV (by means of Corotron) |
| Voltage of simultaneous charging with image-exposure | −200 V (by means of Scorotron) |
| Uniformalized voltage | −200 V (by means of Scorotron) |
| Developing bias (common) | D.C. −15 V<br>A.C. 1.0 KV (effective value, 2 KHz |

In addition to the developing method explained above, a variation of a developing method wherein the photoreceptor is not rubbed was already explained.

Further, another constitution of the present invention is the one wherein the photoreceptor is constructed in the order of a transparent insulating layer, a photosensitive substance layer, a conductive layer and a filter and the development is made from the transparent insulating layer side by giving the primary and secondary charging from the transparent insulating layer side and by giving from reverse side an image-exposure and flood-exposure from the filter side. Aforesaid explanations are all on the example of a color copying machine wherein so-called color-separation filters and toners in three primary colors are used but the embodiment of the present invention is never be limited to the foregoing and may be embodied as various types of multi-color-image-reproducing apparatuses or as a printer for color photographs and others. It is naturally possible to select freely the combination of the color of color-separation filter and the color of toner corresponding to the former, according to the purpose.

In the aforesaid process for forming the multi-color images, it is not necessarily be required that the light of each uniform exposure is the light of B, G and R. Namely. at the filter portion where the uniform exposure has penetrated, the charges on the boundary surface between the insulating layer and the photoconductive layer have been eliminated and thereby no portions in surface potential is made even if the light penetrates again. Therefore, it is possible to obtain multi-color images wherein the colors of document are reproduced satisfactorily even if the uniform exposures are made in the order of red light, yellow light and white light, for example, and the developments are made in the order of cyan toner, magenta toner and yellow toner each of which corresponds to each of the colors of foregoing light. Without being limited to the foregoing, it is naturally possible to give the uniform exposure by means of other light in spectral distribution. What is essential is that the potential pattern is formed only on the filter of specific kind. Incidentally, when the uniform exposure light penetrates twice or more through the filter on a part of the photoreceptor as shown in the foregoing, it is preferable to apply the light to the photoreceptor in order to eliminate completely the charges on the boundary surface between the insulating layer and the photoconductive layer after the development. It is further possible to charge in many ways the pattern and the layout of the filters on the photoreceptor without being limited to the foregoing.

Since it is possible for the light of a certain color to penetrate two kinds or more of filters among plural filters having spectral percent transmission characteristics which differ each other, an edge effect can be moderated to the desired degree and the color-reproduction can be performed satisfactorily when finely-divided latent images are developed. In addition to that, due to the complicated regularity of spectral percent transmission of each color-separation filter portion, it is possible to reduce the occurrence of the moire caused by the interference between the spatial frequency of the foregoing and the spatial frequency of the original image such as a document and others.

Further, since the process including a flood-exposure with the light penetrating at least one kind of color-separation filter and the development is repeated after forming the electrostatic latent image caused by an image-exposure, it is possible to reduce the number of flood-exposures and image-exposures which have been required to be plural times to only one time and therby it is also possible to achieve the materialization of the apparatus which is small in size, high speed and reliable because the positioning of each image is not necessary for transferring. Reproduced matter obtained is of a high image quality without any color-slip.

Figure 27:
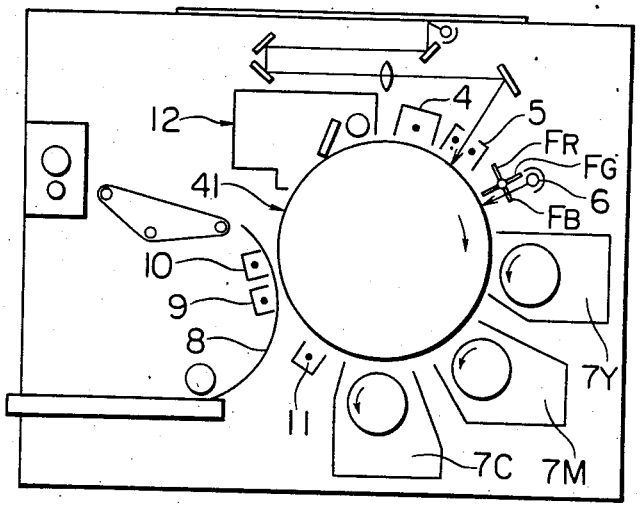
FIG. 27 illustrates a schematic structure of the multi-color image reproducing apparatus in which the processes shown in FIG. 28 of a still further example of the invention can be embodied.

FIG. 27 illustrates also a multi-color image reproducing apparatus provided with a photoreceptor 41 having such mosaic formed filters as shown in FIGS. 1 and 2, and the photoreceptor 41 is formed in a drum-shape and is rotated in the direction of the arrow. It is, however, to be understood that the invention shall not be limited thereto, but it is allowed that such photoreceptor 41 may also be formed in the belt-shape.

In the case that the three kinds of filters are distributed as shown in FIG. 2, it is preferred that a length of a cycle of the repetition arrangements of the filters may be such a width or a size as is from 30 to 300 μm. It is a matter of course that the invention shall not be limited only to the kinds of the filters of R, G and B, but the above-mentioned preferable length will be varied according to the variations of the number of the kinds thereof.

With reference to FIG. 28, a description will now be made in advance about the principle of the formation of a multi-color image with the image reproducing apparatus provided such a photoreceptor 41 as shown in FIG. 27. FIG. 28 illustrates an example in which such an n-type semi-conductive photoconductor as cadmium sulfide is used in the photoconductive layer 3 of the photoreceptor 41, and like reference characters designate corresponding functional members shown in FIG. 27.

FIG. 28[2] illustrates such a state that the photoreceptor 41 is being rotated and is charged uniformly by a positive corona-discharge from charger 4. In this state, a positive charge is generated on the surface of insulating layer 3 and correspondingly a negative charge is induced on the boundary surface between photoconductive layer 2 and insulating layer 3, and resultantly the surface potential E of the photoreceptor 41 will be uniformed as shown in the graph.

FIG. 28[2] illustrates the variation of the charged surface of the photoreceptor 41 taken place by the red-color component $L_R$ out of the imagewise exposure lights having been incident from image-exposure device 5 to the above-mentioned charged surface of the photoreceptor 41. In the drawing, the image-exposure device 5 is also provided with discharger 5 and while an A.C. charge or a charge having an opposite signal to that of charger 4 is kept on discharging thereby, so as to give an image-exposure to the photoreceptor 41. The red-color component $L_R$ passes through the R-filter portions of insulating layer 3 to make conductive the corresponding portions of the photoconductive layer 2 arranged underneath the insulating layer 3, therefore, in the R-filter portions, there eliminates the negative charge having been induced on the boundary surface between the photoconductive layer 2 and the insulating layer 3. On the other hand, the red-color component $L_R$ does not pass through G- and B-filter portions, therefore, the negative charges induced in the photoconductive layer 2 will remain as they are in these portions. Consequently, the surface potentials E of the photoreceptor 41 are uniformed by discharger 5 of the image-exposure device, in the R-filter portions where the negative charge was eliminated, as well as in the G- and B-filter portions where the negative charges still remain. The reason thereof is that the positive charge generated on the surface of the insulating layer 3 is so distributed as to correspond to the negative charge induced in the boundary between the photoconductive layer 2 and the insulating layer 3 so as to keep the balance. The green component and the blue component of the image-exposure will also bring out the similar results. Therefore, in the sate that an image-exposure is made by an image-exposure device onto the surface of the photoreceptor 41, no electrostatic image function will be displayed.

A further description will be omitted, because the succesive processes are similar to those shown in FIG. 4.

FIG. 28[5] illustrates a state that the surface potentials of a photoreceptor 41 are uniformed by making use of the discharger 5 of an image-exposure device. In this process, there is no influence which may extend on the charge distribution in the R- and G-filter portions between insulating layer 3 and photoconductive layer 2.

Next, photoreceptor 41 having formed thereon a yellow toner image as shown in FIG. 28[5] is uniformly exposed to a green-light obtained by passing the light from lamp 6 through filter $F_G$. Resultantly, a potential pattern is produced at this time in the G-filter portions so as to give a complementary color image to green color, as is described in FIG. 28[3]. When developing this electrostatic latent image with developing device 7M containing magenta toners, the magenta toners adhere only to the G-filter portions to form a magenta image, as illustrated in FIG. 28[4]. Thereby, the two different color toner images are superposed together. In the similar manner, a cyan toner development may be carried out.

In the above-mentioned processes, there is formed on a photoreceptor 41 a three-color toner image without having any color-slippage and any color turbidity.

Based on the above-mentioned principle, a multi-color image reproducing apparatus illustrated in FIG. 27 can form multi-color images. Namely, a drum-formed photoreceptor 41 having such a layer arrangement as aforementioned is rotated in the direction of the arrow and according to the rotation thereof, the following processes are carried out.

The surface of a photoreceptor 41 is charged by charger 4 so as to make the potentials uniform, and while the charged surface of the photoreceptor 41 is being exposed imagewise to a light reflected from the surface of an original document irradiated by an image-exposure device, a corona-discharge is applied to the surface of the photoreceptor 41 by means of the discharger 5 of the image-exposure device, so that the surface potentials of the surface of the photoreceptor 41 may be made constant. In this case, such a discharge made by the discharger 5 is of an A.C. or of an opposite signal to that of the charger 4. Next, a uniform exposure is made to a light obtained by a combination of lamp 6 and anyone of filters $F_B$, $F_G$ and $F_R$; and the resulting electrostatic latent image is developed with anyone of the developing devices 7Y, 7M and 7C. In this instance, the filters $F_B$, $F_G$ and $F_R$ are those capable of transmitting such a light as blue, green and red, for example; and the developing devices 7Y, 7M and 7C are those containing, for example, yellow toners, magenta toners and cyan toners, respectively. After the above-mentioned processes are carried out, the partly developed image area reaches again the position of the image-exposure device without receiving any actions of the other developing devices, a pre-transfer charger 11, transferring device 9, a separating device 10 a cleaning device 12 and charger 4. In this position, the charger 5 of the image-exposure device carries out only a discharge to uniform the surface potentials in the image areas of the photoreceptor 41, and then the surface of the photoreceptor in the image areas is irradiated uniformly by a light which is emitted from lamp 6 and passed through a filter different from that illustrated in the previous drawing. By this irradiation of the light, there is formed an electrostatic latent image, on the previously developed surface of the photoreceptor 41, comprising a color component different from that in the last time. The resulted electrostatic latent image is developed by the different developing device from that in the last time, and the electrostatic latent images of the remaining color components are formed and developed respectively in the similar manner, and then the desired number of color toner images or all the three-color toner image are superposed altogether.

In the above-mentioned image forming processes, it is desired to form an image in such a manner that filters $F_B$, $F_G$ and $F_R$ and developing devices 7Y, 7M and 7C are to be combined each other so as to be in a complementary color relation. However, the invention shall not be limited thereto.

The multi-color image reproducing apparatus described in reference to FIG. 27 is so simply constructed as to attach two units of the developing devices to a monocolor copying machine. In such an apparatus, there is no instance at all where any of the three color toner images is slipped in position and there is no necessity at all for providing any special machanism or strict requirement to the driving systems of the photoreceptor 41 and the like. Such an apparatus as mentioned above can therefore be made very compact in size as compared with any of the conventional color image reproducing apparatuses. In addition to the above description, the spectral characteristics of a light to be used for flood-exposures may be obtained from using filters of green (G), blue (B) and red (R), and besides they may also be obtained by the other means than the filters, and further, such spectral characteristics thereof shall not be limited thereto, and, in conclusion, such spectral characteristics shall be good enough if they are capable of forming a potential pattern in only the specific filter portions corresponding to a specific light irradiated onto a photoreceptor through a flood-exposure to the specific light.

To be more concrete, in the image reproducing apparatus illustrated in FIG. 27, an excellently reproduced color image without any color-slippage was obtained when a copy of a three-color image was tried under the following conditions:

In the photoreceptor 41, it is capable of rotating in the direction of the arrow, and it comprises a photoconductive layer 2 having such a layer arrangement as shown in FIG. 2(*d*) comprising CdS of 30 μm in thickness, and an insulating layer of 20 μm in thickness containing a filter layer of which the length l of the R, G and B filter portion shown in FIG. 3(*b*) is 100 μm, and the photoreceptor size is 120 mm in diameter;

Charger 4 is to be that capable of setting the potential of the photoreceptor 41 to 1.5 KV after charging with a Colotron discharger., 7 Discharger 5 of an image-exposure device is to be that capable of setting the potential of the photoreceptor 41 to −200 V after discharging with a Scolotron discharger., Each of developing devices 7Y to 7C are to be the respective magnetic brush developing devices in which a developing sleeve of 25 mm in outer diameter comprising a non-magnetic stainless steel is rotated counterclockwise at a revolving speed of 153 rpm, and a magnet member provided inside the sleeve and having eight magnetic poles arranged in the circumferential direction so as to generate a magnetic flux density of 800 G at maximum on the surface of the developing sleeve and is then rotated clockwise at a revolving speed of 800 rpm so as to transport a developer layer;

The gap between the surfaces of the photoreceptor 41 and the developing sleeve of each developing device 7Y to 7C is provided to be 1 mm;

In the developing devices 7Y to 7C, there uses the developer comprising toners and carriers each mixed up at a ratio of 1:4 by weight out of which the toners are of 10 μm in the average particle size of the respective yellow, magenta and cyan toner particles and −10 to −20 μc/g in frictional charged volume, and the carriers each comprise resins of 25 μm in average particle size in which magnetic substances of not lower than $10^{13}\Omega$.cm in specific resistance are dispersed;

The thickness of the developer layer to be formed on the developing sleeve of each developing device is to be 0.5 mm; and When each developing device carries out the respective developments, the developing sleeve is to be applied with a developing bias which is overlapped with a D.C. voltage of −150 V and A.C. voltage of 1 KV in terms of effective value and 2 KHz of frequency.

It is needless to say that the number of kinds or the colors of the separation filters, and the color-combination of the toners corresponding to the separation filters may be able to select arbitrarily in accordance with the purposes. For example, the following process is also possible to devise in order to obtain a copied matter in two colors, red and black. In other words, in such a process, a photoreceptor in which only G-filters are scatteringly distributed may be used to follow a process basically similar to the above-mentioned process, provided that the uniform exposure or the flood-exposure is to be made by a red or blue light and a green light and the development is to be made with black toners and red toners. Resultantly, the areas corresponding to the red portions of an original document will be reproduced into red, and the other colors will be reproduced into black. In this case, it is possible to regard as that the no filter portions of the photoreceptor are to be the transparent filter portions thereof.

In the multi-color image reproducing apparatuses of the invention, no color-slippage is taken place at all in a multi-color images, because a single image-exposure is enough to form every independent color electrostatic latent image, and particularly in the example of the invention, the driving mechanism of the photoreceptor, the exposure-scanning system and the like can simply be structured similar to the case of mono-color copying machines, and a newly addition of a plurality of dischargers is not required for uniforming the surface potentials of the photoreceptor after developing, if the dischargers of the image-exposure device are commonly used. It is thereby possible to make the apparatuses more compact in size and to more improve the reliability of multi-color image information, and further to enjoy such an excellent condition that high-quality multi-color images without any color-slippage can be reproduced at a high speed.

As mentioned above, various examples of the invention and the effects thereof are described. All the descriptions relates to the methods and the apparatuses of reproducing a multi-color images by making use of a photoreceptor having mosaic-shaped filters or those similar thereto, and the every embodiments of the invention can be achieved by making use of a non-contact type deVeloping method in which a high quality multi-color image without any color-slippage can be obtained by a single image-exposure.

What is claimed is:

1. A method for reproducing a multi-colored image comprising 1. providing a photoreceptor having a photoconductive layer on a conductive member and an insulating layer including a filter layer having groups of fine-fibers distributed therein, each of said groups being capable of passing a specific color, said insulating layer on said photoconductive layer,
2. charging said photoreceptor with a charging means whereby a first substantially uniform charge is placed thereon,
3. imagewise exposing the surface of said photoreceptor in the presence of an alternating current or a charge opposite to said uniform charge,
4. uniformly exposing said surface with light corresponding to said specific color, whereby a potential pattern is formed on portions of said photoreceptor corresponnding to said specific color,
5. developing said potential pattern by a toner of appropriate color,
6. repeating said uniformly exposing said developing, and
7. subjecting said surface to a second substantially uniform charge opposite to said first uniform charge, before said uniformly exposing in said repating whereby deposition of said toner on unwanted areas is minimized.

2. The method of claim 1 wherein said surface has a substantially uniform surface potential thereon before each said uniformly exposing after said developing said potential pattern by a toner of appropriate color.

3. The method of claim 1 wherein at least part of the surface potential remaining on said photoconductive layer is eliminated.

4. The method of claim 3 wherein said surface potential remaining is in areas corresponding to those to which toners adhere.

5. The method of claim 1 wherein, in said repeating, said developing is carried out so that a developer layer on a developing device makes no substantial dontact with said surface.

6. A method for reproducing a multi-colored image comprising 1. providing a photoreceptor having an insulating layer containing a first plurality of first filters capable of transmitting the short wavelengths of visible light, a second plurality of second filters capable of transmitting the medium wavelength of visible light, and a third plurality of third filters capable of transmitting the long wavelength of visible light, a photoconductive layer having a spectral sensitivity covering substantially the entire wavelength region of visible light, and a conductive base member,
2. charging said photoreceptor with a charging means whereby a first substantially uniform charge is placed thereon,
3. imagewise exposing the surface of said photoreceptor in the presence of an alternating current or a charge opposite to said first uniform charge,
4. forming a primary electrostatic image by uniform exposure of said surface to a primary light which contains a component capable of passing through one said plurality of said filters and containing substantially no component capable of passing through the other pluralities of said filters,
5. developing said primary image by a first color toner,
6. at least partly evening the potentials remaining on said surface by charging with a second uniform charge opposite to said first uniform charge, after developing said primary image,
7. forming a secondary electrostatic image by uniform exposure of asid surface to a secondary light which contains a component capable of passing through another said plurality of said filters and containing substantially no component capable of passing through the remaining plurality of said filters, and
8. developing said secondary image by a second color toner.
7. The method of claim 6 further comprising
9. at least partly evening the potentials remaining on said surface, by charging with a tertiary uniform charge opposite to said first uniform charge, after developing said secondary image,
10. forming a tertiary electrostatic image by uniform exposure of said surface to a tertiary light which contains a component capable of passing through at least said remaining plurality of said filters, and
11. developing said tertiary image by a third color toner.

8. The method of claim 7 wherein said tertiary light is white light.

9. The method of claim 8 wherein said primary light is a red light capable of passing through said first filters and second secondary light is a yellow light capable of passing through said second filters.

10. The method of claim 1 wherein said repeating takes place at least twice.

11. The method for reproducing multi-color images as claimed in claim 1 wherein there are distributed mutually different spectral transmission characteristics of a layer of plural kinds of fine filters contained in said insulating layer, and wherein at least two kinds of said filters are capable of substantially transmitting a light in any hue.

12. The method for reproducing multi-color images as claimed in claim 11 wherein a layer provided on said photoreceptor comprises plural kinds of filters, among said fine filters, which are capable of transmitting mainly the rays of light of an identical hue and are mutually different in a maximum percent transmission and/or a maximum transmission wavelength of light.

* * * * *